US010370218B2

(12) United States Patent
Tracey et al.

(10) Patent No.: US 10,370,218 B2
(45) Date of Patent: Aug. 6, 2019

(54) REEL WITH MANUALLY ACTUATED RETRACTION SYSTEM

(71) Applicant: Great Stuff, Inc., Austin, TX (US)

(72) Inventors: James B. A. Tracey, Austin, TX (US); Joseph M. Hill, III, Austin, TX (US); Johnathan R. Tracey, Austin, TX (US)

(73) Assignee: GREAT STUFF, INC., Austin, TX (US)

( * ) Notice: Subject to any disclaimer, the term of this patent is extended or adjusted under 35 U.S.C. 154(b) by 0 days.

(21) Appl. No.: 15/701,299

(22) Filed: Sep. 11, 2017

(65) Prior Publication Data

US 2017/0369273 A1 Dec. 28, 2017

Related U.S. Application Data

(63) Continuation of application No. 14/719,092, filed on May 21, 2015, now Pat. No. 9,771,239, which is a continuation of application No. 13/802,398, filed on Mar. 13, 2013, now Pat. No. 9,067,759.

(60) Provisional application No. 61/674,209, filed on Jul. 20, 2012, provisional application No. 61/674,241, filed on Jul. 20, 2012, provisional application No. 61/706,657, filed on Sep. 27, 2012.

(51) Int. Cl.
*B65H 75/44* (2006.01)

(52) U.S. Cl.
CPC ..... *B65H 75/4486* (2013.01); *B65H 75/4484* (2013.01)

(58) Field of Classification Search
CPC ..... B65H 75/44
USPC ..... 318/3, 34
See application file for complete search history.

(56) References Cited

U.S. PATENT DOCUMENTS

| | | | |
|---|---|---|---|
| 2,039,915 | A | 12/1934 | McCoy |
| 2,262,462 | A | 5/1941 | Margis, Jr. |
| 2,353,639 | A | 11/1941 | Bethold et al. |

(Continued)

FOREIGN PATENT DOCUMENTS

| | | |
|---|---|---|
| DE | 556596 | 8/1932 |
| DE | 4407195 | 4/1995 |

(Continued)

OTHER PUBLICATIONS

U.S. Appl. No. 15/607,236, filed May 26, 2017, Tracey et al.

(Continued)

*Primary Examiner* — David Luo
(74) *Attorney, Agent, or Firm* — Knobbe, Martens, Olson & Bear, LLP

(57) ABSTRACT

A reel has a spool member on which the linear material is spooled, an electric motor that rotates the spool member, and a controller that controls the operation of the motor. The controller monitors an unwound length of the linear material based on sensed rotation of the spool member by one or more sensors. The controller causes the electric motor to wind the linear material around the spool member, for example, upon detection of a pulling force on the linear material over a pull distance within a predetermined range, but, for example, does not trigger the winding of the linear material if the pull distance is greater than the predetermined range. The controller can cause the electric motor to stop winding of the linear material upon detection of a force on the linear material that holds the linear material in place.

25 Claims, 27 Drawing Sheets

(56) References Cited

U.S. PATENT DOCUMENTS

| | | | | |
|---|---|---|---|---|
| 2,507,297 | A | 5/1950 | Bouget | |
| 3,160,173 | A | 12/1964 | Bowen | |
| 3,512,733 | A | 5/1970 | Ault | |
| 3,558,026 | A | 1/1971 | Rosen | |
| 3,788,575 | A | 1/1974 | Boettcher et al. | |
| 3,835,571 | A | 9/1974 | Berry | |
| 4,241,884 | A | 12/1980 | Lynch | |
| 4,454,999 | A | 6/1984 | Woodruff | |
| 4,537,364 | A | 8/1985 | Pollman et al. | |
| 4,565,099 | A | 1/1986 | Arnold | |
| 4,655,399 | A | 4/1987 | Harvey | |
| 4,666,097 | A | 5/1987 | Tsuge et al. | |
| 4,708,301 | A | 11/1987 | Kataoka | |
| 4,718,168 | A | 1/1988 | Kerr | |
| 4,744,696 | A | 5/1988 | Vidler | |
| 4,775,086 | A | 10/1988 | Kataoka | |
| 4,787,569 | A | 11/1988 | Kanada et al. | |
| 4,852,263 | A | 8/1989 | Kerr | |
| 4,893,037 | A | 1/1990 | Schwartz | |
| 4,910,444 | A | 3/1990 | Kilstroem et al. | |
| 5,005,777 | A | 4/1991 | Fernandez | |
| 5,160,055 | A | 11/1992 | Gray | |
| 5,294,066 | A | 3/1994 | Lacour | |
| 5,398,911 | A | 3/1995 | Holster | |
| 5,440,820 | A | 8/1995 | Hwang | |
| 5,495,995 | A | 3/1996 | Dominique et al. | |
| 5,502,358 | A | 3/1996 | Lee | |
| 5,526,997 | A | 6/1996 | Karczmer et al. | |
| 5,762,282 | A | 6/1998 | Woner | |
| 5,793,174 | A * | 8/1998 | Kovach | E06B 9/262 318/16 |
| 5,808,824 | A | 9/1998 | Kaniwa et al. | |
| 5,841,259 | A | 11/1998 | Kim et al. | |
| 6,057,658 | A | 5/2000 | Kovach et al. | |
| 6,142,406 | A | 11/2000 | Newman | |
| 6,149,096 | A | 11/2000 | Hartley | |
| 6,181,089 | B1 | 1/2001 | Kovach et al. | |
| 6,279,848 | B1 | 8/2001 | Mead, Jr. | |
| 6,369,530 | B2 * | 4/2002 | Kovach | E06B 9/32 318/16 |
| 6,474,588 | B2 | 11/2002 | Valverde | |
| 6,474,922 | B2 | 11/2002 | Bachman et al. | |
| 6,536,615 | B2 | 3/2003 | Nishikino et al. | |
| 6,672,529 | B2 | 1/2004 | Cain et al. | |
| 6,782,662 | B2 | 8/2004 | McCartney et al. | |
| 6,913,221 | B2 | 7/2005 | Moon et al. | |
| 6,941,802 | B2 | 9/2005 | Brown | |
| 6,983,907 | B2 | 1/2006 | Ikuta et al. | |
| 6,995,682 | B1 | 2/2006 | Chen et al. | |
| 7,028,989 | B2 | 4/2006 | Flynn et al. | |
| 7,108,218 | B2 | 9/2006 | Chapman et al. | |
| 7,150,425 | B2 | 12/2006 | Banaszkiewicz et al. | |
| 7,150,572 | B2 | 12/2006 | McNestry et al. | |
| 7,159,851 | B1 | 1/2007 | Ross et al. | |
| 7,175,122 | B2 | 2/2007 | Bui et al. | |
| 7,185,881 | B2 | 3/2007 | Drarvik et al. | |
| 7,207,746 | B1 | 4/2007 | Legun | |
| 7,331,436 | B1 | 2/2008 | Pack et al. | |
| 7,350,736 | B2 * | 4/2008 | Caamano | B65H 75/403 242/390.9 |
| 7,364,106 | B2 | 4/2008 | Bui et al. | |
| 7,419,038 | B2 | 9/2008 | Caamano et al. | |
| 7,431,268 | B2 | 10/2008 | Steiner et al. | |
| 7,503,338 | B2 | 3/2009 | Harrington et al. | |
| 7,533,843 | B2 | 5/2009 | Caamano et al. | |
| 7,644,442 | B2 | 1/2010 | Miller et al. | |
| 7,682,094 | B2 | 3/2010 | McNestry et al. | |
| 7,688,010 | B2 | 3/2010 | Caamano et al. | |
| 7,692,393 | B2 | 4/2010 | Caamano et al. | |
| 7,722,268 | B2 | 5/2010 | McNestry et al. | |
| 7,748,917 | B2 | 7/2010 | McNestry et al. | |
| D626,818 | S | 11/2010 | Tracey | |
| 7,838,892 | B2 | 11/2010 | Wirth | |
| D632,548 | S | 2/2011 | Tracey et al. | |
| 8,006,958 | B2 | 8/2011 | Starks et al. | |
| 8,695,912 | B2 | 4/2014 | Tracey et al. | |
| 8,746,605 | B2 | 6/2014 | Tracey et al. | |
| 8,801,458 | B2 | 8/2014 | Ceraldi et al. | |
| 9,067,759 | B2 | 6/2015 | Tracey et al. | |
| 9,663,322 | B2 | 5/2017 | Tracey et al. | |
| 9,771,239 | B2 | 9/2017 | Tracey et al. | |
| 2002/0011537 | A1 | 1/2002 | Durrstein et al. | |
| 2004/0155137 | A1 | 8/2004 | Sharpe et al. | |
| 2004/0231723 | A1 | 11/2004 | Harrington et al. | |
| 2005/0040276 | A1 | 2/2005 | Sharpe et al. | |
| 2005/0082517 | A1 | 4/2005 | Steiner et al. | |
| 2005/0087644 | A1 | 4/2005 | Kim et al. | |
| 2006/0000936 | A1 | 1/2006 | Caamano et al. | |
| 2006/0266605 | A1 | 11/2006 | Caamano et al. | |
| 2007/0194163 | A1 | 8/2007 | Okonsky | |
| 2008/0023579 | A1 | 1/2008 | Leonard | |
| 2008/0074893 | A1 | 3/2008 | Ham | |
| 2008/0223951 | A1 | 9/2008 | Tracey et al. | |
| 2010/0102775 | A1 | 4/2010 | Chander et al. | |
| 2014/0021284 | A1 | 1/2014 | Tracey et al. | |
| 2015/0307318 | A1 | 10/2015 | Tracey et al. | |
| 2017/0355552 | A1 | 12/2017 | Tracey et al. | |

FOREIGN PATENT DOCUMENTS

| | | |
|---|---|---|
| DE | 20304085 | 7/2003 |
| EP | 0 289 475 | 11/1988 |
| EP | 0 841 743 | 5/1998 |
| EP | 0 953 536 | 11/1999 |
| EP | 1 457 450 | 9/2004 |
| FR | 2630419 | 10/1989 |
| GB | 946662 | 1/1964 |
| GB | 2 055 488 | 3/1981 |
| JP | 10-297821 | 11/1998 |
| JP | 11-21022 | 1/1999 |
| JP | 2000-219435 | 8/2000 |
| JP | 2003-221166 | 8/2003 |
| JP | 2004-059302 | 2/2004 |
| JP | 2004-067328 | 3/2004 |
| JP | 2007-070008 | 3/2007 |
| JP | 2007-519508 | 7/2007 |
| WO | WO 95/09123 | 4/1995 |
| WO | WO 98/21138 | 5/1998 |
| WO | WO 2008/040349 | 4/2008 |
| WO | WO 2010/015966 | 2/2010 |
| WO | WO 2012/145435 | 10/2012 |

OTHER PUBLICATIONS

Nordic, Hose Boss Rewind Assist, found at http://www.archive.org/web/20031212090707/http://www.nordicsystems.com.hoseboss.php, dated Dec. 12, 2003.

International Search Report and Written Opinion dated Apr. 27, 2006; Appl. No. PCT/US2005/023652, 13 pages.

ThomasNet News, Thomas Publishing Company, Wire Pay-Out is suited for traverse wound reels, http://news.thomasnet.com/fullstory/454371 as of Aug. 10, 2004.

Warn Industries, The Basic Guide to Winching Techniques, http://www.warn.com/corporate/images/90/TechGuide_PN62885-A2.pdf as of Aug. 24, 2009.

General Machine Products Co., General Machine Products Co., Inc., Terminal Wire Reel, http://www.gmptools.com/nf/80470.htm as of Aug. 24, 2009.

Vimala, P., and K. Narayanan, Indirect Tension Control for Winder, Proceedings of the 2007 International Conference on Embedded Systems & Applications, ESA 2007, Jun. 25-28, 2007, pp. 74-80, CSREA Press, Las Vegas NV.

Ishihara, et al., AC Drive System for Tension Reel Control, Industry Applications, Jan. 1985, pp. 147-153, vol. IA-21-Issue 1.

International Search Report and Written Opinion dated Jul. 11, 2012, for International Application No. PCT/US2012/034126, filed Apr. 18, 2012, in 13 pages.

International Search Report and Written Opinion dated Oct. 18, 2012, for International Application No. PCT/US2012/034128, filed Apr. 18, 2012, in 10 pages.

(56) References Cited

OTHER PUBLICATIONS

Communication relating to the results of a partial International Search Report dated Nov. 12, 2005, in Application No, PCT/US2005/023652, 5 pages.
European Search Report dated Oct. 28, 2010 for application No. 10178366.0.
Extended European Search Report dated Sep. 25, 2014 for European Patent Application No. 12774125.4, filed on Sep. 27, 2013. 6 pages.
Vimala, P., and K. Narayanan, Abstract of "Indirect Tension Control for Winder," Proceedings of the 2007 International Conference on Embedded Systems & Applications, ESA 2007, Jun. 25-28, 2007, CSREA Press, Las Vegas NV.

* cited by examiner

| FIG. 5A-1 | FIG. 5A-2 |
|---|---|

| FIG. 5G-1 | FIG. 5G-2 | FIG. 5G-3 |
|---|---|---|

REEL WITH MANUALLY ACTUATED RETRACTION SYSTEM

CROSS-REFERENCE TO RELATED APPLICATIONS

This application is a continuation of U.S. patent application Ser. No. 14/719,092, filed May 21, 2015, entitled AUTOMATIC REEL DEVICES AND METHOD OF OPERATING THE SAME, which is a continuation of U.S. patent application Ser. No. 13/802,398, issued as U.S. Pat. No. 9,067,759, filed Mar. 13, 2013, entitled AUTOMATIC REEL DEVICES AND METHOD OF OPERATING THE SAME, which claims the benefit of U.S. Provisional Application No. 61/674,209, filed Jul. 20, 2012, entitled REEL WITH MANUALLY ACTUATED RETRACTION SYSTEM, U.S. Provisional Application No. 61/674,241, filed Jul. 20, 2012, entitled WALL, CEILING OR BENCH MOUNTED REEL WITH AUTOMATIC POWER ADJUSTMENT, and U.S. Provisional Application No. 61/706,657, filed Sep. 27, 2012, entitled AUTOMATIC REEL DEVICES AND METHOD OF OPERATING THE SAME, the entirety of each of which is incorporated herein by reference. Certain structures and mechanisms described or otherwise referenced herein are illustrated and described in the following U.S. Pat. Nos. 6,279,848; 7,350,736; 7,503,338; 7,419,038; 7,533,843; D 632,548; and D 626,818, which are hereby incorporated herein by reference in their entireties and should be considered a part of this specification. Other structures and mechanisms described or otherwise referenced herein are illustrated and described in the following U.S. patent application publications: U.S. Patent App. Publ. Nos. US2007/0194163 A1 and US2008/0223951 A1, which are hereby incorporated herein by reference in their entireties and should be considered a part of this specification. U.S. patent application Ser. No. 13/448,784, filed Apr. 17, 2012, entitled REEL SYSTEMS AND METHODS FOR MONITORING AND CONTROLLING LINEAR MATERIAL SLACK, U.S. patent application Ser. No. 13/449,123, filed Apr. 17, 2012, entitled SYSTEMS AND METHODS FOR SPOOLING AND UNSPOOLING LINEAR MATERIAL, and U.S. application Ser. No. 13/802,638, filed Mar. 13, 2013, entitled REEL WITH MANUALLY ACTUATED RETRACTION SYSTEM are also hereby incorporated by reference in their entirety and should be considered a part of this specification.

BACKGROUND

Field

The present disclosure relates generally to systems and methods for spooling and unspooling linear material and, in particular, to a motorized device having a controller for controlling the spooling and/or unspooling of linear material.

Description of the Related Art

Linear material, such as hoses, cords, cables, and the like, can be cumbersome and difficult to manage. Reels and like mechanical devices have been designed to help unspool such linear material from a rotatable spool member or a drum-like apparatus from which it can be deployed and wound upon. Some conventional devices are manually operated, requiring the user to physically rotate the spool member or drum to spool (wind in) the linear material and to pull, without any assistance, when unwinding. This can be tiresome and time-consuming for users, especially when the material is of a substantial length or is heavy, or when the drum or spool member is otherwise difficult to rotate. Other devices are motor-controlled, and can automatically wind in the linear material. These automatic devices often have a gear assembly wherein multiple revolutions of the motor produce a single revolution of the spool member or drum. For example, some conventional automatic devices have a 30:1 gear reduction, wherein 30 revolutions of the motor result in one revolution of the spool member or drum.

However, some existing methods of winding linear material have encountered problems related to winding an end portion of the linear material around a spool member, particularly when at least a portion of linear material must be wound in a vertical direction (i.e., if the spooling unit is mounted off the floor). For example, the winding of linear material can be affected by a variance in the strength of the electric motor, as well as by the ambient temperature surrounding the system, which may affect the operation of the electric motor.

Such automatic devices can be very complex to operate and can require use of a remote control that can be difficult to operate and requires the user to gain familiarity with the operation of the remote control. Also, as the remote controls are generally battery powered, use of the remote control requires periodically changing its batteries, which can be cumbersome and time consuming.

SUMMARY

A need exists for improved reel assembly for spooling linear material, as well as for improved methods of automatically winding the linear material during use.

In some embodiments, a reel assembly can have an enclosure for housing a spool member. A linear material can be spooled onto the spool member. The linear material can be, for example, an electrical cord, a water hose, an air hose, or any similar cord/cable. The housing (enclosure) can be on a frame that can be supported on a ground surface or mounted on a ceiling. The device can have a motor for winding and unwinding (spooling or unspooling) the linear material to facilitate, for example, hose or cable management.

To help manage the linear material, the reel assembly can implement various features to help improve ease of use depending on, for example, the type of linear material and/or the particular amount of the linear that is being wound and unwound. The user can grasp the end of the linear material and extract the linear material to a desired length and location. The reel assembly can sense that the user is extracting the linear material and does not engage the motor to wind the linear material onto the spool member. Upon sensing that the user is extracting the linear material, the reel assembly may provide a forward assist to help unwind the linear material from the spool member. For example, the reel assembly may engage the motor to rotate the reel assembly in a direction that unwinds the linear material at a desired speed (e.g., unwinds at about the same speed with which the user is extracting the linear material). When the reel assembly does not receive any further commands (winding initiation as discussed below) or sense a change in deployed length of the linear material, the reel assembly can turn off (e.g., enter a sleep state with reduced power consumption).

After using the linear material, the user can engage winding of the linear material onto the spool member by pulling the linear material in the payout direction (further extract the linear material from the reel assembly) by a predetermined amount. When the reel assembly senses that the user has pulled on the linear material for the predetermined amount, the reel assembly initiates winding of the linear material onto the spool member. During winding of the linear material, the linear material may get caught by an obstruction (e.g., pinched in a crevice) that prevents further winding of the linear material. The reel assembly can sense that the spool member is no longer winding the linear material and can disengage the motor (e.g., stop operating the motor).

When the user pulls the linear material for the predetermined distance and holds on to the linear material (e.g., the user unintentionally pulled on the linear material, or changed their mind and does not want the linear material to be wound), the reel assembly can sense that the user is holding on to the linear material and disengage the motor (e.g., stop operating the motor) to not wind the linear material. In some implementations, the user may desire to use the linear material at a new location that is closer to the reel assembly. The user can pull the linear material the predetermined distance and hold on to the linear material as the reel assembly winds the linear material. At the new desired shorter length and location, the user may apply a holding force (hold on) to the linear material. The reel assembly can sense the holding force and can disengage the motor (e.g., stop operating the motor) to stop winding of the linear material onto the spool member.

Alternatively, after using the linear material, the user may desire to use the linear material at a new location further away from the reel assembly. The user can pull the linear material in the payout direction (further extract the linear material from the reel assembly) beyond the predetermined amount. The reel assembly can sense that the user has continued to pull the linear material beyond the predetermined amount and not engage the motor to cause the spool member to wind the linear material. The reel assembly can monitor the amount of linear material extracted by the user and stop the linear material from further deployment at a predetermined maximum deployment length. The maximum deployment length can correspond to, for example, a strain relief portion of the linear material necessary to be retained on the spool member to allow the user to pull the linear material by the predetermined amount to initiate winding. The strain relief portion may also correspond to protecting connecting components between the reel assembly and the linear material from pulling forces (e.g., the linear material is not fully unwound such that the connecting components are subject to pulling forces).

After winding of the linear material is initiated, the reel assembly can wind the linear material at a generally constant winding speed over predetermined amounts of linear material. When the reel assembly is mounted on a ceiling, the reel assembly can sense a docking length at which the end of the linear point loses contact with the ground. Based on detecting changes in revolution rates of the spool member, the reel assembly can adjust the winding speed to be generally constant through (before and after) the docking point location. The docking point can be set by the user at a desired length such that the end of the linear material is proximate to the ground. The reel assembly can wind the linear material to a home position and turn off (e.g., enter a sleep state with reduced power consumption). The home position can be where the end of the linear material is near or against the housing of the reel assembly corresponding to a fully spooled length of the linear material. The home position can be set by the user at a desired length to provide a predetermined grasping length to facilitate grasping the end of the linear material when the user desires to extract the linear material from the reel assembly.

In accordance with embodiments disclosed herein, a method for spooling linear material on an automatic reel device is provided. The method comprises monitoring an amount of a linear material unwound from a rotatable spool member of the automatic device with one or more sensors. The method further comprises sensing a pulling action on the linear material in a payout direction of the linear material. The method further comprises determining, with one or more sensors, whether a pull distance of said pulling action falls within a predetermined range based at least in part on sensed rotation of the rotatable spool member. The method further comprises controlling an electric motor to wind the linear material onto the rotatable spool member when said pull distance falls within the predetermined range. The method further comprises controlling the electric motor to not wind the linear material when said pull distance is greater than the predetermined range. The method further comprises controlling the electric motor to stop rotating the rotatable spool member when the linear material is obstructed from being wound onto the rotatable spool member after determining said pull distance falls within the predetermined range.

In some embodiments, the rotatable spool member is mounted on a ceiling; the method further comprises engaging a power relay between a power source and the electric motor when said pull distance falls within the predetermined range; the method further comprises disengaging a power relay between a power source and the electric motor after winding the linear material around the rotatable spool member to a predetermined docking amount of the linear material; the method further comprises disengaging a power relay between a power source and the electric motor after winding the linear material around the rotatable spool member to a last stop point corresponding to a complete spooling of the linear material; controlling the electric motor to stop rotating the rotatable spool member when the linear material is obstructed from being wound onto the rotatable spool member comprises sensing when electric current draw of the electric motor is greater than a current spike limit or a maximum current limit; obstruction of the linear material from being wound onto the rotatable spool member comprises at least one of a user holding on to the linear material or an external obstruction restricting movement of the linear material; the one or more sensors comprise one or more Hall Effect sensors configured to measure one or more counts indicative of one or more revolutions of the rotatable spool member, each of said counts corresponding to an amount of linear material unspooled from the spool member; the Hall Effect sensors are disposed on an output shaft of the motor on an opposite side of the motor from the rotatable spool member on which the linear material is wound to help accurately measure rotation of the spool member; controlling the electric motor to stop rotating the rotatable spool member when the linear material is obstructed from being wound onto the rotatable spool member comprises sensing when a time period between measured counts is greater than a maximum count timeout; the maximum count timeout is 75 milliseconds; the method further comprises setting a docking point location at which the linear material first contacts a ground surface by holding an end of the linear material to the ground surface and pulling on the linear material a predetermined number of times; the method further comprises determining a docking point location at which the linear material loses contact with a ground surface based at least in part on a sensed change in winding velocity of the linear material by the one or more sensors; the one or more sensors comprise one or more Hall Effect sensors configured to measure one or more counts indicative of one or more revolutions of the spool member, each of said counts corresponding to an amount of linear material unspooled from the rotatable spool member; the sensed change in winding velocity corresponds to at least one of a time period decrease between said counts, indicating winding acceleration of the linear material, or a time period increase between said counts, indicating winding deceleration of the linear material; a number of counts over a total unspooled length of the linear material is at least 1000 to facilitate sensing the change in winding velocity of the linear material by the one or more sensors; and/or the linear material is an electrical cord.

In accordance with embodiments disclosed herein, a method for spooling linear material on an automatic device mounted on a wall, ceiling, or bench above a ground surface is provided. The method comprises monitoring an amount of a linear material unwound from a spool member of the automatic device with one or more sensors. The method further comprises sensing a pulling action on the linear material in a payout direction of the linear material. The method further comprises determining, with one or more sensors, whether a pull distance of said pulling action falls within a predetermined range based at least in part on sensed rotation of the spool member. The method further comprises controlling an electric motor to wind the linear material onto the spool member when said pull distance falls within the predetermined range. The method further comprises determining when the linear material passes a docking point location at which the linear material loses contact with the ground surface based at least in part on a sensed change in winding speed of the linear material by the one or more sensors as the electrical motor winds the linear material. The method further comprises adjusting power to the electric motor to maintain winding speed of an end of the linear material through the docking point location generally constant.

In some embodiments, the method further comprises setting the docking point location by sensing a pulling force on the linear material a first predetermined number of times while the end of the linear material is held in a first generally fixed position proximate the ground surface; the method further comprises setting a predetermined grasping length of the linear material by sensing a pulling force on the linear material while the end of the linear material is held in a second generally fixed position corresponding to a desired grasping length to facilitate grasping of the linear material for the pulling action; the one or more sensors comprise one or more Hall Effect sensors configured to measure one or more counts indicative of one or more revolutions of the spool member, each of said counts corresponding to an amount of linear material spooled or unspooled on the spool member; adjusting power to the electric motor to maintain winding speed through the docking point location generally constant is based at least in part on maintaining a time period between said counts generally constant; the method further comprises controlling the electric motor to wind the linear material below a maximum translational velocity of the linear material by decreasing rotational velocity of the spool member as more linear material is spooled onto the spool member during winding, thereby increasing a winding diameter of the linear material around the spool member; the method further comprising controlling the electric motor to unwind the linear material from the spool member during extraction of the linear material from the automatic device; and/or the method further comprising controlling the electric motor to stop unwinding the linear material from the spool member when a change in unwinding speed is less than a minimum unwinding acceleration of the linear material.

In accordance with embodiments disclosed herein, an automatic reel apparatus for spooling linear material is provided. The apparatus comprises a spool member configured to rotate bi-directionally to spool and unspool the linear material with respect to the spool member. The apparatus further comprises an electric motor having an output shaft and configured to rotate the spool member via the output shaft. The apparatus further comprises one or more sensors configured to measure one or more counts indicative of one or more revolutions of the spool member, each of said counts corresponding to an amount of linear material spooled or unspooled on the spool member. The apparatus further comprises a controller configured to control the operation of the electric motor. The controller is configured monitor a length of the linear material unwound from the spool member based at least in part on an indication of rotation of the spool member generated by the one or more sensors and communicated to the controller. The controller is further configured to control the electric motor to wind the linear material around the spool member upon detection of a pulling force on the linear material over a pull distance within a predetermined range. The controller is further configured to control the electric motor to not wind the linear material around the spool member upon detection that the pulling distance is greater than the predetermined range. The controller is further configured to control the electric motor to stop upon detection of a holding force on the linear material that holds the linear material in place.

In some embodiments, the controller is further configured to determine a docking point location at which the linear material loses contact with a ground surface based at least in part on a sensed change in winding velocity of the linear material by the one or more sensors; the controller is further configured to set a docking point location at which the linear material first contacts a ground surface by sensing a pulling force on the linear material a predetermined number of times while an end of the linear material is held in a generally fixed position proximate the ground surface; the controller is further configured to detect the holding force by sensing a first spike in electric current draw of the motor corresponding to the rotatable spool member not rotating at a first length of the linear material unwound from the spool member; the controller is further configured to set a home position corresponding to the first length of the linear material unwound from the spool member; the controller is further configured to detect the holding force by sensing a second spike in electric current draw of the motor corresponding to the rotatable spool member not rotating at a second length of the linear material unwound from the spool member shorter than the first length; the controller is further configured to control the electric motor to stop when electric current draw of the motor is greater than a current spike limit or a maximum current limit corresponding to when the linear material is obstructed from being wound onto the rotatable spool member; the controller is further configured to set a new home position corresponding to the second length of the linear material unwound from the spool member; the controller is further configured to control the electric motor to not wind the linear material around the spool member upon detecting the pulling distance within the predetermined range when the pulling force is applied on the linear material within a predetermined time period of detecting the holding force on the linear material; the controller is further configured to enter a sleep mode after a predetermined time period of not detecting the pulling force on the linear material and not controlling the electric motor to wind or not wind, the sleep mode comprising reducing power consumption of the automatic reel apparatus; the one or more sensors are mounted on the output shaft of the motor on an opposite side of the motor from the spool member on which the linear material is wound to help accurately measure rotation of the spool member; the apparatus further comprises a housing configured to house the spool member, the housing having a mounting element configured to mount the housing to a surface; the mounting element is configured to mount the housing to a ceiling; the linear material is an electrical cord; the controller is further configured to stop unwinding of the linear material from the spool member at a maximum deployable length of the linear material to provide a strain relief portion of the linear material allowing the user pull the linear material over at least the predetermined range to initiate winding of the linear material around the spool member; the apparatus further comprises a brake configured to inhibit rotation of the spool member; the controller is further configured to engage the brake to stop unwinding of the linear material from the spool member at the maximum deployable length of the linear material; the maximum deployable length is less than a total unspooled length of the linear material; the controller is further configured to determine the total unspooled length of the linear material by detecting a change in rotation direction of the spool member when a user extracts the total unspooled length of the linear material; the one or more sensors comprise one or more Hall Effect sensors configured to measure one or more counts indicative of one or more revolutions of the spool member, each of said counts corresponding to an amount of linear material spooled or unspooled on the spool member; the controller is further configured to control a power output of the motor based at least in part on said measured counts to maintain winding speed of the linear material generally constant; the controller is further configured to adjust power to the motor such that a time period between said counts is generally constant; and/or the apparatus further comprises an interface configured to visually display a reference number based on said counts indicative of the one or more revolutions of the spool member to provide a user with an indication of the amount of linear material that is unwound.

In accordance with embodiments disclosed herein, a method for spooling linear material on an automatic reel device is provided. The method comprises monitoring an amount of a linear material unwound from a spool member of the automatic device with one or more sensors. The method also comprises sensing a pulling action on the linear material in a payout (pullout) direction of the linear material. The method also comprises determining if a pull distance of said pulling action falls within a predetermined range based at least in part on sensed rotation of a rotatable spool member with one or more sensors. The method also comprises controlling an electric motor to wind the linear material onto a rotatable spool member if said pull distance falls within the predetermined range. The method also comprises controlling the electric motor to not wind the linear material if said pull distance is greater than the predetermined range. The method further comprises controlling the electric motor to stop rotating the rotatable spool member when a user holds onto the linear material.

In accordance with embodiments disclosed herein, an automatic reel apparatus for spooling linear material is provided. The apparatus comprises a spool member configured to rotate bi-directionally to spool and unspool the linear material with respect to the spool member. The apparatus also comprises an electric motor having an output shaft and configured to rotate the spool member via the output shaft. The apparatus also comprises one or more Hall Effect sensors configured to measure one or more counts indicative of one or more revolutions of the spool member, each of said counts corresponding to an amount of linear material spooled or unspooled on the spool member. The apparatus also comprises a controller configured to control the operation of the electric motor. The controller is configured to monitor a length of the linear material unwound from the spool member based at least in part on an indication of rotation of the spool member generated by one or more Hall Effect sensors and communicated to the controller. The controller is also configured to cause the electric motor to wind the linear material around the spool member upon detection of a pulling force on the linear material over a pull distance within a predetermined range. The controller is also configured to cause the electric motor to not wind the linear material upon detection that the pulling distance is greater than the predetermined range. The controller is further configured to stop upon detection of a force on the linear material that holds the linear material in place. To help manage the linear material safely, the reel assembly can implement various speeds for winding and unwinding depending on, for example, the type of linear material and/or the particular amount of the linear material that is being wound and unwound. The reel assembly can monitor the amount of linear material that has been unspooled to achieve various functions discussed below. In some embodiments, where, for example, about an entire length of the linear material has been unspooled, the reel assembly can start winding the linear material at a first velocity or speed. The first velocity can be such that the reel assembly does not tip over from the friction forces on the linear material from contact with the ground surface as the linear material is being wound. Once a sufficient amount of linear material has been wound onto the spool member to increase the total weight of the reel assembly (and/or decrease friction forces on the linear material) to minimize the possibility of the reel assembly tipping, the reel assembly can wind the linear material at a second velocity or speed. This second velocity can be faster than the first velocity to help decrease total winding time.

When a sufficient or a majority amount of the linear material has been wound onto the spool member, the reel assembly can wind the linear material at a third velocity or speed (e.g., drag speed). The drag speed can be slower than the second velocity to reduce the velocity of the linear material as an end of the linear material approaches the reel assembly. At a first predetermined amount of linear material, the reel assembly can wind the linear material at a fourth velocity or speed (e.g., crawl speed). The crawl speed can be slower than the drag speed to further reduce the velocity of the linear material before the linear material reaches a point (e.g., docking point) at which the end of the linear material is lifted off the ground as it is wound onto the spool member in the housing. The velocity of the linear material is reduced to decrease the momentum of the end of the linear material such that swinging (i.e., hysteresis) of the end of the linear material is minimized as it loses contact with the ground. Minimizing swinging is a safety feature designed to help prevent bodily injury and/or property damage that could be caused by excessive swinging motions of the end of the linear material if it was lifted off the ground while having a relatively fast horizontal velocity. The swinging is caused, in part, by the change from a generally horizontal translation to a generally vertical translation as the end of the linear material lifts off the ground.

The crawl speed can be maintained (generally constant in some embodiments) for a second predetermined amount of linear material after it lifts off the ground to help further minimize swinging of the end of linear material. After swinging of the end of the linear material has been sufficiently minimized (i.e., after the linear material has been wound for the second predetermined amount), the reel assembly can wind the linear material at a fifth velocity or speed (i.e., docking speed). The docking speed can be faster than the crawl speed. The reel assembly can utilize the higher docking speed to help decrease total winding time after implementing the slower crawl speed to reduce swinging. The reel assembly can vary the docking speed. For example, the reel assembly can wind the linear material at a sixth velocity or speed as the end of the linear material approaches the housing of the reel assembly. The sixth velocity can be slower than the docking speed to help inhibit the end of the linear material from slamming into the housing if, for example, substantially the entire length of the linear material is to be wound onto the spool member such that the end of the linear material touches or closely approaches the housing of the reel assembly.

In some embodiments, the reel assembly can be programmed to leave a predetermined amount of linear material outside of the housing (e.g., the entire length of the linear material is not wound onto the spool member). Leaving an unwound predetermined amount of linear material can help a user grasp the unwound portion to initially grasp and pull the linear material for unwinding, particularly when the reel assembly is mounted to a ceiling. The user, in some embodiments, can program a desired amount of linear material to remain unwound.

In accordance with embodiments disclosed herein, a method for spooling linear material on an automatic device supported above a ground surface is provided. The method comprises monitoring an amount of a linear material unwound from a spool member of the automatic device with one or more sensors. The method further comprises winding the linear material around the spool member at a first speed when a length of linear material unwound from the spool member is greater than a first predetermined amount, at least a portion of the linear material disposed on the ground surface. The method further comprises winding the linear material around the spool member at a second speed lower than the first speed when the length of linear material unwound from the spool member decreases below the first predetermined amount but is greater than a docking point location at which the linear material loses contact with the ground surface. The method further comprises winding the linear material around the spool member at a third speed lower than the first speed when the length of linear material unwound from the spool member decreases below the docking point location but is greater than a third predetermined amount, said linear material length being disposed above the ground surface such that the linear material is not in contact with the ground surface. The method further comprises winding the linear material around the spool member at a fourth speed greater than the third speed when the length of linear material unwound from the spool member decreases below the third predetermined amount. Winding at said second and third speeds is configured to dissipate kinetic energy from the winding of the linear material so as to maintain swing of an end of the linear material below a predetermined limit amount in a direction transverse to a vertical axis when the linear material passes the docking point location.

In some embodiments, the rotatable spool member is mounted on a ceiling; the third speed is generally equal to the second speed; the one or more sensors comprise one or more Hall Effect sensors configured to measure one or more counts indicative of one or more revolutions of the spool member, each of said counts corresponding to an amount of linear material unspooled from the spool member; the method further comprises controlling with a controller a power output of a motor coupled to the spool member based at least in part on said measured counts, the motor rotating the spool member such that the third speed is generally constant and substantially equal to the second speed irrespective of ambient temperature changes or a mounting height of the automatic device; the controller is further configured to adjust power to the motor such that a time period between said counts is generally constant; a number of counts over a total unspooled length of the linear material is at least 1000 to facilitate adjusting winding speeds to be generally constant; the method further comprises controlling with a controller power to a motor coupled to the spool member, wherein the controller is configured to stop power to the motor when a time period between measured counts is greater than a maximum count timeout corresponding to when the linear material is obstructed from being wound onto the spool member; the maximum count timeout is 75 milliseconds; the method further comprising unwinding the linear material from the spool member with a motor coupled to spool member and controlling with a controller power to the motor, wherein the controller is configured to detect a change in unwinding speed of the linear material with the one or more sensors and stop power to the motor when the change in unwinding speed is less than a minimum unwinding acceleration of the linear material; the method further comprises engaging a power relay between a power source and a motor when a user pulls the linear material a predetermined pull amount; the method further comprises disengaging a power relay between a power source and a motor after winding the linear material around the spool member at the fourth speed to a predetermined docking amount of the linear material; said predetermined limit amount is less than one foot to mitigate striking a nearby object with the end of the linear material; the linear material is an electrical cord; the method further comprises winding the linear material around the spool member at a fifth speed lower than the fourth speed when the length of linear material unwound from the spool member decreases below a fourth predetermined amount; winding at the fifth speed when the length of linear material unwound from the spool member decreases below the fourth predetermined amount is configured to inhibit slamming the end of the linear material into the automatic device; and/or winding the linear material comprises automatically winding the linear material via a controller that controls rotation of an electric motor of the automatic device.

In accordance with embodiments disclosed herein, a method for spooling linear material on an automatic device mounted on a wall, ceiling, or bench above a ground surface is provided. The method comprises monitoring an amount of a linear material unwound from a spool member of the automatic device with one or more sensors. The method further comprises winding the linear material around the spool member at a first speed when a length of linear material unwound from the spool member is greater than a first predetermined amount. The method further comprises winding the linear material around the spool member at a drag speed slower than the first speed when the length of linear material unwound from the spool member decreases below the first predetermined amount but is greater than a second predetermined amount. The method further comprises winding the linear material around the spool member at a crawl speed slower than the drag speed when the length of linear material unwound from the spool member decreases below the second predetermined amount but is greater than a third predetermined amount, wherein between the second and third predetermined amounts is a docking point location at which linear material loses contact with the ground surface, and wherein a distance between the docking point location and the second predetermined amount defines a first length. The method further comprises winding the linear material around the spool member at a docking speed greater than the crawl speed when the length of linear material unwound from the spool member decreases below the third predetermined amount shorter than the docking point location by a second length. Said crawl speed is generally constant and winding the linear material at the crawl speed through the first and second lengths dissipates kinetic energy from the winding of the linear material so as to maintain swing of an end of the linear material below a predetermined limit amount in a direction transverse to a vertical axis when the linear material passes the docking point location and lifts off the ground surface.

In some embodiments, the method further comprises measuring with the one or more sensors one or more counts indicative of one or more revolutions of the spool member, each of said counts corresponding to an amount of linear material spooled or unspooled from the spool member, the one or more sensors comprising one or more Hall Effect sensors configured to measure the one or more counts, and further comprising controlling with a controller a power output of a motor coupled to the spool member based at least in part on said measured counts, the motor rotating the spool member such that the crawl speed is generally constant irrespective of ambient temperature changes or a mounting height of the automatic device, the controller adjusting power to the motor such that a time period between said counts is generally constant; said time period is about 100 milliseconds; said predetermined limit amount is one foot; the method further comprises initiating a winding operation of the linear material around the spool member at a start-up speed slower than the first speed over a fourth predetermined amount of linear material upon receipt of a command to begin winding the linear material to help prevent at least one of tipping of the automatic device or yanking the linear material from a hand of a user; the ratio of the first length to the second length is at least 2 to 1; the method further comprises engaging a power relay between a power source and a motor when a user pulls the linear material a predetermined pull amount; the method further comprise disengaging a power relay between a power source and a motor after winding the linear material around the spool member at the docking speed to a predetermined docking amount of the linear material; the method further comprising disengaging a power relay between a power source and a motor when electric current draw of the motor from the power source is greater than at least one of a current spike limit or a maximum current limit corresponding to when the linear material is obstructed from being wound onto the spool member; and/or winding the linear material comprises automatically winding the linear material via a controller that controls rotation of an electric motor of the automatic device.

In accordance with embodiments disclosed herein, an apparatus for spooling a linear material is provided. The apparatus comprises a spool member configured to rotate bi-directionally to spool and unspool the linear material with respect to the spool member. The apparatus further comprises an electric motor configured to rotate the spool member. The apparatus further comprises a controller configured to control the operation of the motor. The controller is configured to monitor a length of the linear material unwound from the spool member based at least in part on an indication of rotation of the spool member generated by one or more sensors and communicated to the controller. The controller is further configured to control the motor to wind the linear material around the spool member at a start-up speed over a first predetermined length. The controller is further configured to control the motor to wind the linear material around the spool member at a second speed faster than the start-up speed when the amount of linear material unwound from the spool member is greater than a second predetermined amount. The controller is further configured to control the motor to wind the linear material around the spool member at a drag speed slower than the second speed when the amount of linear material unwound from the spool member decreases below the second predetermined amount but is greater than a third predetermined amount. The controller is further configured to control the motor to wind the linear material around the spool member at a crawl speed slower than the drag speed when the amount of linear material unwound from the spool member decreases below the third predetermined amount. The controller is further configured to control the motor to wind the linear material around the spool member at a docking speed faster than the crawl speed when the amount of linear material unwound from the spool member decreases below a fourth predetermined amount. Winding the linear material at at least one of the drag or crawl speeds is configured to dissipate kinetic energy from the winding of the linear material so as to inhibit swinging of an end of the linear material when the linear material loses contact with a ground surface.

In some embodiments, the apparatus further comprises a housing configured to house the spool member, the housing having a mounting element configured to mount the housing to a surface; the mounting element is configured to mount the housing to a ceiling; the controller is further configured to cause the motor to wind a predetermined length of the linear material around the spool member such that a grasping length of the linear material remains unspooled to facilitate grasping of the linear material; the controller is further configured to stop unwinding of the linear material from the spool member at a maximum deployable length of the linear material to provide a strain relief portion allowing the user pull the linear material a predetermined pull amount to initiate winding of the linear material around the spool member; the apparatus further comprises a brake configured to inhibit rotation of the spool member; the controller is further configured to engage the brake to stop unwinding of the linear material from the spool member at the maximum deployable length of the linear material; the maximum deployable length is less than a total unspooled length of the linear material; the controller is further configured to determine the total unspooled length of the linear material by detecting a change in rotation direction of the spool member when a user extracts the total unspooled length of the linear material; the one or more sensors comprise one or more Hall Effect sensors configured to measure one or more counts indicative of one or more revolutions of the spool member, each of said counts corresponding to an amount of linear material spooled or unspooled on the spool member, the controller is further configured to control a power output of the motor based at least in part on said measured counts, to maintain a winding speed of the linear material generally constant, and the controller is further configured to adjust power to the motor such that a time period between said counts is generally constant; the apparatus further comprises an interface configured to visually display a reference number based on said counts indicative of the one or more revolutions of the spool member to provide a user with an indication of the amount of linear material that is unwound; the linear material is an electrical cord; the controller is further configured to determine a docking point location at which the linear material loses contact with the ground based at least in part on a sensed change in winding speed of the linear material by the one or more sensors, the controller further configured to determine when to control the motor to wind the linear material at said drag, crawl, and docking speeds based at least partly on said determination of the docking point location; the apparatus further comprises a remote control configured to communicate with the controller by sending a wireless signal indicating how to control the operation of the motor; the remote control is attached on the end of the linear material; and/or the controller is further configured to control the motor to not wind the linear material when electric current draw of the motor from a power source is greater than at least one of a current spike limit or a maximum current limit corresponding to when the linear material is obstructed from being wound onto the spool member.

In accordance with embodiments disclosed herein, a method for spooling linear material on an automatic device supported above a ground surface is provided. The method comprises monitoring an amount of a linear material unwound from a spool member of the automatic device with one or more sensors. The method also comprises automatically winding the linear material around the spool member at a first speed when the amount of linear material unwound from the spool is greater than a first predetermined amount, at least a portion of the linear material disposed on the ground surface. The method also comprises automatically winding the linear material around the spool member at a second speed lower than the first speed when the amount of linear material unwound from the spool decreases below the first predetermined amount but is greater than a docking point location at which the linear material loses contact with the ground surface by a first length. The method additionally comprises automatically winding the linear material around the spool member at a third speed lower than the first speed when the amount of linear material unwound from the spool decreases below the docking point location but is greater than a third predetermined amount by a second length, said linear material amount being disposed above the ground surface such that the linear material is not in contact with the ground surface. The method further comprises automatically winding the linear material around the spool member at a fourth speed greater than the third speed when the amount of linear material unwound from the spool decreases below the third predetermined amount. Said second and third speeds are configured to dissipate kinetic energy from the winding of the linear material so as to maintain swing of an end of the linear material below a predetermined limit amount in a direction transverse to a vertical axis when the linear material passes the docking point location.

In accordance with embodiments disclosed herein, a method for spooling linear material on an automatic device mounted on a wall, ceiling or bench above a ground surface is provided. The method comprises monitoring an amount of a linear material unwound from a spool member of the automatic device with one or more sensors. The method also comprises automatically winding the linear material around the spool member at a first speed when a length of linear material unwound from the spool is greater than a first predetermined amount. The method also comprises automatically winding the linear material around the spool member at a drag speed slower than the first speed when the length of linear material unwound from the spool decreases below the a second predetermined amount but is greater than a docking point location at which the linear material loses contact with the ground surface, a distance between the first predetermined amounts and docking point location defining a first length. The method also comprises automatically winding the linear material around the spool member at a crawl speed slower than the drag speed when the length of linear material unwound from the spool decreases below a third predetermined amount but is greater than the docking point location at which linear material loses contact with the ground surface, a distance between the docking point location and third predetermined amounts defining a third length. The method also comprises automatically winding the linear material around the spool member at a docking speed greater than the crawl speed when the length of linear material unwound from the spool decreases below a fourth predetermined amount shorter than the docking point location by a second length. Said crawl speed is generally constant and winding the linear material at the crawl speed through the first and second lengths dissipates kinetic energy from the winding of the linear material so as to maintain swing of an end of the linear material below a predetermined limit amount in a direction transverse to a vertical axis when the linear material passes the docking point location and lifts off the ground surface.

In accordance with embodiments disclosed herein, an apparatus for spooling linear material is provided. The apparatus comprises a spool member configured to rotate bi-directionally to spool and unspool the linear material with respect to the pool member. The apparatus also comprises an electric motor configured to rotate the spool member. The apparatus also comprises a controller configured to control the operation of the motor. The controller is configured to monitor a length of the linear material unwound from the spool member based at least in part on an indication of rotation of the spool member generated by one or more sensors and communicated to the controller. The controller is configured to cause the motor to wind the linear material around the spool member at a start-up speed over a first predetermined length. The controller is also configured to cause the motor to wind the linear material around the spool member at a second speed faster than the start-up speed when the amount of linear material unwound from the spool is greater than a second predetermined length. The controller is further configured to cause the motor to wind the linear material around the spool member at a drag speed slower than the second speed when the amount of linear material unwound from the spool decreases below the second predetermined amount but is greater than a third predetermined amount. The controller is additionally configured to cause the motor to wind the linear material around the spool member at a crawl speed slower than the drag speed when the amount of linear material unwound from the spool decreases below the third predetermined amount. The controller is further configured to cause the motor to wind the linear material around the spool member at a docking speed faster than the crawl speed when the amount of linear material unwound from the spool decreases below a fourth predetermined amount. Winding the linear material at at least one of the drag and crawl speeds is configured to dissipate kinetic energy from the winding of the linear material so as to inhibit swinging of an end of the linear material when the linear material loses contact with a ground surface.

BRIEF DESCRIPTION OF THE DRAWINGS

FIGS. 5A-1 and 5A-2 (collectively FIG. 5A) together show a circuit diagram of the microcontroller unit of FIG. 4 according to one embodiment.

FIGS. 5G-1, 5G-2, and 5G-3 (collectively FIG. 5G) together show a circuit diagram of the voltage regulation circuit of FIG. 4 according to one embodiment.

FIGS. 5H-1, 5H-2, and 5H-3 (collectively FIG. 5H) together show a circuit diagram of the motor driver of FIG. 4 according to one embodiment.

DETAILED DESCRIPTION

Figure 1:
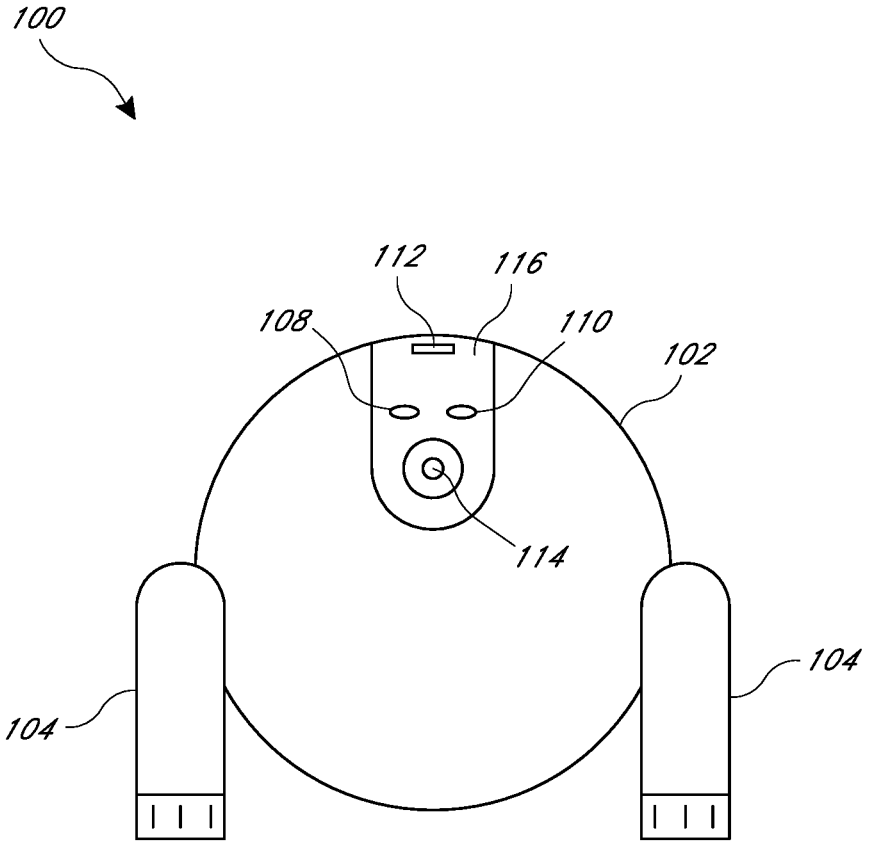
FIG. 1 illustrates a front elevation view of an illustrative embodiment of an automatic device.

The headings provided herein are for convenience only and do not necessarily affect the scope or meaning of the claims.

Terminology

Unless the context clearly requires otherwise, throughout the description and the claims, the words "comprise," "comprising," "include," and the like are to be construed in an inclusive sense, as opposed to an exclusive or exhaustive sense; that is to say, in the sense of "including, but not limited to." The words "coupled" or "connected", as generally used herein, refer to two or more elements that may be either directly connected, or connected by way of one or more intermediate elements. Additionally, the words "herein," "above," "below," "earlier," "later," and words of similar import, when used in this application, shall refer to this application as a whole and not to any particular portions of this application. Where the context permits, words in the Detailed Description using the singular or plural number may also include the plural or singular number, respectively. The word "or" in reference to a list of two or more items, is intended to cover all of the following interpretations of the word: any of the items in the list, all of the items in the list, and any combination of the items in the list.

Moreover, conditional language used herein, such as, among others, "can," "could," "might," "may," "e.g.," "for example," "such as" and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Furthermore, the verbs "spool," "wind," "rewind," "retract," and the like (and variants thereof) can refer to the rotation of the spool member in a direction that causes more of the linear material to become wound around the spool member. Conversely, the verbs "unspool," "unwind," "deploy," and the like (and variants thereof) can refer to the rotation of the spool member in a direction that causes less of the linear material to become wound around the spool member. Also, an "unwound" length and an "unspooled" length can be equivalent.

In addition, the words "duty cycle" can refer to a fraction of time that a system is in an active state. For example, a duty cycle can be 20% when a control signal is in an active state (e.g., high) for 20% of a cycle and in an inactive state (e.g., low) for 80% of the cycle. Thus, a first control signal that is in an active state for a larger percentage of a cycle can correspond to a greater duty cycle than a second control signal that is in the active state for a smaller percentage of the cycle.

Reel Apparatus

FIG. 1 illustrates an automatic device (e.g., automatic reel device) 100 according to one embodiment. The illustrated automatic device 100 is structured to spool a water hose, such as used in a garden or yard area. Other embodiments of the automatic device 100 may be structured to spool air or pressure hoses, water hoses, cables, electrical cords, other cords, or other types of linear material and may be adapted to be used in home, commercial, or industrial settings. It will be understood that the reel apparatuses described herein need not include the linear material. For example, any of the reel apparatuses described herein may not include linear material that is wound or unwound about a spool member. The linear material is connected by a user for operation of the reel apparatuses as discussed herein.

Figure 2:
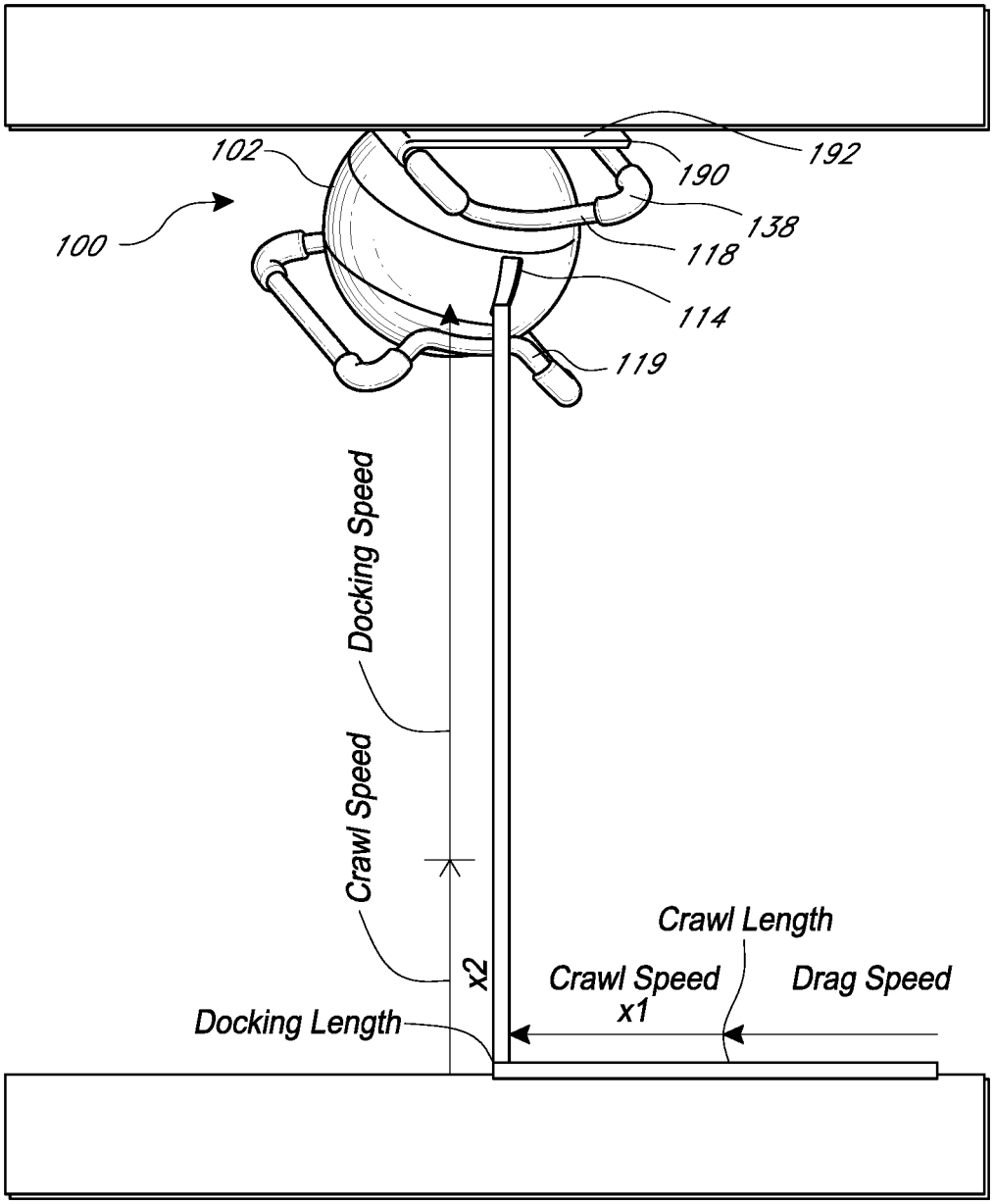
FIG. 2 illustrates an example of an automatic device of FIG. 1 that is mounted on a wall or ceiling above a floor or ground surface.

The illustrated automatic device 100 comprises a body 102 supported by a base formed by a plurality of legs 104 (e.g., four legs of which two legs are shown in FIG. 1). Alternatively, the body 102 can be supported by a support structure as shown in U.S. Design Pat. Nos. D 632,548 and D 626,818. In some embodiments, the automatic device 100 can be mounted off the floor (e.g., on a wall or ceiling of a building, or on a bench), as shown in FIG. 2 and described further below. The body 102 advantageously houses several components, such as a motor, a gear assembly, a braking mechanism, control circuitry such as a brake or controllers, a rotatable spool member onto which the linear material can be wound (such as a spool, reel, drum, or the like), portions of the linear material wound onto the spool member, and the like. The body 102 is preferably constructed of a durable material, such as a hard plastic. In other embodiments, the body 102 may be constructed of a metal or other suitable material. In certain embodiments, the body 102 has a sufficient volume to accommodate a spool member that winds up a standard garden hose (or electrical cord, cable, etc.) of approximately 100 feet in length. In other embodiments, the body 102 is capable of accommodating a standard garden hose of greater than 100 feet in length, such as 140 feet or more. Embodiments can vary as to linear material capacity, as may be suitable for use with smaller or larger amounts of linear material or with similar lengths of linear material with a smaller or larger diameter.

The illustrated legs 104 support the body 102 above a surface such as the ground (e.g., a lawn) or a floor. The legs 104 may also advantageously include wheels, rollers, or other devices to enable movement of the automatic device 100 on the ground or other supporting surface. In certain embodiments, the legs 104 are capable of locking or being affixed to a certain location to prevent movement of the automatic device 100 relative to the supporting surface. In some embodiments, as noted above and discussed further below, the body 102 can be supported on a wall or ceiling of a building or on a support structure (e.g., bench) so that the body 102 is supported a certain distance off the floor.

In certain embodiments, a portion of the body 102 is moveably attached to the base to allow a reciprocating motion of the automatic device 100 as the linear material is wound onto the internal device. One example of a reciprocating mechanism is described in more detail in U.S. Pat. No. 7,533,843.

The illustrated device 100 also comprises an interface panel 116, which includes a power button 108, a select button 110 and an indicator light 112. In some embodiments, the power and select buttons 108, 110 can be actuated manually by a user and/or be actuated via a remote control, such as a remote control disposed at a distal end of the cord or linear material. The power button 108 controls the operation of the motor, which controls the spool member and in some embodiments also controls other components, such as a brake, of the device 100. For example, pressing the power button 108 activates the motor when the motor is in an off or inactive state. In certain embodiments, in order to account for premature commands or electrical glitches, the power button 108 may be required to be pressed for a predetermined time or number of times, such as, for example, at least about 0.1 second before turning on the motor. In addition, if the power button 108 is pressed and held (or actuated remotely) for longer than a predetermined time, e.g., about 3 seconds, the automatic device 100 may turn off the motor and/or generate an error signal (e.g., activate the indicator light 112) inasmuch as this might signify a problem with the unit or that the button is being inadvertently pressed, such as by a fallen object, for example.

If the power button 108 is pressed (or actuated remotely) while the motor is running, the motor is turned off. In certain embodiments, the power button 108 may be required to be pressed or actuated for more than a predetermined amount of time, e.g., about 0.1 second to turn off the motor.

The illustrated interface panel 116 also includes the select button 110. The select button 110 may be used to select different options available to the user of the automatic device 100. For example, a user may depress the select button 110 (or actuate it remotely) to indicate the type or size of linear material used with the device 100. In some embodiments, the select button 110 may be used to select a winding (spooling) speed, or winding initiation, for the device 100. The select button 110 may be actuated by the user to select an unwinding (unspooling) speed.

The illustrated indicator light 112 provides information to a user regarding the functioning of the device 100. In some embodiments, the indicator light 112 comprises a fiber-optic indicator that includes a translucent button. In certain embodiments, the indicator light 112 is advantageously structured to emit different colors or to emit different light patterns to signify different events or conditions. For example, the indicator light 112 may flash a blinking red signal to indicate an error condition.

In other embodiments, the device 100 may comprise indicator types other than the indicator light 112. For example, the automatic device 100 may include an indicator that emits an audible sound or tone.

Although the interface panel 116 is described with reference to particular embodiments, the interface panel 116 may include more or less buttons usable to control (e.g., manually or via a remote control) the operation of the automatic device 100. For example, in certain embodiments, the automatic device 100 comprises an "on" button and an "off" button.

Also, the interface panel 116 may include one or more buttons to control the operating of any braking mechanism of a particular embodiment, and the select button 110 or other interface components may allow users to review and configure parameters for the operation of any such braking mechanism.

Furthermore, the interface panel 116 may include other types of displays or devices that allow for communication to or from a user. For example, the interface panel 116 may include a liquid crystal display (LCD), a touch screen, one or more knobs or dials, a keypad, combinations of the same or the like. The interface panel 116 may also advantageously include an RF receiver that receives signals from a remote control device.

The automatic apparatus 100 may be powered by a battery source. For example, the battery source may comprise a rechargeable battery. In some embodiments, the indicator light 112 is configured to display to the user the battery voltage level. For example, the indicator light 112 may display a green light when the battery level is high, a yellow light when the battery life is running out, and a red light when the battery level is low. In certain embodiments, the automatic apparatus 100 is configured to shut down the motor when the linear material is in a fully retracted state and the battery voltage dips below a certain level, such as, for example, about 11 volts. This may prevent the battery from being fully discharged when the linear material is spooled out from the device 100.

In addition to, or instead of, using battery power, other sources of energy may be used to power the automatic device 100. For example, the device 100 may comprise a cord that electrically couples to an AC outlet. In some embodiments, the cord powers the device 100 and provides power to an electrical receptacle at an end of the linear material. In some embodiments, the automatic device 100 may comprise solar cell technology or other types of powering technology. For example, the automatic device may comprise a regenerative winding mechanisms that stores energy generated by the user pulling out the linear material.

As further illustrated in FIG. 1, the automatic device 100 comprises a port or aperture 114. The port 114 provides a location on the body 102 through or over which a linear material may be spooled and unspooled. In some embodiments, the port 114 comprises a circular shape with a diameter of approximately 1 to 2 inches, such as to accommodate a standard garden hose. Other embodiments may have ports with other shapes, such as diamonds or triangles. Some embodiments may have multiple apertures that can be used, or an aperture which can receive an adapter or which is adjustable so as to select a desired shape. In some embodiments, the port 114 may be located on a moveable portion of the body 102 to facilitate spooling and unspooling. In certain embodiments, the port 114 is sized or shaped such that only that portion of the linear material with a particular cross section or of a particular maximum diameter may fit through. In such embodiments, the diameter of the port 114 may be sufficiently small or suitably shaped to block passage of a fitting and/or a nozzle at the end of the linear material, a collar or other device placed around or affixed to the linear material, or a portion of the linear material that is sufficiently large or differently shaped.

A skilled artisan will recognize from the disclosure herein a variety of alternative embodiments, structures and/or devices usable with the automatic device 100. For example, the device 100 may comprises any support structure, any base, and/or any console usable with embodiments described herein.

Reel Mounted Above Ground Surface

Referring to FIG. 2, an example of an automatic device 100 configured to wind linear material according to the illustrative method 1500 (see FIG. 12) will be described. The automatic device 100 can have the same features (e.g., interface panel 116) as the automatic device illustrate in FIG. 1. It will be understood that any combination of features described with reference to FIG. 2 can be implemented in connection with the method 1500. As illustrated in FIG. 2, the automatic device 100 can be mounted above a ground or floor surface, such as mounted on a ceiling or a wall or on a bench and, in some implementations, the automatic device 100 can be mounted to two or more surfaces. For instance, the automatic device 100 can be mounted to both a ceiling and a wall. Although the automatic device 100 of FIG. 2 is described in the context of being mounted to a ceiling and/or a wall for illustrative purposes, any combination of features related to multi-stage docking can be applied to other surface-mounted automatic devices 100 and/or non surface-mounted automatic devices 100. For instance, an automatic device 100 configured to perform multi-stage docking can be mounted to a table and/or a floor, such as the automatic device shown in FIG. 1. Alternatively, an automatic device 100 configured to perform multi-stage docking can be free standing.

The automatic device 100 can be secured to a wall and/or ceiling via a number of ways known in the art. In some embodiments, the automatic device 100 can be mounted to a surface via a mounting element 190. The mounting element 190 can be configured to be secured to a wall or a ceiling, and also configured to support the automatic device by locking onto two of the handle portions 138 of support structures 118 and/or 119 of the illustrated embodiment. The illustrated mounting element 190 includes a generally planar element or plate 192 that can be configured to be mounted to a surface, such as wall and/or ceiling. For example, the planar element 192 can be mounted via nails, screws, nut and bolt combinations, adhesive, and the like. The illustrated mounting element 190 can also include a latch member and a hook member at opposite ends of the planar element 192. The latch member can define a recess that is sized and shaped to receive one of the handle portions 138. The hook member can also be sized and shaped to receive one of the handle portions 138. The mounting element 190 can be configured so that when one of the handle portions 138 is received within the hook member, the automatic device 100 can be rotated about the hook member so that one of the other handle portions 138 partially deflects the latch member and then snaps into the recess thereof, effectively locking the automatic device 100 onto the mounting element 190.

The automatic device 100 can be removably secured to the mounting element 190, as illustrated in FIG. 2. In some embodiments, the mounting element 190 can be locked onto one of the handle portions 138 of the lower support structure 118 and one of the handle portions 138 of the upper support structure 119. In other embodiments, the mounting element 190 can be locked onto both of the handle portions 138 of the upper support structure 119 and/or the lower support structure 118. The automatic device 100 can be configured so that the distance between each of the handle portions 138 of each support structure 118, 119 is substantially equal, so that the mounting element 190 can be removably secured to either support structure, as desired. Further, the distance between a handle portion 138 of the support structure 118 and a handle portion 138 of the support structure 119 on one side of the automatic device 100 can be substantially equal to such distance on the other side of the automatic device 100, so that the mounting element 90 can be removably secured on either side of the automatic device 100, as desired. The structure and operation of the automatic device 100 is further described below.

As illustrated in FIG. 2, the automatic device 100 can be mounted to a ceiling via the mounting element 190. Linear material can be unwound and wound from the automatic device 100 through the aperture 114. In an illustrative example, the automatic device 100 can include one or more sensors 803 with one or more sources 801 (FIGS. 6-11) for monitoring the amount of unspooled linear material. In some embodiments, the one or more sensors 803 can be Hall Effect sensors that can detect magnets mounted on a shaft or axle a predetermined number of degrees apart from each other. In some embodiments, a Hall Effect sensor can detect two magnets mounted on a shaft or axle 180 degrees apart from each other. In other embodiments, any other suitable number of sources 801 can be mounted with respect to the shaft, axle or disc 1010 (FIGS. 6-11).

Control System

Figure 3:
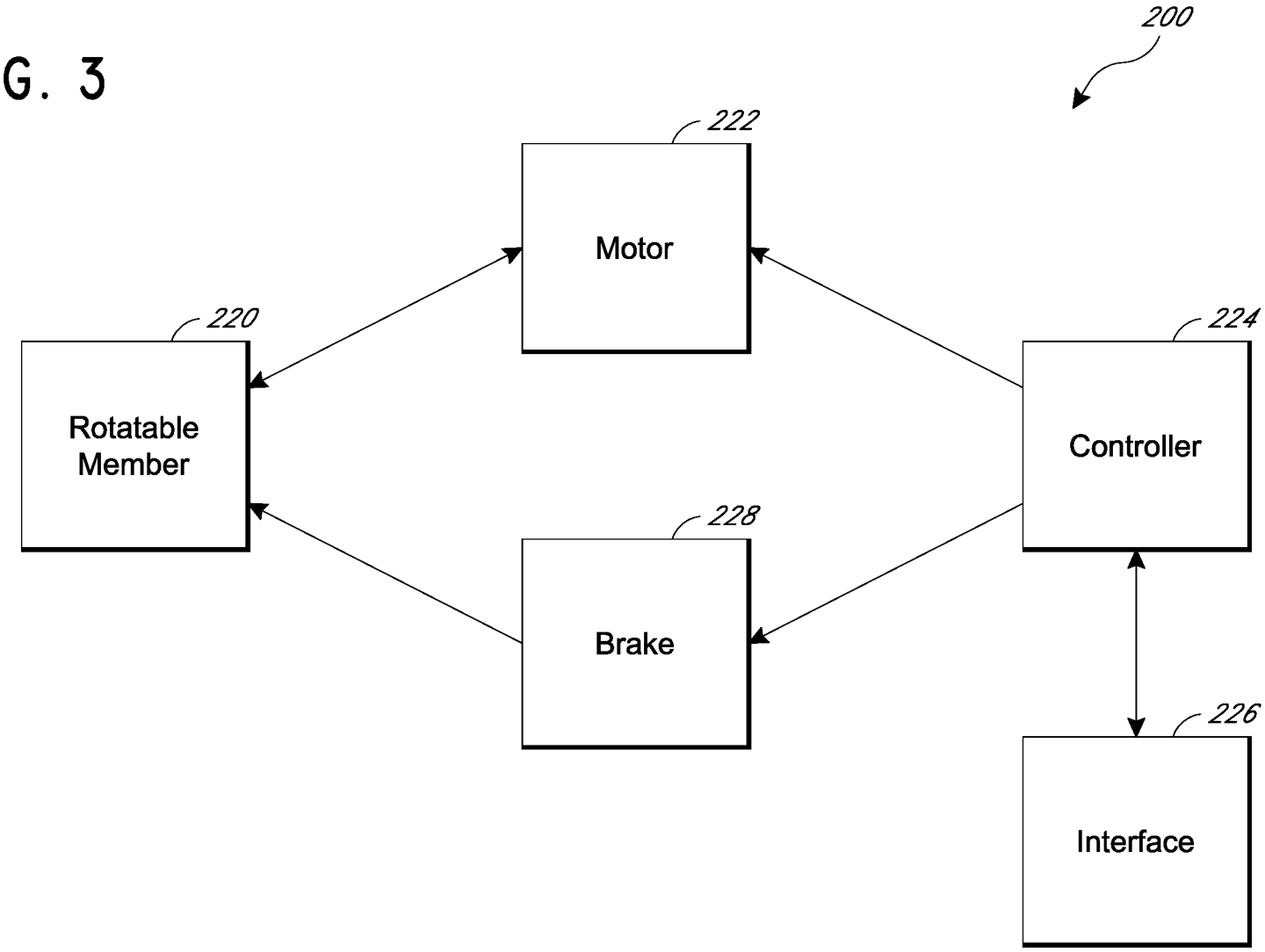
FIG. 3 illustrates a block diagram of an illustrative control system usable by the automatic device of FIG. 1.

FIG. 3 illustrates a block diagram of an illustrative control system 200 usable to control the spooling and/or unspooling of a linear material. In certain embodiments, the automatic device 100 advantageously houses the control system 200 within the housing 102, exposing some or all of the interface 226 via the interface panel 116.

As shown in the block diagram of FIG. 3, the control system 200 comprises a rotatable spool member 220, a motor 222, a controller 224, a brake 228, and an interface 226. In general, the spool member 220 is powered by the motor 222 (e.g., electric motor) to spool or unspool linear material, such as a hose (e.g., water hose, air hose) or electrical cord, including other linear materials as discussed herein. In certain embodiments, the controller 224 (e.g., electronic controller) controls the operation of the motor 222 (e.g., electric motor) or brake 228 based on stored instructions or instructions received through the interface 226. The arrows included in FIG. 3 illustrate a flow of control. For example, the controller 224 can control the motor 222 and the brake 228. The bidirectional arrow between the rotatable spool member 220 and the motor 222 indicates that the motor 222 can control the rotatable spool member 220 and the rotatable spool member 220 can control the motor 222. Similarly, in certain embodiments, the control interface 226 and the controller 224 may control each other. The complete data flow of certain embodiments of the control system 200 is not shown in FIG. 3. For example, the controller 224 may obtain data from the motor 222 and/or the brake 228 according to some embodiments.

In certain embodiments, the spool member 220 comprises a substantially cylindrical drum capable of rotating on at least one axis to spool or unspool linear material. In other embodiments, the spool member 220 may comprise other devices suitable for winding or unwinding a linear material, including spool members that are non-cylindrical or that have a non-contiguous surface onto which the linear material is spooled.

In some embodiments, the motor 222 comprises a brush DC motor (e.g., a conventional DC motor having brushes and having a commutator that switches the applied current to a plurality of electromagnetic poles as the motor rotates). The motor 222 advantageously provides power to rotate or assist with the rotation of the spool member 220 in the unwinding direction, so as to deploy the linear material off of the spool member 220. The rotation of the spool member 220 caused by the motor 222 can complement efforts by a user to deploy the linear material by pulling on it and thereby reduces the amount of effort the user must exert ("forward assist"). The motor 222 may provide power to rotate the spool member 220 inside the automatic device 100 to spool the linear material onto the spool member 220. This spooling may cause some or all of the linear material to retract into the body 102, or to otherwise accumulate on or near the spool member 220.

In some embodiments, the motor 222 is coupled to the spool member 220 via a gear assembly. For example, the automatic device 100 may advantageously comprise a gear assembly having an about x:1 gear reduction, wherein about "x" revolutions of the motor 222 produces about one revolution of the spool member 220, and wherein "x" is within about 20 to 40, and preferably approximately 28 to 32. In some embodiments, other gear reductions may be advantageously used to facilitate the spooling or unspooling of linear material. In some embodiments, the motor 222 may comprise a brushless DC motor, a stepper motor, or the like.

In certain embodiments, the motor 222 operates within a voltage range between about 10 and about 15 volts and consumes up to approximately 250 watts. Under normal load conditions, some embodiments of the motor 222 may exert a torque of approximately 120 ounce-inches (or approximately 0.85 Newton-meters) and operate at approximately 2,500 RPM (corresponding to the spool member 220 rotating, for example, at approximately 800-900 RPM, depending on the gear ratio). Preferably, the motor 222 also is capable of operating within an ambient temperature range of approximately about −25° C. to about 50° C., allowing for a widespread use of the device 100 in various types of weather conditions and climates. In some embodiments, the motor can operate at a variable rate. In some embodiments, the motor has an operational maximum rotational velocity in the range of approximately 2000 RPM to 3500 RPM, preferably approximately 2800 RPM. This maximum may be the result of physical properties of the motor 222, power supply, or other components of the device 100. It may also be a "soft" limit implemented mechanically or in the software or circuitry of automatic device 100, such as by the means discussed below.

In certain embodiments, the motor 222 advantageously operates at a rotational velocity selected to cause the spool member 220 to completely retract a standard 100-foot garden hose or electrical cord within a period of approximately 20 to approximately 45 seconds, preferably approximately 30 seconds. However, as a skilled artisan will recognize from the disclosure herein, the retraction time may vary according to the type of motor used, the type and length of linear material spooled by the automatic device 100, and other properties of the device 100.

In certain embodiments, the motor 222 is configured to retract linear material at a maximum velocity in the range of 0.5 to 2 meters per second. In certain preferred embodiments, the motor 222 is configured to retract linear material at a maximum velocity of approximately 1 meter (approximately 3-4 feet) per second. At a given motor 222 rotation rate, the retraction velocity of the linear material may be proportional to the diameter of the layers of linear material wound on the spool member 220. Thus, as linear material is unwound from the spool member 220, a single revolution of the spool member may unwind decreasing amounts of linear material. For example, in some embodiments with a 100 foot garden hose completely wound around the spool member, a first revolution of the spool member may deploy approximately 48 inches of material, while the last allowed revolution may deploy approximately 24 inches of linear material. Thus, the rotation rate of the spool member 220 will increase as the diameter of the layers of the linear material on the spool member 220 decreases given a certain extraction (payout) speed of the linear material. In some embodiments, forward assist (or power assist) can aid a user during extraction of the linear material by the motor rotating the spool member in a payout direction, as discussed in U.S. application Ser. No. 13/448,784, filed Apr. 17, 2012, the entire contents of which are hereby incorporated by reference and should be considered a part of this specification. As discussed herein, the controller 224 can measure the winding speed (or change in winding speed) of the linear material using sensors 803 (e.g., Hall Effect sensors) by counting ticks of the sensors over a time period as the motor 222 and spool member 220 rotate. As the linear material is extracted from the automatic device 100 at a certain extraction speed or velocity, the rotation rate (unwinding speed) of the spool member 220 increases proportionally to the decrease in diameter of the linear material layers on the spool member 220. The speed at which the forward assist feature rotates the spool member 220 can be adjusted accordingly (e.g., increase spool member unwinding speed) to maintain a desired linear material extraction rate or speed. During forward assist, the controller 224 can use the counts or ticks to monitor for the proportional increase in unwinding speed (acceleration) of the spool member 220 as the linear material is extracted. If acceleration of the spool member 220 decreases below a predetermined minimum unwinding acceleration, the controller 224 can stop the motor 222 (e.g., apply a brake as discussed herein). In some embodiments, the minimum unwinding acceleration can be about 0.001 to about 0.2 revolutions per square second (rev/s^2), including about 0.01 to about 0.1, about 0.02 to about 0.07, about 0.03 to about 0.06, and about 0.04 to about 0.07 rev/s^2. In some embodiments, the controller 224 can stop the motor 222 when the unwinding rate of the spool member 220 is constant or decelerates during extraction of the linear material with power assist. By stopping the forward assist and/or applying the brake when the change in unwinding speed slows below a minimum unwinding acceleration, the automatic device 100 can inhibit (e.g., prevent) over-unspooling, e.g., excess unwound linear material inside the housing of the automatic device 100 that can lead to, for example, tangling of the linear material.

A similar relationship holds when winding in the linear material: the more linear material that has been wound around the spool member, the more material that is spooled with the next revolution of the spool member. To maintain the retraction velocity (or translational velocity or speed) below a selected maximum velocity, the motor 222 may advantageously operate at different speeds during retraction of the linear material as the winding diameter increases with more linear material being spooled onto the spool member 220. Thus, in order to achieve a relatively high velocity when the linear material is initially retracted, yet stay below a maximum velocity (e.g., maximum translational velocity) as the diameter of the spool of linear material on the device 100 increases, the rotational velocity (e.g., the RPM) of the spool member 220 decreases as more linear material is spooled onto the device 100.

The motor 222 of certain embodiments operates during linear material deployment with operational characteristics similar to those it has during retraction. For example, in some embodiments the motor 222 operates at a maximum rotational velocity of approximately 2800 RPM during deployment. Embodiments may have higher or lower maximum rotational velocities of the motor 222, and the gearing ratio of the embodiment, the type of linear material, and the nature of the intended use of the embodiment are all factors that may influence the properties of the motor 222 used and the maximum rotational velocity allowed.

Controller

FIGS. 4 and 5A-5H illustrate schematic diagrams of an illustrative embodiment of a controller, such as the controller 224 (FIG. 3), that can perform one or more of the functions described in this application. The following description and references to FIGS. 4 and 5A-5H are for illustrative purposes only and not to limit the scope of the disclosure. The skilled artisan will recognize from the disclosure hereinafter a variety of alternative structures, devices and/or processes usable in place of, or in combination with, the described embodiments.

Figure 4:
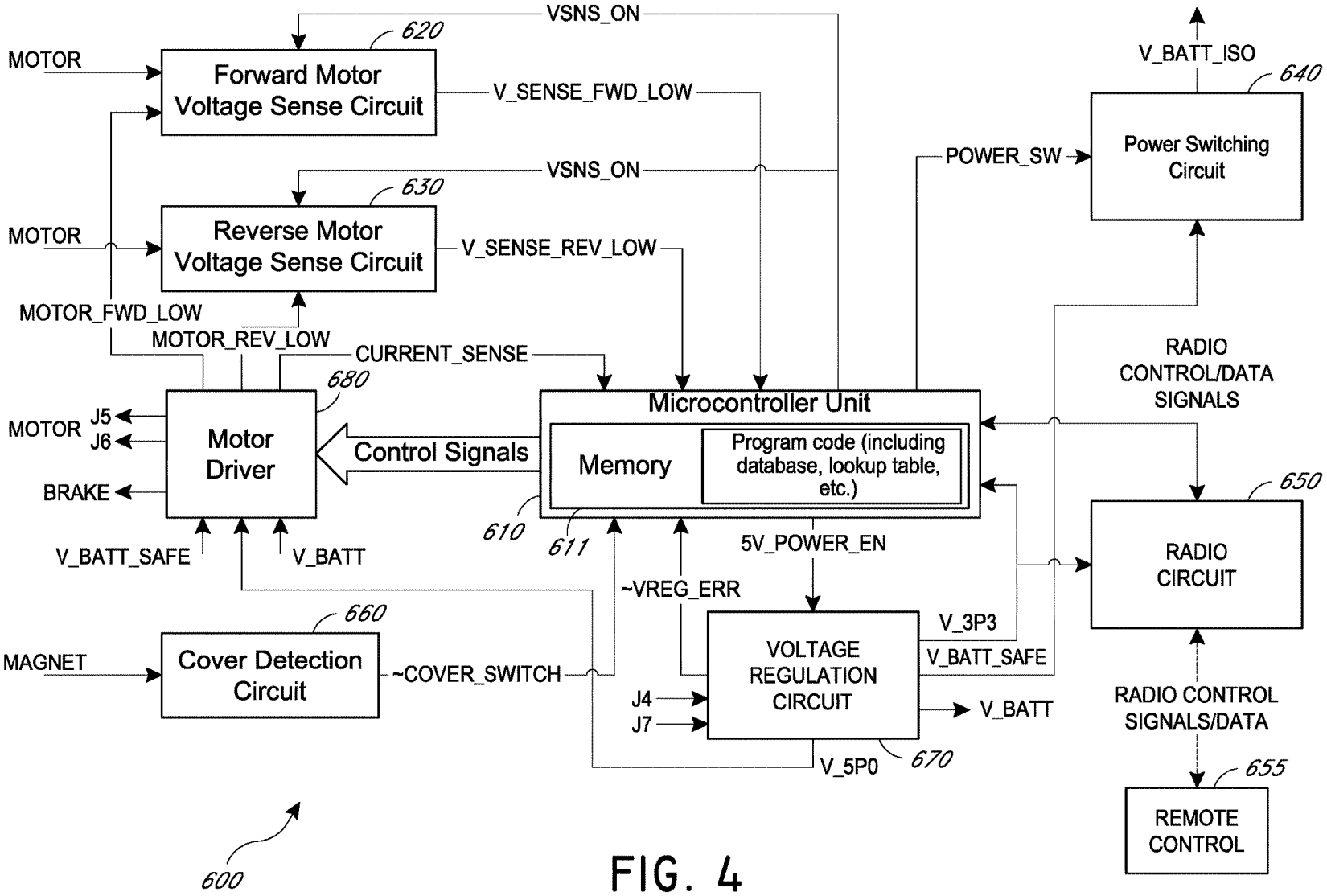
FIG. 4 illustrates a schematic diagram of an illustrative control circuit implementing a controller as shown in FIG. 3.

FIG. 4 illustrates an illustrative motor control system for implementing a controller 224 in some embodiments of the device 100. The illustrated motor controller 600 includes a microcontroller unit 610, a forward motor voltage sense circuit 620 including a transistor package U9 (FIG. 5B), a reverse motor voltage sense circuit 630 including a transistor package U6 (FIG. 5C), a cover detection circuit 660 including a hall effect sensor U1 (FIG. 5F), a voltage regulation circuit 670 including voltage regulators U11 and U2 (FIG. 5G), a power switching circuit 640 including a transistor package U7 (FIG. 5D), a radio circuit 650 including an RF transceiver U5 (FIG. 5E), and a motor driver 680. The motor controller 600 receives power through positive and negative power contacts J4, J7. The functions, steps, programs, algorithms discussed herein can be performed by either the controller 224 or controller 600, or both.

In some embodiments, each of the transistor packages U9, U6, U7 can include one NPN transistor and one PNP transistor that are not electrically coupled inside the package. The NPN transistor includes a base, an emitter, and a collector connected to pins B1, E1, and C1, respectively. The PNP transistor includes a base, an emitter, and a collector connected to pins B2, E2, and C2, respectively.

The microcontroller unit 610 serves to monitor and control the motor 222 (FIG. 3), and can cause the motor to act as the braking mechanism 228 (FIG. 3). The microcontroller unit 610 can output motor driver control signals MTR_FWD_HI, MTR_FWD_LO, MTR_REV_HI, MTR_REV_LO; a voltage sense signal VSNS_ON; a 5-volt power enable signal 5V_POWER_EN; a power switch signal POWER_SW; radio control signals RF_SCLK, RF_~SEL, ~IRQ, RF_FFS, RF_FFIT, RF_VDI, and ~RESET; and radio data signals RF_SDI and RF_SDO. The microcontroller unit 610 can receive a current sense signal CURRENT_SENSE from the motor driver, a sensed forward motor voltage V_SENSE_FWD_LOW from the forward motor voltage sense circuit, a sensed reverse motor voltage V_SENSE_REV_LOW from the reverse motor voltage sense circuit, a cover detection signal ~COVER_SWITCH from the cover detection circuit, and a voltage regulation error signal ~VREG_ERR from the voltage regulation circuit.

The forward motor voltage sense circuit 620 can receive the voltage sense signal VSNS_ON from the microcontroller unit 610 and a forward motor terminal voltage MOTOR_FWD_LOW from the motor driver 680, and output the sensed forward motor voltage V_SENSE_FWD_LOW. The forward motor voltage sense circuit 620 can include the transistor package U9. When the voltage sense signal VSNS_ON is enabled, the forward motor voltage sense circuit 680 converts the forward motor terminal voltage MOTOR_FWD_LOW into the sensed forward motor voltage V_SENSE_FWD_LOW by reducing the voltage level and providing input pin protection.

Similarly, the reverse motor voltage sense circuit 630 can receive the voltage sense signal VSNS_ON from the microcontroller unit 610 and a reverse motor terminal voltage MOTOR_REV_LOW from the motor driver 680, and output the sensed reverse motor voltage V_SENSE_REV_LOW. The reverse motor voltage sense circuit 630 can include the transistor package U6. When the voltage sense signal VSNS_ ON is enabled, the reverse motor voltage sense circuit 630 converts the reverse motor terminal voltage MOTOR_REV_LOW into the sensed reverse motor voltage V_SENSE_REV_LOW by reducing the voltage level and providing input pin protection.

The microcontroller unit 610 is configured to enable VSNS_ON. When VSNS_ON is enabled, the microcontroller unit 610 will shortly receive back safely reduced voltages on V_SENSE_REV_LOW and V_SENSE_FWD_LOW. A difference between these two voltages corresponds to an approximate rate (and direction) of rotation for the motor, which the microcontroller unit 610 can access via a lookup table. The lookup table can be stored in memory 611 internal or external to the microcontroller unit 610 and/or motor controller 600. The memory 611 can include volatile or nonvolatile memory. The memory 611 can store program code that the controller can, for example, draw upon as a database (e.g. the lookup table) for controlling the device 100 as discussed herein. The program code can implement the algorithms and program logic for performing the various functions discussed herein.

The rotational velocity for the motor 222 can be stored for later use, for example, in accordance with the previously described processes. It can be compared to a similarly calculated value based on the next enablement of VSN-S_ON, and may be compared to stored values containing maximum, minimum, and threshold values for the motor's rotational velocity as appropriate to implement motor and brake control processes such as processes described herein (e.g., processes related to docking).

A skilled artisan will appreciate that the microcontroller unit 610 may be configured to determine the correspondence between voltage differential and rotational velocity of the motor dynamically (e.g., without the use of a lookup table), and that it may, instead of storing and testing determined rates of rotation of the motor, store and test the voltage differentials directly.

The cover detection circuit 660 detects whether the cover of the body 102 of the device 100 is in place and outputs the cover detection signal ~COVER_SWITCH. The cover detection circuit 660 detects a magnet attached to the cover via the hall effect sensor U1. When the lid is on, the cover detection signal ~COVER_SWITCH is low. When the ~COVER_SWITCH high signal is received by the microcontroller unit 610, it may promptly emit the appropriate signals to cease rotation of the motor, or, for example, stop sending the 5V_POWER_EN signal to the voltage regulation circuit 670.

The voltage regulation circuit 670 serves to condition power coming from the power input contacts J4, J7. The voltage regulation circuit 670 receives the 5-volt power enable signal 5V_POWER_EN from the microcontroller unit 610 and outputs power signals V_BATT, V_BATT_SAFE, V_3P3, V_5P0 and the voltage regulation error signal ~VREG_ERR. The voltage regulation circuit 670 can include the first and second voltage regulators U11, U2. In some embodiments, the first voltage regulator U11 generates a 3.3-volt power signal V_3P3 from the power signal V_BATT_SAFE for use by, for example, the microcontroller unit 610 and the radio circuit 650. The unswitched 3.3 volts is generally available whenever the 12-volt source is active (e.g., the 12-volt source is connected to the controller and has a sufficient charge). When the 5-volt power enable signal 5V_POWER_EN is enabled, the second voltage regulator U2 generates a 5.0-volt power signal V_5P0 for use by, for example, the motor driver 680, from a power signal V_BATT_ISO (discussed below with respect to the power switching circuit). The voltage regulation circuit 670 enables the voltage regulation error signal ~VREG_ERR when there is an error in voltage regulation. A skilled artisan will appreciate that the voltage regulation circuit 670 can be configured to provide various voltages, depending on the needs of the other components of the controller 600.

The power switching circuit 640 allows the microcontroller unit 610 to control the power signal V_BATT_ISO. The power switching circuit 640 receives the power signal V_BATT_SAFE from the voltage regulation circuit 670 and receives the power switch signal POWER_SW from the microcontroller unit 610. The power switching circuit 640 can include the transistor package U7. When the microcontroller unit 610 enables the power switch signal POWER_SW, the power switching circuit 640 connects the power signal V_BATT_ISO to the power signal V_BATT_SAFE through the transistor package U7. When the microcontroller unit 610 disables the power switch signal POWER_SW, the power switching circuit 640 isolates V_BATT_ISO from the power signal V_BATT_SAFE. This can be used in conjunction with sleep and power saving modes.

The radio circuit 650 serves to transmit and receive radio signals for use with a remote control 655. The illustrated radio circuit 650 can receive radio control signals RF_SCLK, RF_~SEL, ~IRQ, RF_FFS, RF_FFIT, RF_VDI, ~RESET and radio data signals RF_SDI, RF_SDO from the microcontroller unit 610. The radio circuit 650 includes the RF transceiver U5. The radio circuit 650 can transmit and receive the radio data signals RF_SDI, RF_SDO.

Figures 1, 5A:
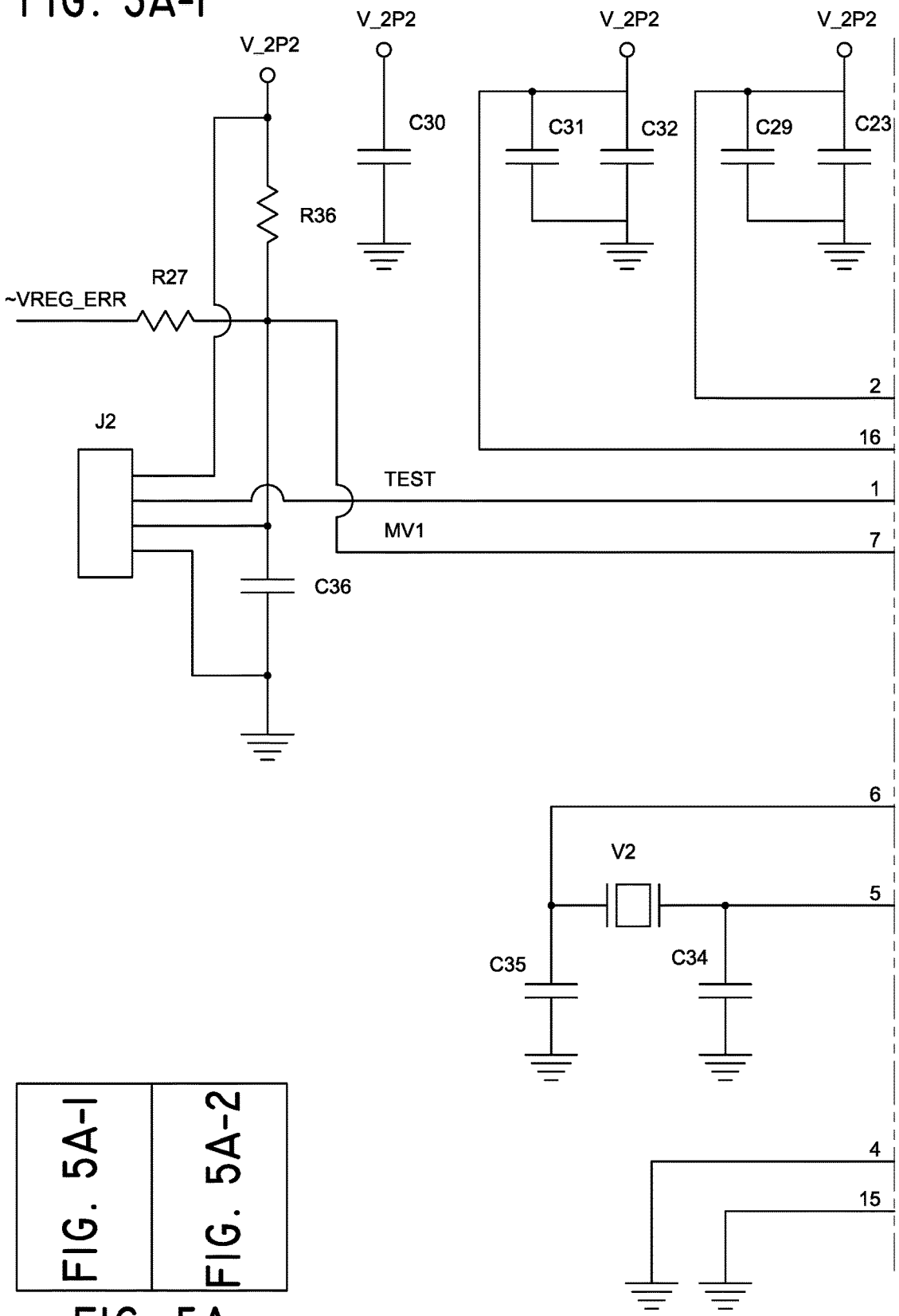
Figures 2, 5A:
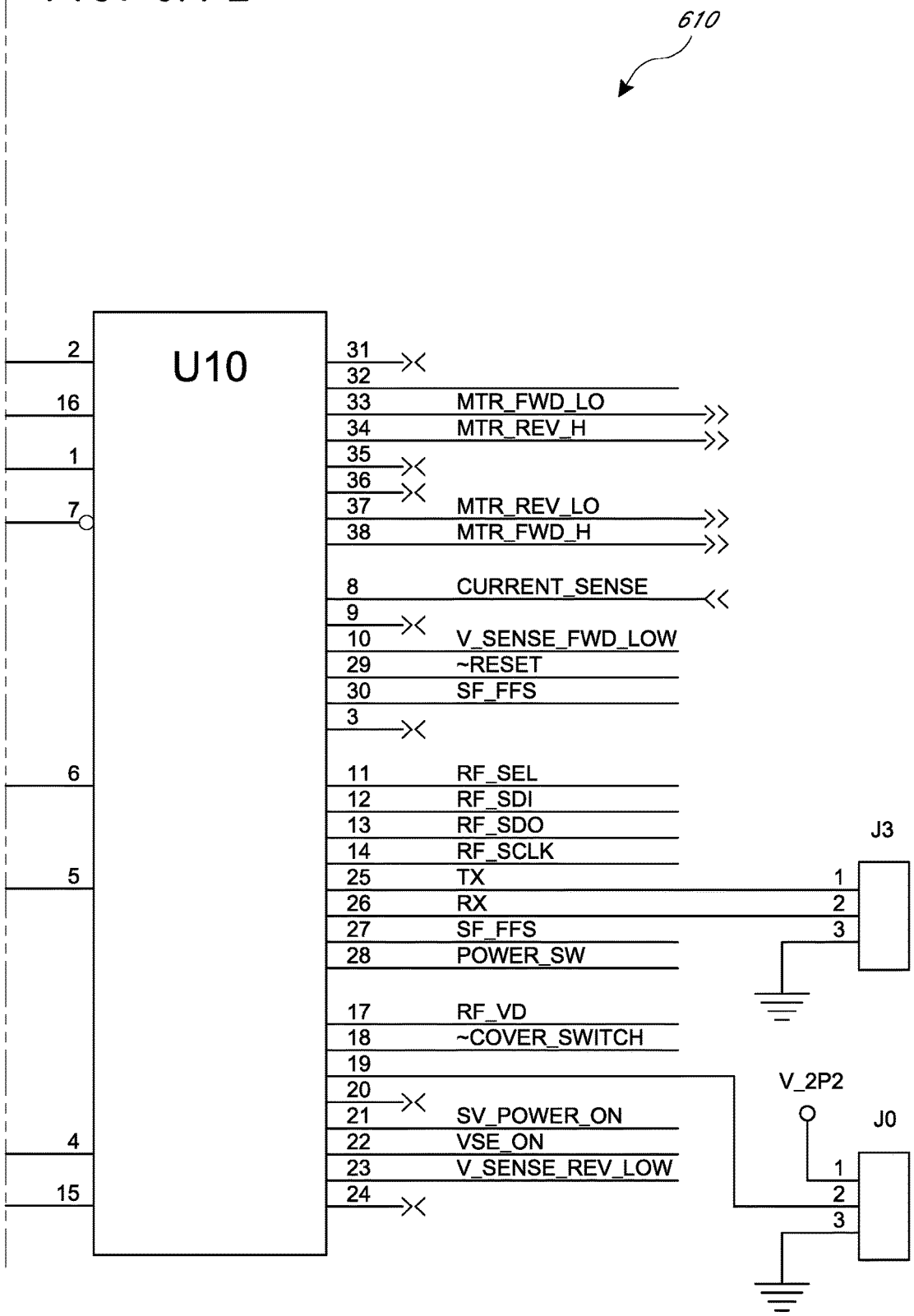
Figure 5B:
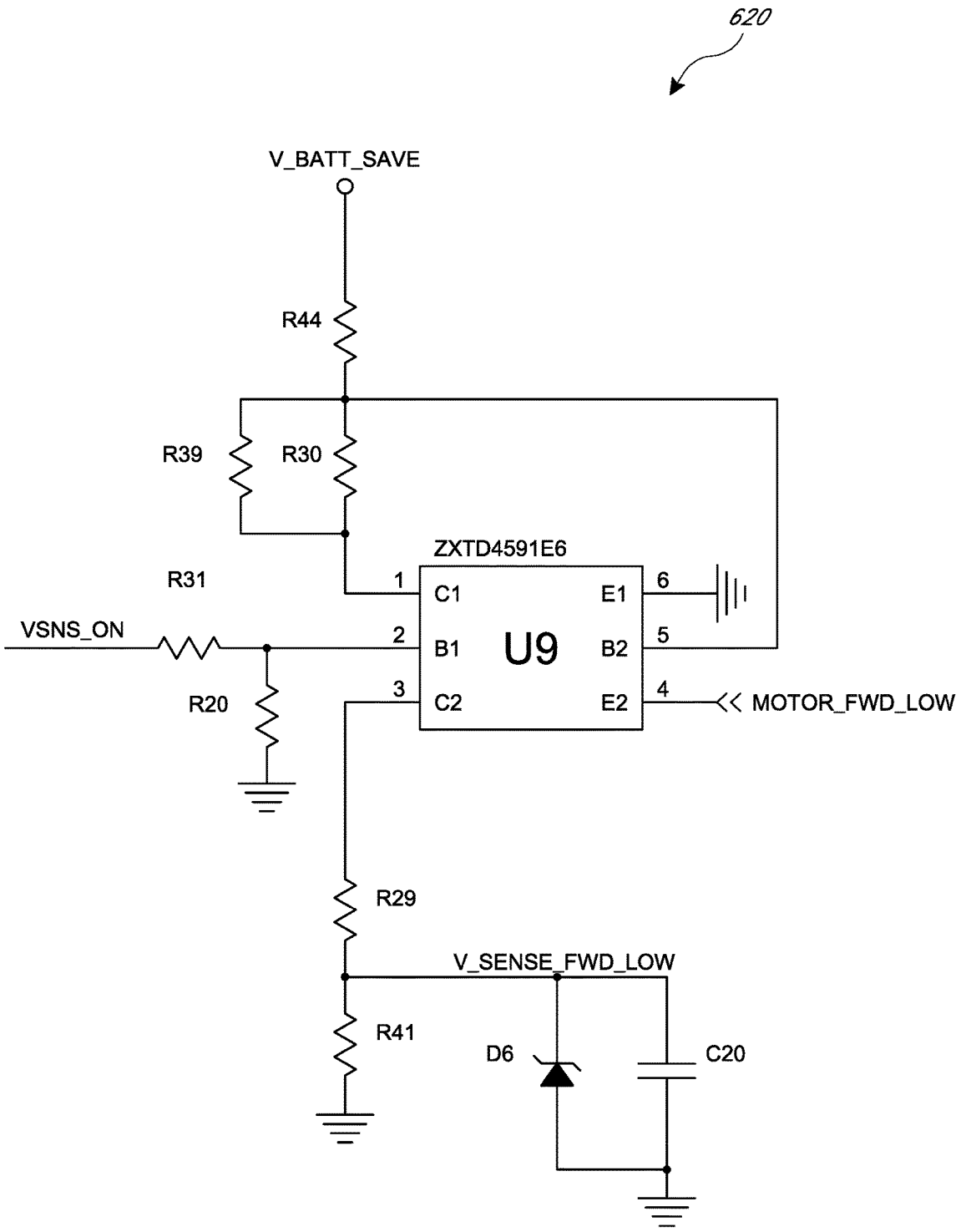
FIG. 5B is a circuit diagram of the forward motor voltage sense circuit of FIG. 4 according to one embodiment.
Figure 5C:
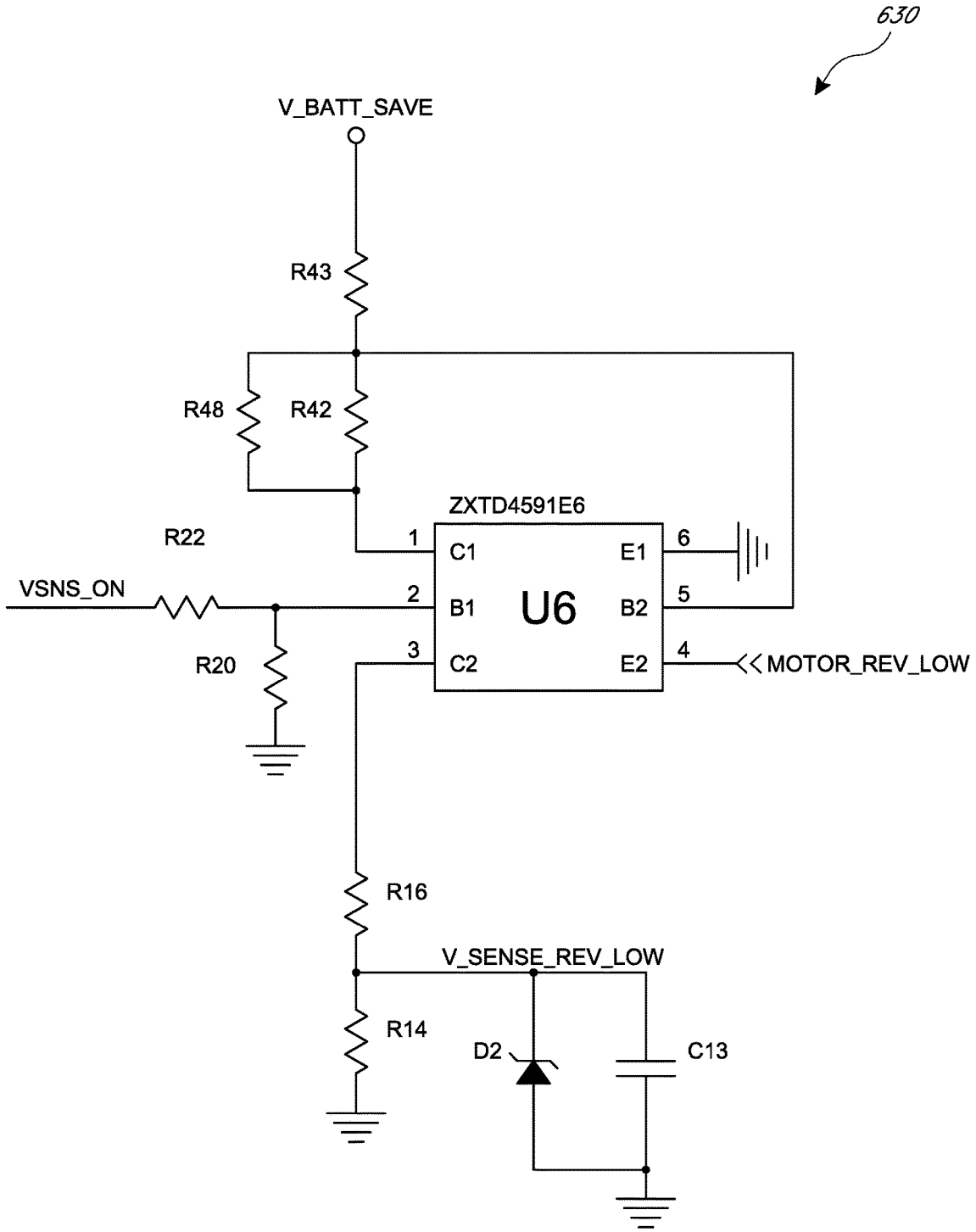
FIG. 5C is a circuit diagram of the reverse motor voltage sense circuit of FIG. 4 according to one embodiment.
Figure 5D:
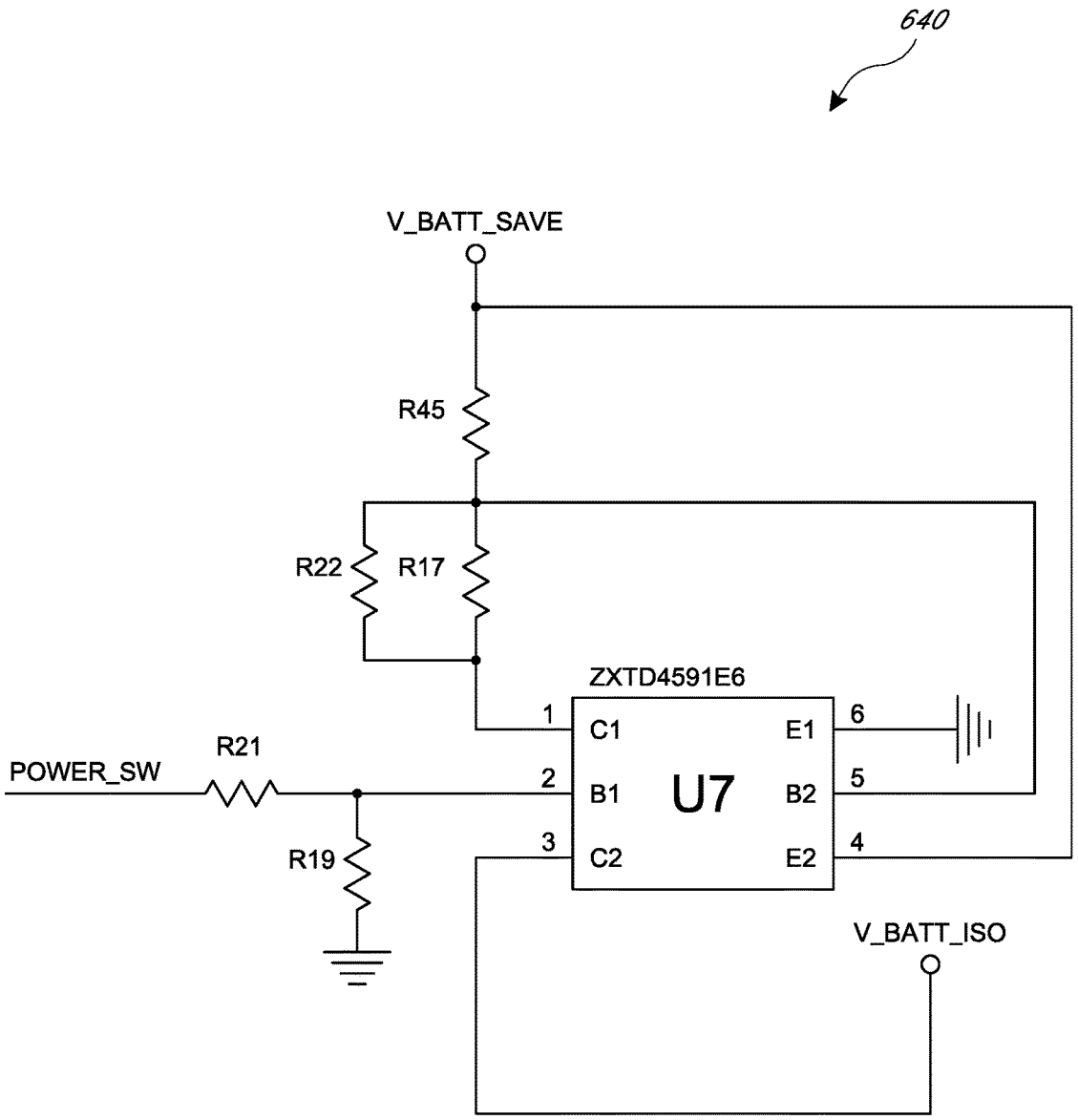
FIG. 5D is a circuit diagram of the power switching circuit of FIG. 4 according to one embodiment.
Figure 5E:
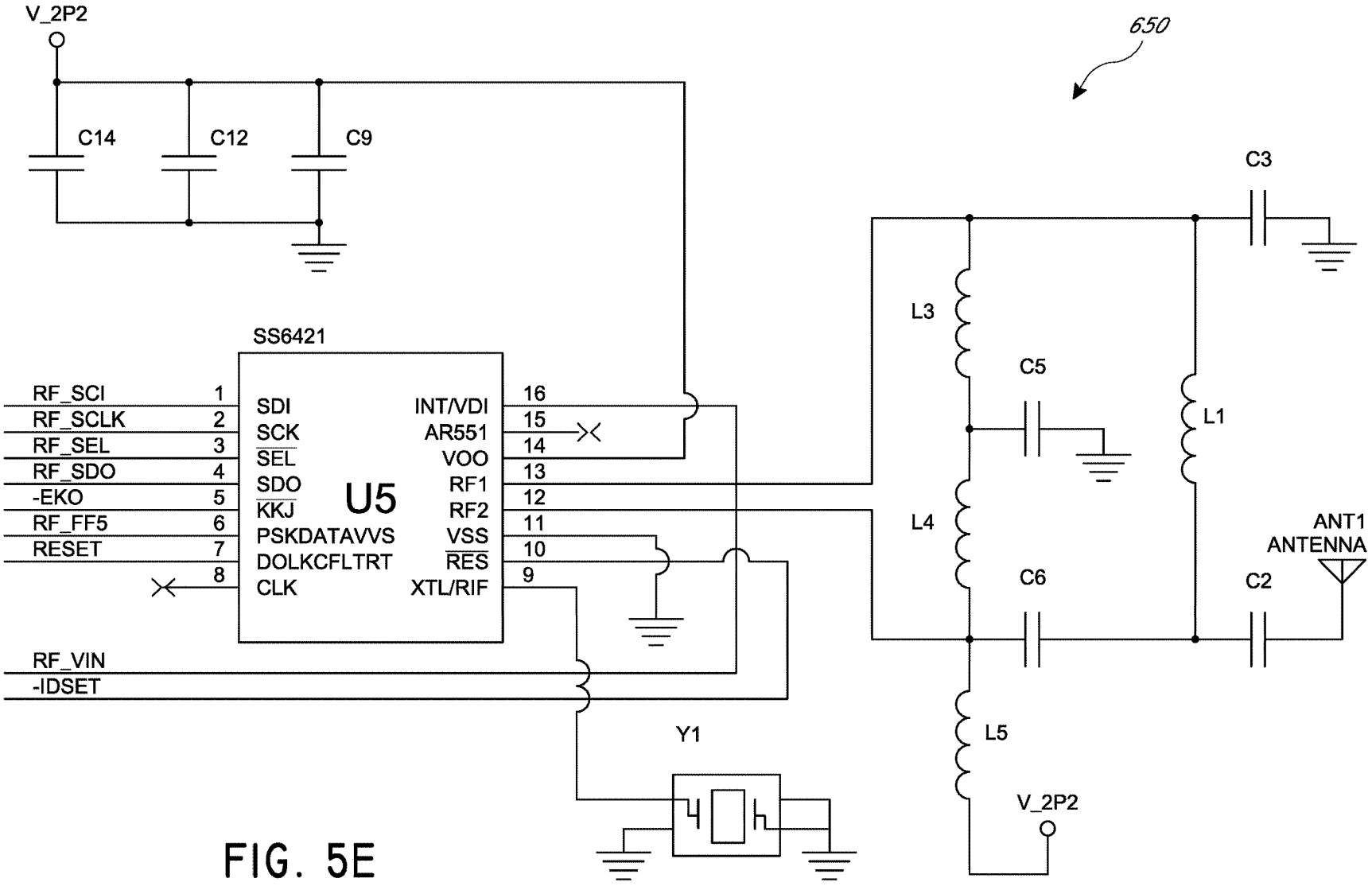
FIG. 5E is a circuit diagram of the RF transceiver of FIG. 4 according to one embodiment.
Figure 5F:
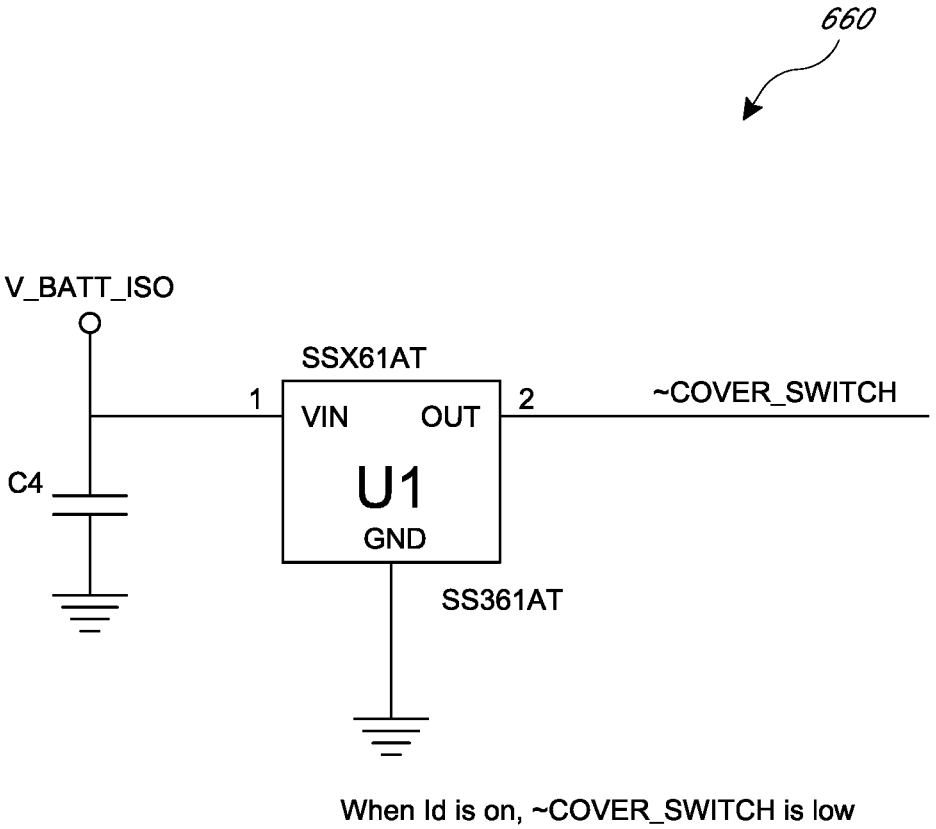
FIG. 5F is a circuit diagram of the Hall Effect sensor of FIG. 4 according to one embodiment.
Figures 1, 5G:
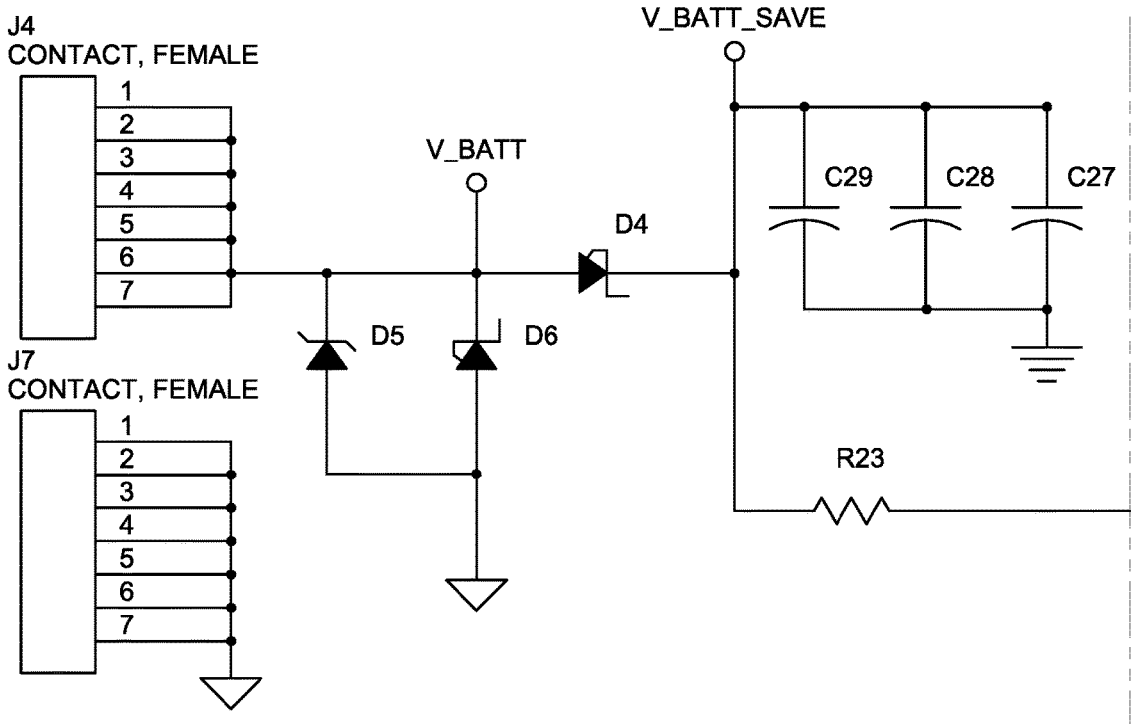
Figures 2, 5G:
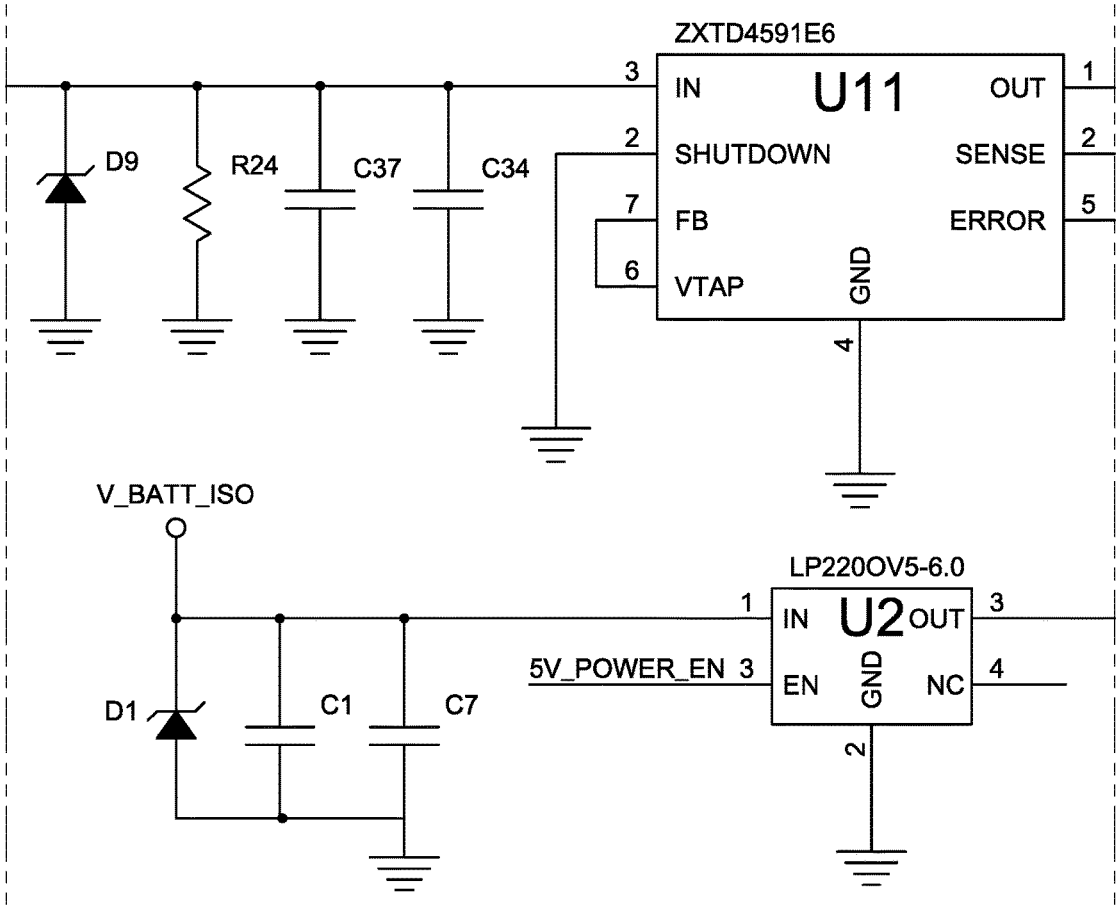
Figures 3, 5G:
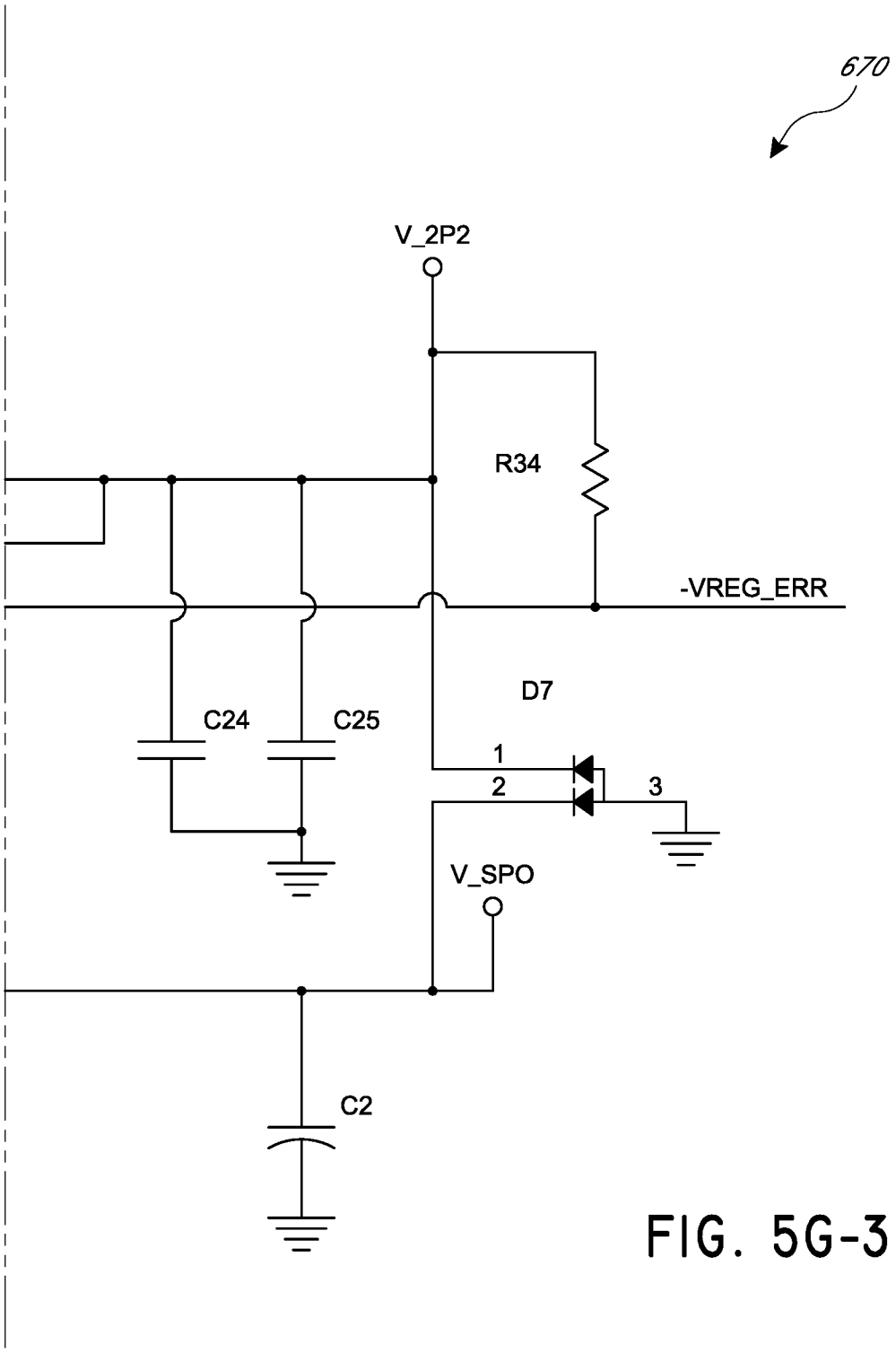
Figures 1, 5H:
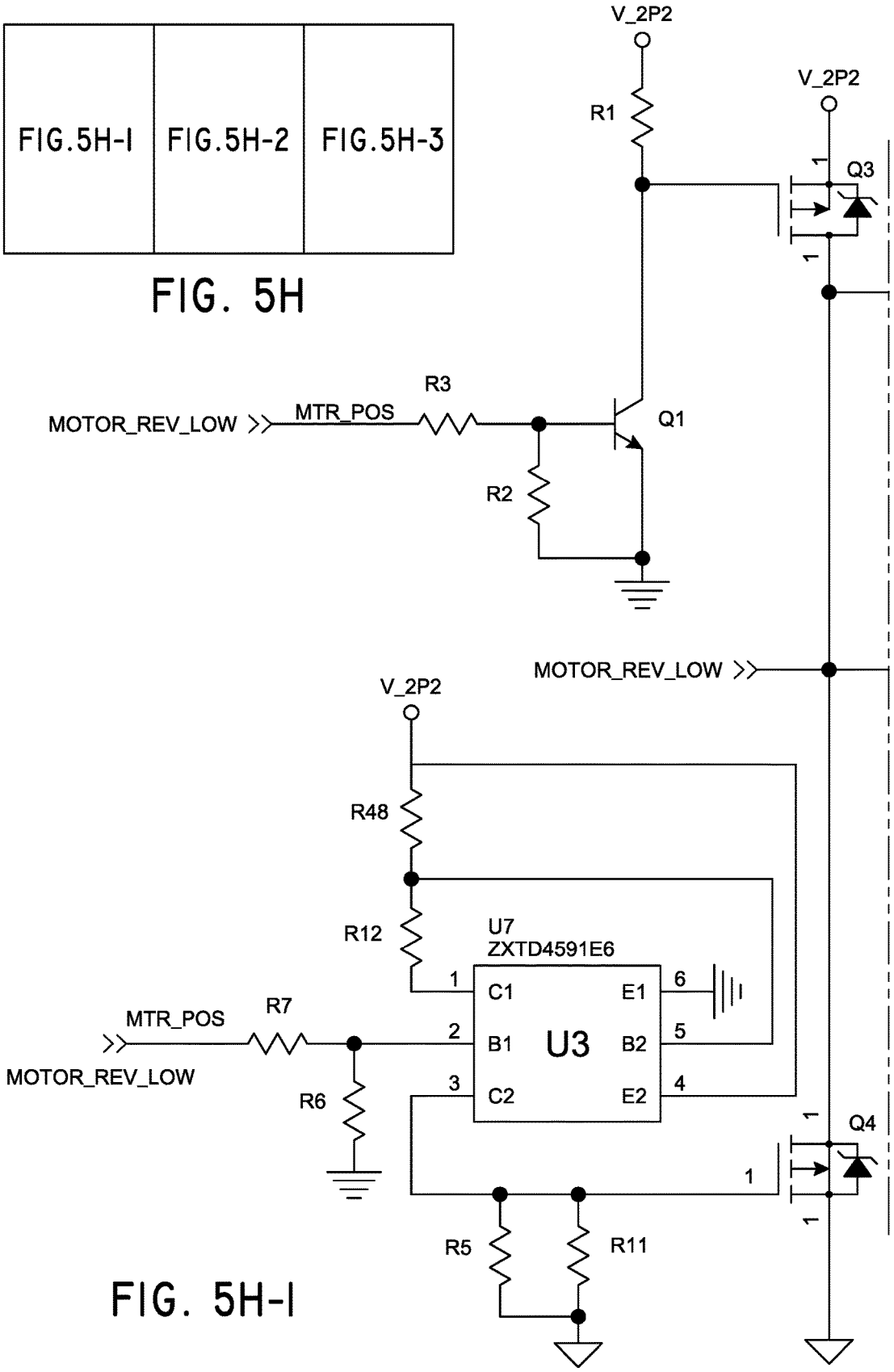
Figures 2, 5H:
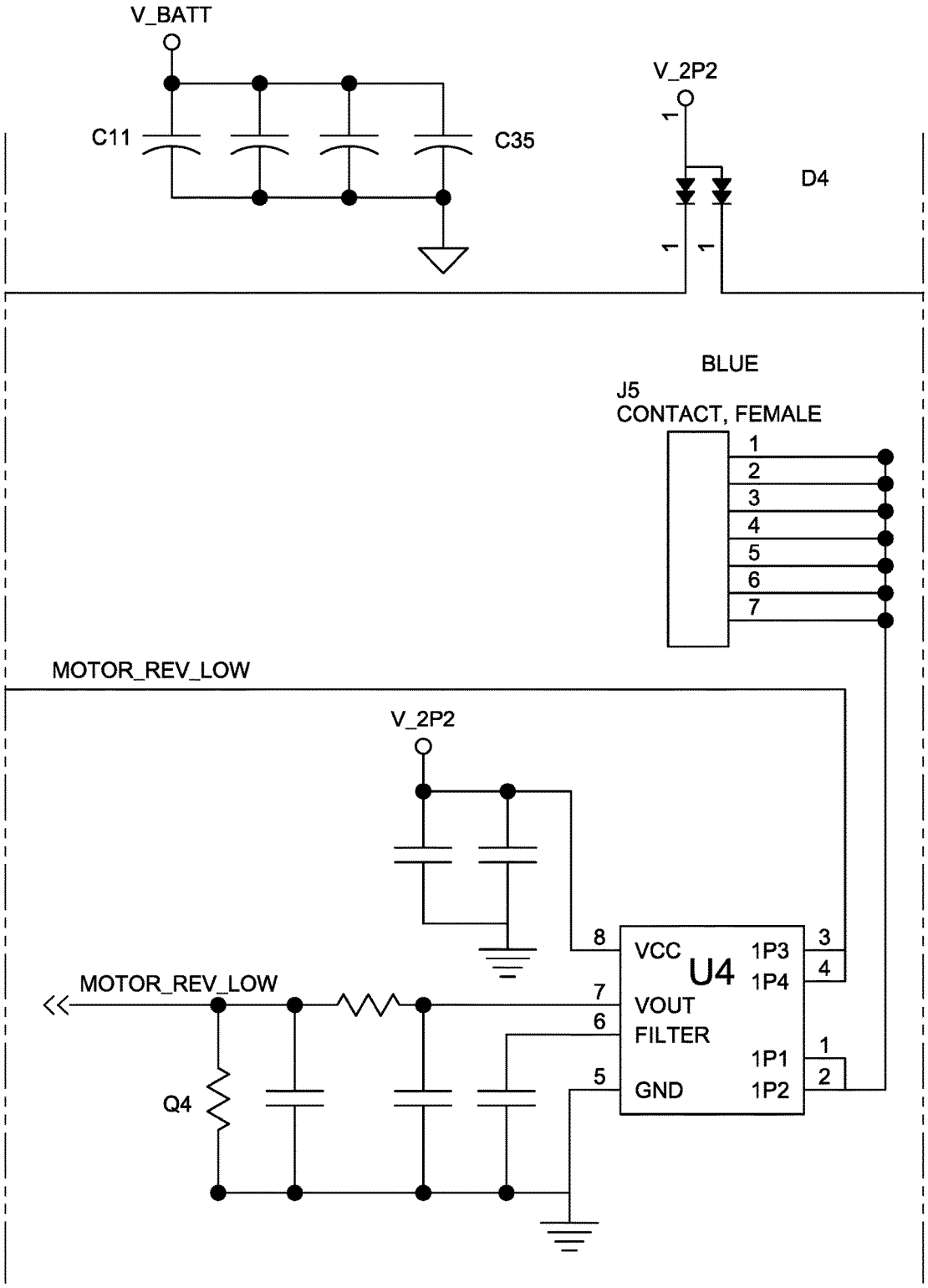
Figures 3, 5H:
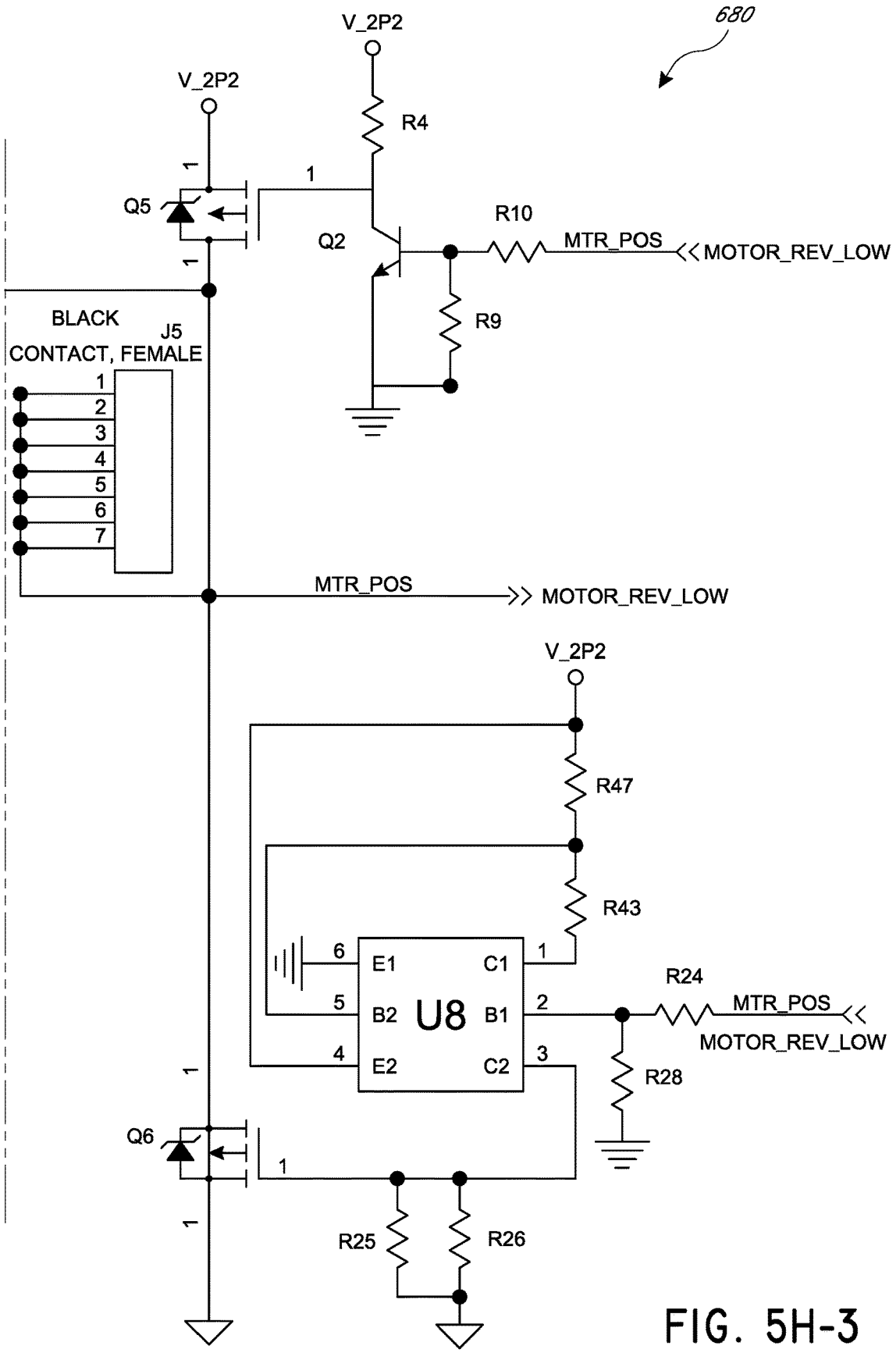

FIG. 5H illustrates one embodiment of the motor driver 680 of FIG. 4, which can be used to power the motor during forward (unwinding) and reverse (winding) operations. The motor driver 680 can be also used to brake the motor. The motor driver 680 can includes a positive motor contact J5; a negative motor contact J6; a current sense circuit; and power transistors Q3, Q4, Q5, and Q6. The motor driver 680 can receive supply voltages V_BATT and V_BATT_SAFE from the voltage regulation circuit and receive motor driver controls MTR_FWD_HI, MTR_FWD_LO, MTR_REV_HI, and MTR_REV_LO from the microcontroller unit 610. The motor driver 680 can output motor terminal voltages MOTOR_REV_LOW, MOTOR_FWD_LOW and a motor current signal CURRENT_SENSE.

The motor driver 680 can receive, from the microcontroller unit 610, motor driver control signals MTR_FWD_HI, MTR_FWD_LO, MTR_REV_HI, and MTR_REV_LO to drive the power transistors Q3, Q6, Q5, and Q4, respectively, via power transistor drive circuits. The power transistors Q3, Q6, Q5, and Q4 can be arranged in an H-bridge configuration, which enables the motor driver to apply driving voltage across the motor contacts J5, J6 in either direction. Thus, during a forward assist operation, the power transistor Q3 is enabled via the motor driver control signal MTR_FWD_HI, and the power transistor Q6 is enabled via the pulse width modulation of the motor driver control signal MTR_FWD_LO. Likewise, the control signal MTR_FWD_HI and the power transistor Q5 are enabled via the pulse width modulation of the motor driver control signal MTR_REV_LO. During a braking operation (e.g., applying an electrical brake), the power transistor Q3 is enabled via the motor driver control signal MTR_FWD_HI, and the power transistor Q5 is enabled via the pulse width modulation of the motor driver control signal MTR_FWD_HI.

The motor driver 680 can also include a current sense circuit which includes a current sense module U4 and a current sense filter. The current sense module U4 detects a current flowing into and out of the positive motor contact J5 and generates a current sense signal CURRENT_SENSE that represents the current flowing into and out of the positive motor contact J5 as a voltage. The current sense filter sets the bandwidth of the current sense signal CURRENT_SENSE.

The microcontroller unit 610 can also compare the current value CURRENT_SENSE with an expected value that correlates to a desired motor speed. If the measured current does not correspond to the expected current for the desired motor speed, the microcontroller unit 610 advantageously adjusts the duty cycle of the appropriate output signals to selectively increase or decrease the motor speed while continuing to measure the current in accordance with the foregoing manner. Thus, the microcontroller unit 610 can use the feedback information provided by the current measuring technique to control the speed of the motor to a desired motor speed.

The microcontroller unit 610 can also use the value of CURRENT_SENSE to approximately determine the actual number of revolutions of the motor. The microcontroller unit 610 is able to calculate the amount of linear material that has been wound or unwound position based on the motor speed, as indicated by CURRENT_SENSE, and the amount of time during which the motor is running at a particular motor speed. A similar result can be obtained by using the voltage differences discussed above.

Rotation Sensors

Figure 6:
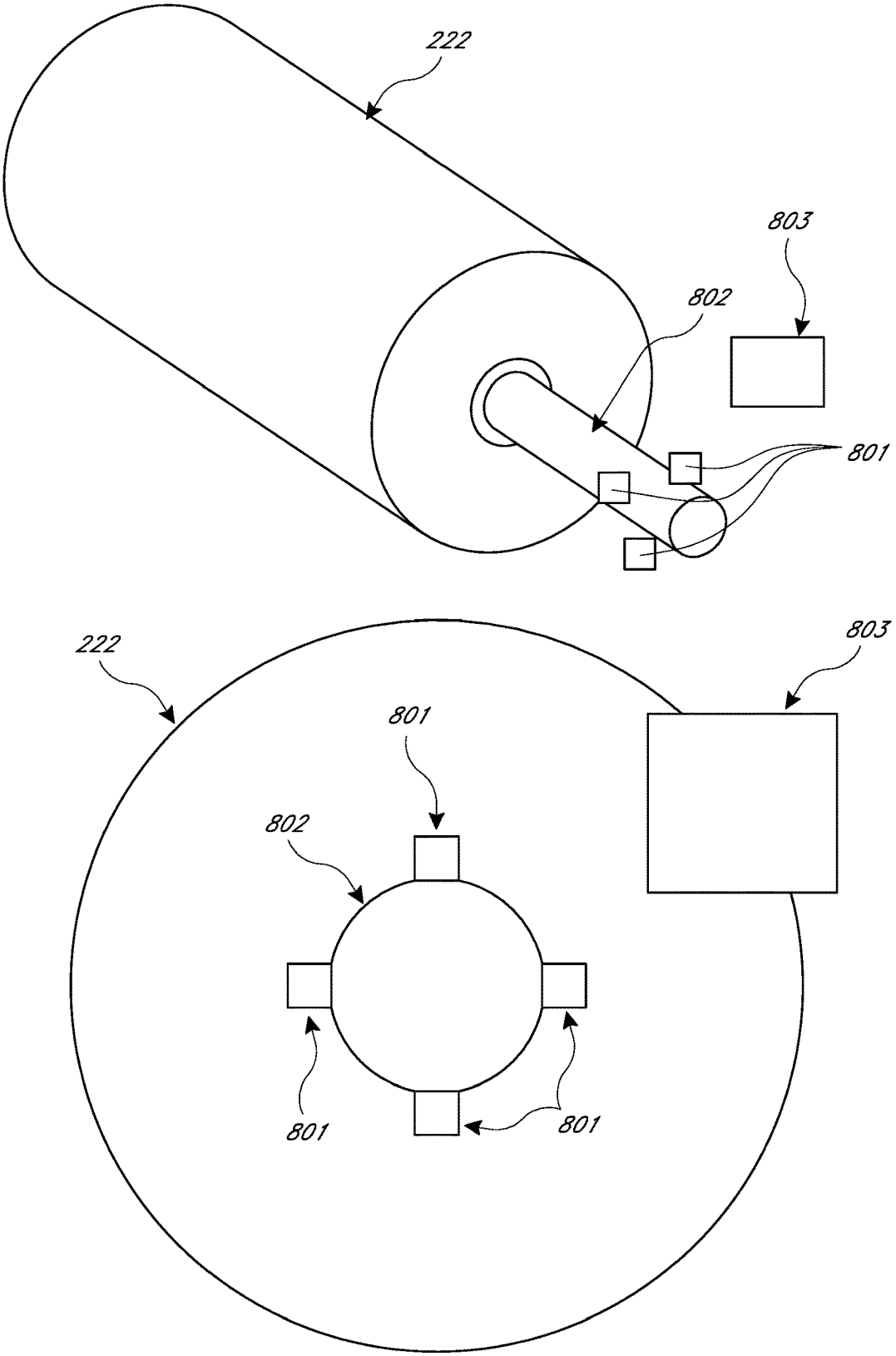
FIG. 6 illustrates an embodiment of a sensor apparatus associated with a motor.
Figure 7:
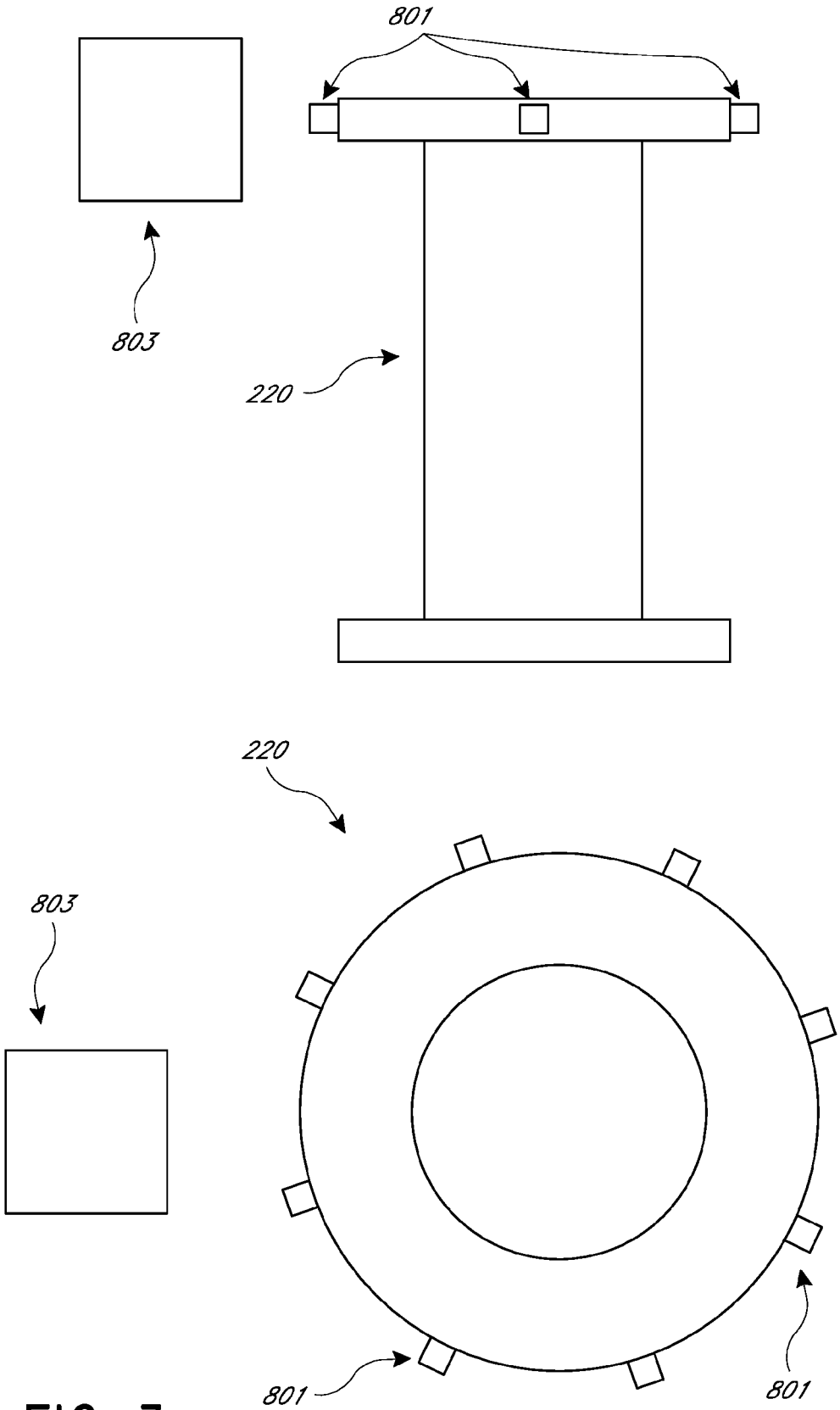
FIG. 7 illustrates an embodiment of a sensor apparatus associated with a spool member.

FIGS. 6 and 7 are illustrative examples of embodiments that monitor the amount of linear material deployed from or remaining on or within a reel device, through the use of sensors such as Hall Effect sensors or optical sensors. As shown in FIG. 6, one or more sources 801, such as magnets, reflectors, or lights, are associated with (e.g., disposed on) a shaft or axle 802 which is operationally rotated (directly or indirectly) by the motor 222. A sensor 803 detects the passage in close proximity of each of the sources 801 as the shaft 802 rotates. For example, when a source 801 passes within about 0.25 inches to 1 inch of the sensor 803, the sensor 803 can detect that a source 801 has passed. The relative positioning of the sensor 803 and the sources 801 is done in accordance with their respective properties, as is known in the art. In some embodiments, this sensor/source mechanism may be wholly or partially integrated with the motor 222 such that when some embodiments of an automatic reel is assembled, a controller 224 is operationally connected to the sensor/source mechanism of the motor 222 and receives, via that connection, signals indicative of the rotation of the motor shaft 802 as measured by the integrated sensors 803 and sources 801. FIG. 6 illustrates two substantially similar embodiments from different perspectives, involving the use of four sources 801. Generally, the more sources 801 that are used, the more precise a measurement of rotational velocity or displacement the sensor 803 can detect, up until the point at which the sources 801 are so close to one another that they interfere with each other and cannot be distinguished by the sensor 803.

Figure 10B:
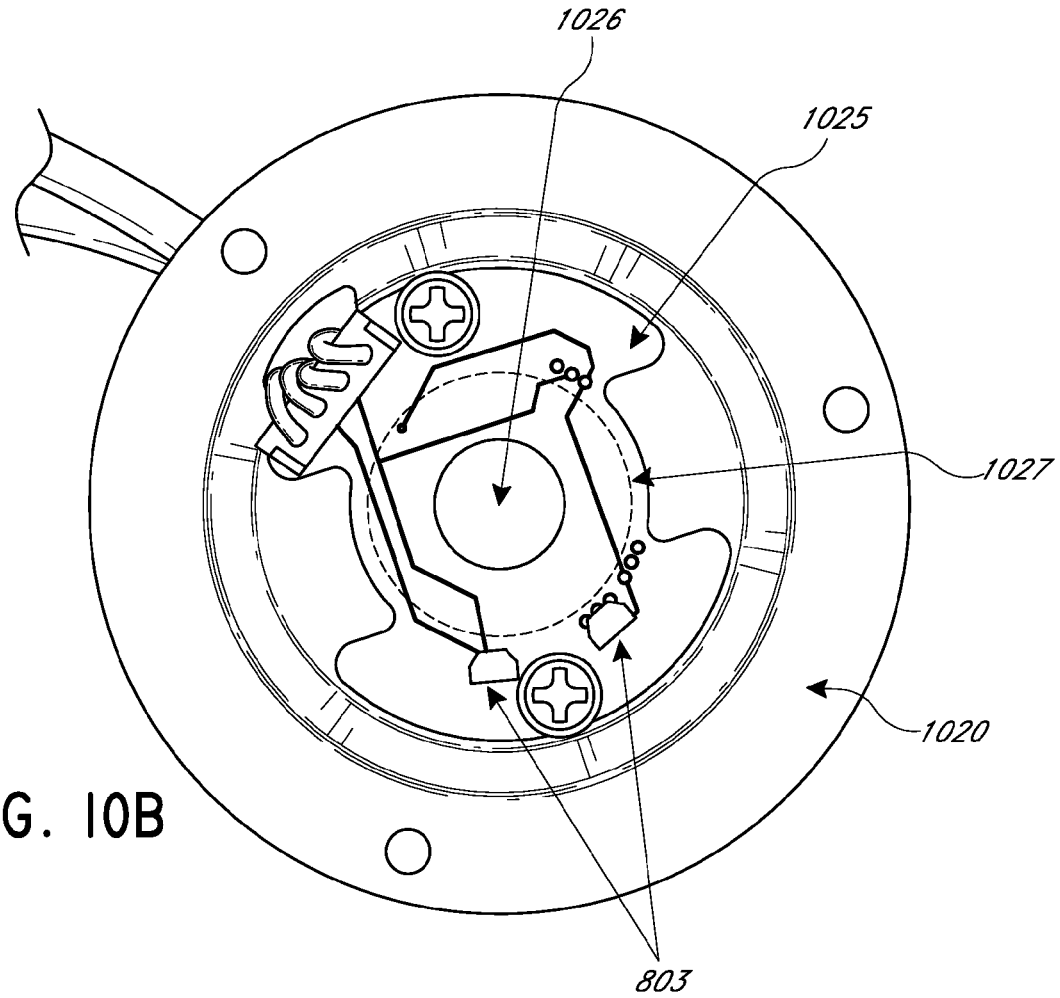
FIG. 10B is an interior view of the cap and sensor assembly of FIG. 8.
Figure 10C:
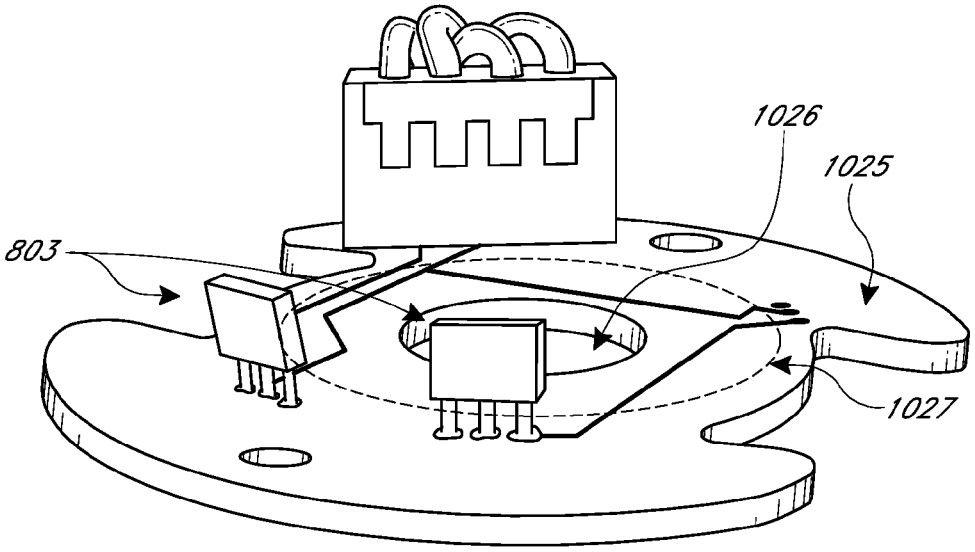
FIG. 10C is a perspective view of a sensor assembly insert mountable within the cap of FIG. 8.
Figure 11:
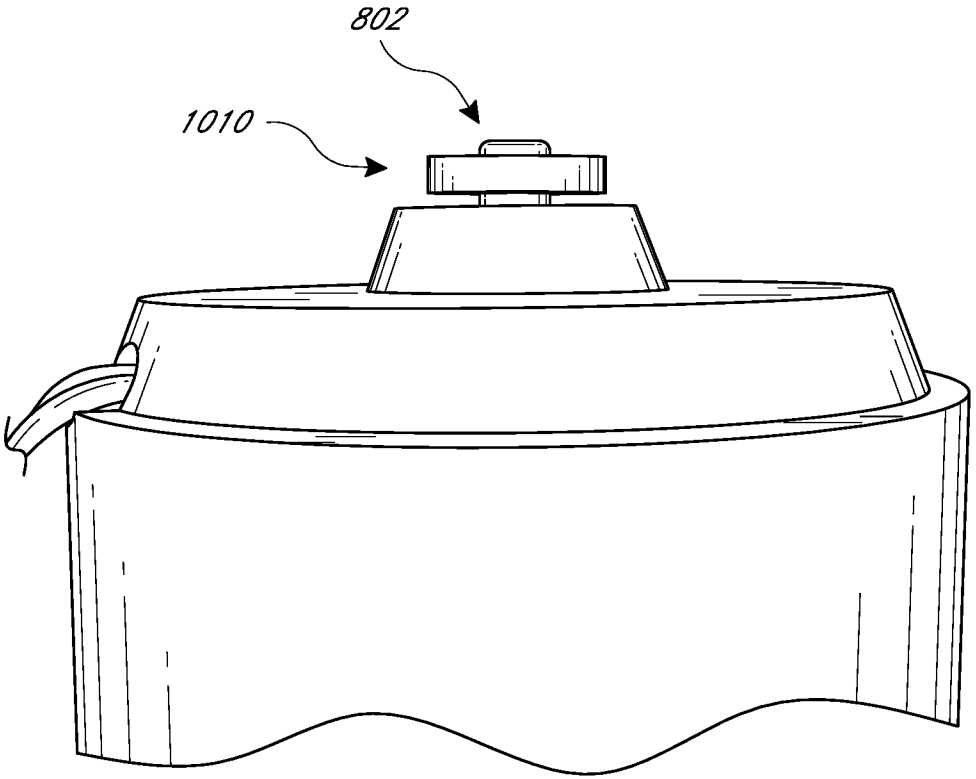
FIG. 11 is a perspective view of the motor and rotating disc of FIG. 8.

Although the embodiments illustrated in FIG. 6 each have a single sensor 803, two or more sensors 803 may be used in some embodiments. Multiple sensors 803 may provide redundancy of measurement, mitigating the risk of failure of one or more of the sensors. For example, circuitry associated with sensor/source mechanism may detect failure of one or more sensors 803 and rely upon input from remaining sensors, may weight data depending on how many sensors 803 report it, or use any of a variety of approaches known to those of skill in the art for achieving redundancy and failure support from multiple inputs. Some embodiments may use multiple sensors 803 to determine both a direction and rate of rotation. For example, if after a period of no or substantially no rotation, rotation is detected at a first sensor and then a second sensor, the controller 224 (FIG. 3) may conclude that rotation is likely occurring in one direction. If, after a period of no or substantially no rotation, rotation is detected at the second sensor and then the first sensor, the controller 224 may conclude that rotation is occurring in the opposite direction. Such a period may be a fraction of a second (such as 0.1 or 0.5 seconds, or less) or one or more seconds or minutes (such a 1, 1.5, 2, 5 or 10 seconds, or longer). The period may be predetermined or it may be dynamically established. It may be based in whole or in part on the properties of the sensor/source mechanism, the properties of the motor 222, the configuration of the automatic device 100, a user's preferences, or a combination of some or all of these. Multiple sensors 803 can also be used to determine likely direction of rotation without requiring a preliminary period of no or substantially no rotation. For example, if rotation has been detected by a first sensor and then a second sensor, in that order, and then is detected by the second sensor (again, without an intervening detection by the first sensor) and the first sensor, in that order, it may be likely that rotation has changed direction. Embodiments with multiple sensors 803 may have two, three, four, or more such sensors 803. The sensors 803 may be arranged regularly (e.g., at equal circumferential intervals) around the monitored rotating component containing the sources 801, or may alternatively be grouped closer to each other, as shown in FIGS. 10B, 10C and FIG. 11.

Control logic and heuristics for a sensor/source mechanism may be contained in software or control circuitry associated with the mechanism. For example, sensor 803 can be interfaced with a microprocessor such as those disclosed herein (e.g., a microprocessor in the microcontroller unit 610). In some embodiments, some or all of that logic and heuristics may be in a different controller (which may also use software, hardware, or a combination thereof), such as motor controller 224. In some embodiments, the motor controller 224 can include the microcontroller unit 610. A portion of the control logic may be configured to convert observations or data from the one or more sources 803 to data indicative of the rate and/or direction of rotation of the motor 222 or the associated shaft 802. The control logic may do so based on the number and relative positioning of sources 801 and sensors 803. In some embodiments, the control logic may also factor in a predefined relationship between the rate of rotation of the shaft 802 and the motor 222. For example, consider an embodiment with two sensors 803 circumferentially spaced apart by 180° about the shaft 802, and two sources 801 also circumferentially spaced apart by 180° about the shaft 802. In this example, a portion of the control logic might determine that when, over a period of one second, the sensors 803 collectively detected sources 801 four times, then the shaft 802 is rotating at approximately 0.5 to 1.0 revolutions per second (with more information about the initial relative positions of the sensors 803 and sources 801, more precision may be possible). In another example involving the same embodiment, the control logic may observe that it took approximately one second after the first source detection by a sensor 803 for a fourth source detection to be made, and may conclude that the shaft 802 is rotating at approximately 0.5 revolutions per second. A rate and/or direction of rotation of the motor 222 can be determined based on a known or assumed relationship between the rotation of the motor 222 and the rotation of the shaft 802 (which may be one-to-one). In some embodiments, the controller 224 (FIG. 3) receives the output of the sensor(s) 803 and determines, from the sensor output, the rate and/or direction of rotation. In some embodiments, separate control logic (e.g., electronic circuitry and/or a logic chip) provided in conjunction with the sensor(s) 803 and/or source(s) 801 is configured to use the sensor output to determine the rate and/or direction of rotation and to communicate that information to the controller 224.

Another way a configuration of sources 801 and sensors 803 can determine both the amount and the direction of rotation of the shaft 802 (or, as shown in FIG. 7, the spool member 220) and thereby be used to calculate a net amount of rotation is through detection of phase shifting or the like. For example, opto-isolator sensors or other optical sensors will detect not just the passing of the sources, but also the phase shifting of the signals associated with those sources. The phase shift indicates the direction of rotation.

Sources 801 and sensors 803 may be similarly configured with respect to any component of the automatic device 100 if, for example, there is a known relationship between the rotational displacement of the component and the amount of linear material wound or unwound while that component is rotating through the rotational displacement. Just as, in some embodiments, each revolution or portion of a revolution of a motor shaft 802 corresponds to a calculable length of linear material being wound or unwound from the spool member 220, in some embodiments the rotation of elements of a gearbox of device 100 may have a similar relationship such that the sensor-source apparatus is configured to monitor the rotation of a gear operatively coupled with respect to the motor 222 and the spool member 220. Or, as illustrated in FIG. 7, the rotation of the spool member 220 can be monitored using sensors 803 and sources 801. FIG. 7 illustrates the sources 801 mounted on the spool member 220, preferably at positions at which they will typically not be covered by linear material or their detection by sensor 803 not otherwise impeded. In some embodiments, sensors 803 may be disposed on the rotatable component (e.g., the motor shaft 802, spool member 220, or a gear element interposed therebetween), while in some embodiments, including the illustrated embodiments, sources 801 are disposed on the rotatable component. In some embodiments, the sources 801 and sensors 803 systems for determining a number of revolutions of the spool member 220, a rate at which the spool member 220 rotates, an amount of time for which the spool member 220 rotates, a direction of rotation of the spool member 220, or any combination thereof as discussed herein, may be mounted on multiple components of the automatic device 100, such as, for example, the spool member 220, the shaft 802, and/or a gear element to help provide greater measurement accuracy as well as system robustness through measurement redundancy.

In general, the number of sources 801 and the number of sensors 803 can vary independently. For example, some embodiments could be configured with multiple sensors 803 and one source 801, or with multiple sensors 803 and multiple sources 801. As stated above, it is typically the case that having more sources 801 or sensors 803 may result in a more precise or finer-grained measurement. Such embodiments may also be more tolerant of failure of one or more sources 801 or sensors 803. It will also be understood that in embodiments where the coupling or engagement between the motor 222 and the spool member 220 is geared, a sensor/source configuration associated with the motor (e.g., as in FIG. 6) or otherwise measuring rotation of the motor's output shaft 802 (as opposed to the spool member 220 or a gear between the shaft 802 and the spool member 220) may be more precise than the same configuration associated with the spool member 220 after the gearing (as in FIG. 7). For example, if two sources 801 are circumferentially spaced apart by 180° about the shaft 802 or spool member 220, and every half revolution can be detected by a single sensor 803, the sensor 803 will be able to report on half revolution increments of the output shaft 802 of the motor 222 (in the embodiment of FIG. 6) or the spool member 220 (in the embodiment of FIG. 7). Suppose that a half revolution of the spool member 220 corresponds to the spooling or unspooling of 12 inches of linear material, depending on factors such as those discussed above, including the amount of linear material currently on the spool member 220 (which affects the spool diameter). A half revolution of the motor shaft 802, if the device 100 has a 30:1 gear ratio, would correspond to the spooling or unspooling of 0.4 inches of linear material. Thus, placing the sensing apparatus on or near the motor shaft 802 may allow a reel device's control system to more finely measure the rotational displacement or velocity, or the linear translation of the linear material. However, there may be operational or production reasons to mount the sensor apparatus in association with the spool member 220, e.g., further from any heat emitted by the motor and closer to the spool member 220 and aperture 114 (FIG. 1).

As mentioned above, sensors 803 and sources 801, be they optical, magnetic, or otherwise, may have their own circuitry for calculating a net number of revolutions in the winding or unwinding direction, which they then make available to a motor controller, or they may send appropriate signals to another component, such as one associated with a motor controller, which is configured to determine such a result from the signals. The motor controller can ultimately use this information, as disclosed herein, to prevent deployment of a proximal end portion of the linear material.

"Waking Up" One or More Sensors

As described earlier, one or more sensors 803 can advantageously provide data to the controller 224 for monitoring movement of the spool member 220 and/or the linear material. The movement of the spool member 220 can be monitored in a variety of ways, such as determining a number of revolutions of the spool member 220, a rate at which the spool member 220 rotates, an amount of time for which the spool member 220 rotates, a direction of rotation of the spool member 220, or any combination thereof. The controller 224 can use information related to the movement of the spool member for a variety of purposes, including, for example, determining how much linear material is wound/unwound from the spool member 220 and/or determining the rate at which the linear material is wound/unwound from the spool member 220. Such information can be used in connection with any combination of features described herein, as appropriate. For instance, the data from a sensor 803 can be used in connection with powered assist.

While the sensor 803 can generate useful data related to the movement of the spool member 220, the sensor 803 and related electronics (e.g., at least a portion of the controller 224) can consume energy. This energy consumption can be significant. In some implementations, this can reduce a battery life of a battery associated with one or more components of the control system 200 or any other suitable reel apparatus.

Advantageously, to reduce energy consumption, the sensor(s) 803 and/or related electronics (e.g., the controller 224) of the various embodiments described herein can have a plurality of modes of operation, such as an active mode and a sleep mode. The sleep mode can be entered, for example, when no activity has occurred for a predetermined period of time to conserve energy (e.g., battery power). The predetermined period of time can be, for example, from about 30 seconds to 2 minutes. The sleep mode can also be entered when a predetermined amount of linear material is wound or unwound. For example, when a maximum amount of linear material is unwound from the spool member, the sensor(s) 803 and/or the controller 224 can enter the sleep mode. As another example, when a maximum amount of linear material is wound around the spool member, the sensor(s) 803 and/or the controller 224 can enter the sleep mode. In yet another example, once the controller verifies that overspooling has been contained within an acceptable limit, then sensor(s) 803 can be deactivated. In some applications, the sensor(s) 803 can be activated at the direction or command of a user, for example, in response to a button push.

In some embodiments, the sleep mode can include low-power consumption (or reduced power consumption) such as, for example, the sensors 803 monitoring for movement of the sources 801 while functionality of, for example, related electronics (e.g., the controller 224) and/or other device components (e.g., power relay) are minimized, suspended, and/or stopped. While the sensors 803 monitor for movement of the sources 801, the sensors 803 may also have reduced power-consumption relative to active mode operation of the sensors 803 as discussed herein. When the sensors 803 detect movement of the sources 801, the sensor(s) 803 and/or the controller 224 can enter the active mode, including turning on the power relay (e.g., power communicated from the power source to the motor 222), as discussed herein.

In an illustrative example, one or more sensors 803 can generate data for use with powered assist, as further discussed in U.S. patent application Ser. No. 13/449,123, filed Apr. 17, 2012, the entire contents of which are hereby incorporated by reference and should be considered a part of this specification. However, the one or more sensors 803 may be in the sleep mode before powered assist begins. As a result, unless the one or more sensors 803 are activated, they may remain in the sleep mode and the controller 224 will not have access to data from the one or more sensors 803. Alternatively, if the one or more sensors 803 are activated (e.g., powered on substantially always), they may consume unnecessary power. Accordingly, a need exists for waking up the one or more sensors 803 to bring them from the sleep mode to the active mode when certain functionalities can use the data generated by the one or more sensors 803 in a way that maintains low overall power consumption.

The principles and advantages of waking up a sensor can be applied to any number of sensors 803. For example, in an embodiment with four sensors 803, one, two, three, or four such sensors can be activated at any given time. More sensors 803 can be desirable for applications that may benefit from data with greater accuracy. For such applications, the additional power consumption of one or more additional sensors 803 and/or related electronics can be worth the increased accuracy of the data generated by the one or more sensors 803.

Once activated, the one or more sensors can generate data related to movement of the spool member. The generated data can be provided to the controller. Rotation of the spool member can be monitored based on the data from the one or more sensors. Monitoring rotation of the spool member can be used for a variety of purposes related to monitoring the motor, the linear material, the spool member, or any combination thereof.

Motors and Sensor Assemblies in a Reel Apparatus

FIGS. 8 through 11 provide illustrative examples of motor and sensor assemblies that can be used to achieve one or more advantages described herein. Any combination of features described in reference to FIGS. 8 through 11 can be implemented in connection with the principles and advantages of any of the methods or apparatuses described herein, as appropriate.

Figure 8:
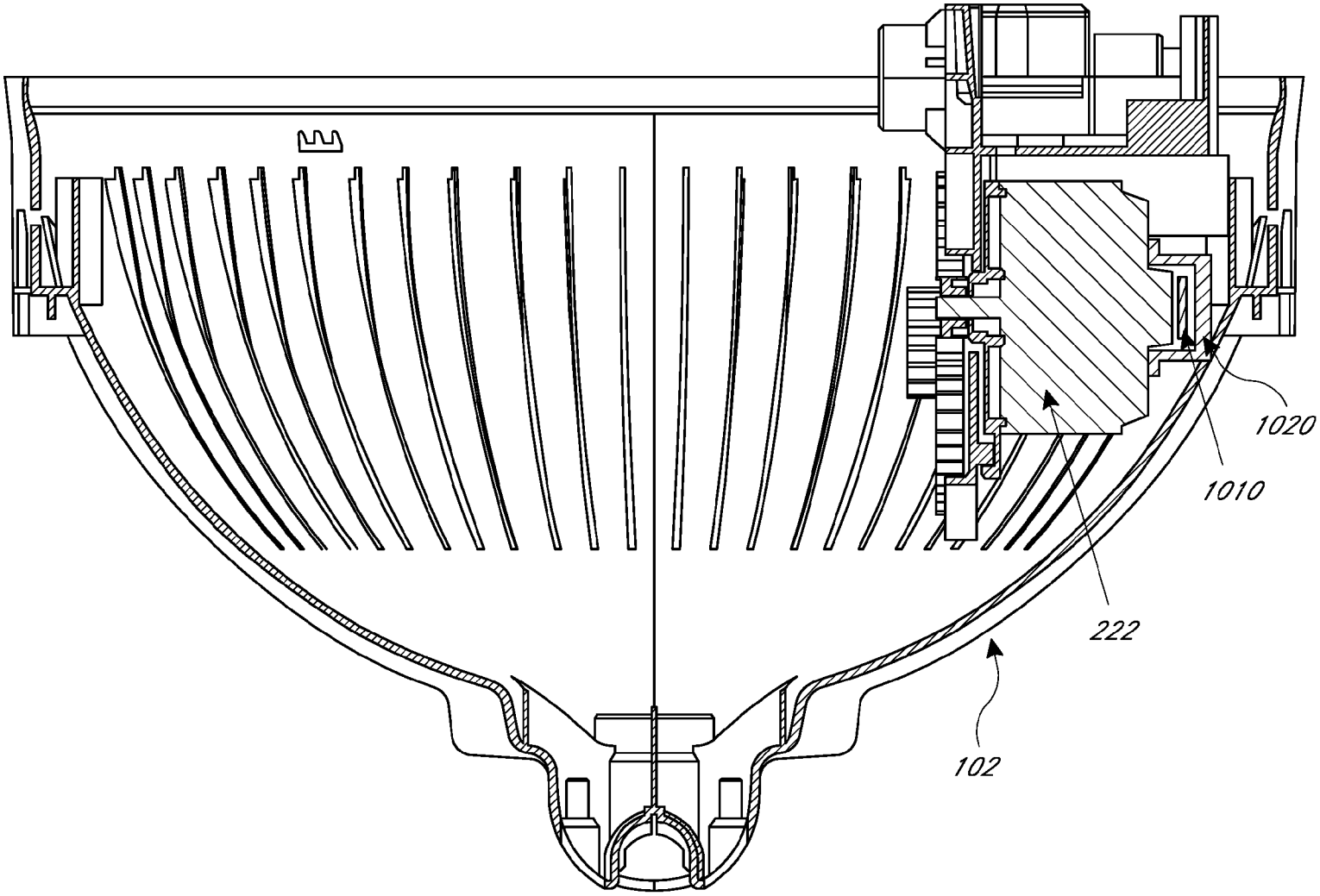
FIG. 8 illustrates an embodiment with a motor having an integrated sensor.
Figure 9:
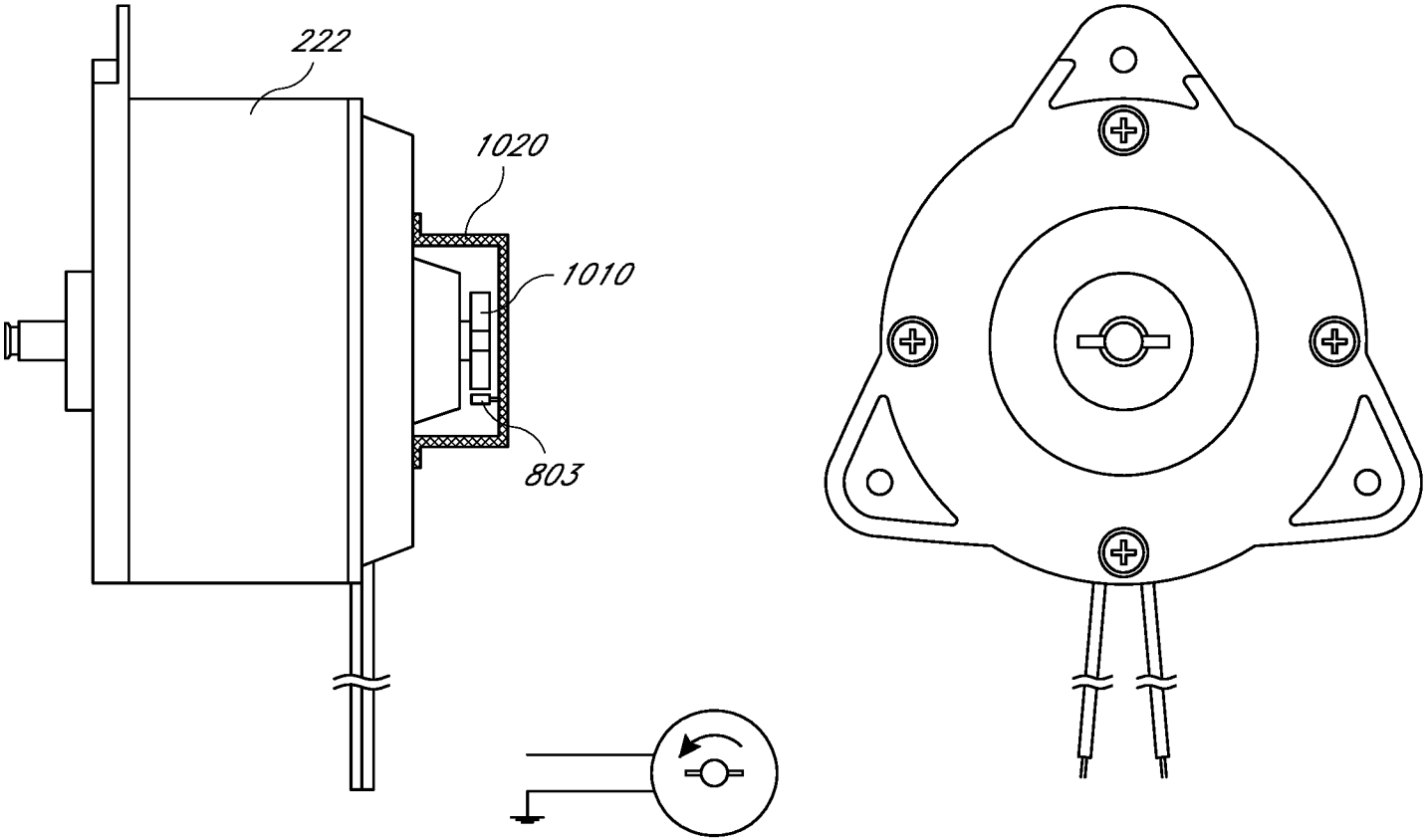
FIG. 9 is a data sheet for a motor that may be used in an embodiment such as that of FIG. 8.

FIG. 8 illustrates an embodiment including a motor 222 with an integrated sensor/source apparatus. One such embodiment may use a motor 222 such as the 300.B086 from Linix Motor. A datasheet for that motor is in FIG. 9.

In FIG. 8, the integrated sensor/source apparatus comprises a disc 1010 associated with motor 222 via a shaft such as shaft 802 (not visible in FIG. 8, but shown in FIG. 6). The association between the motor 222 and disc 1010 is preferably such that the disc 1010 rotates at the rate and in the direction of the rotation of the output shaft 802 of the motor 222, although certain embodiments may have different operational relationships between the motor 222 and disc 1010. Surrounding the disc is a cap 1020, which serves to protect the disc 1010, the sensors 803, and other components of the motor 222. Cap 1020 is optional. In some embodiments, cap 1020 may be removed from the motor 222. In other embodiments, cap 1020 is substantially permanently attached to the motor 222. Similarly, disc 1010, motor 222, and shaft 802 may be removably or substantially permanently attached to each other, by appropriate means known to those of skill in the art.

Figure 10A:
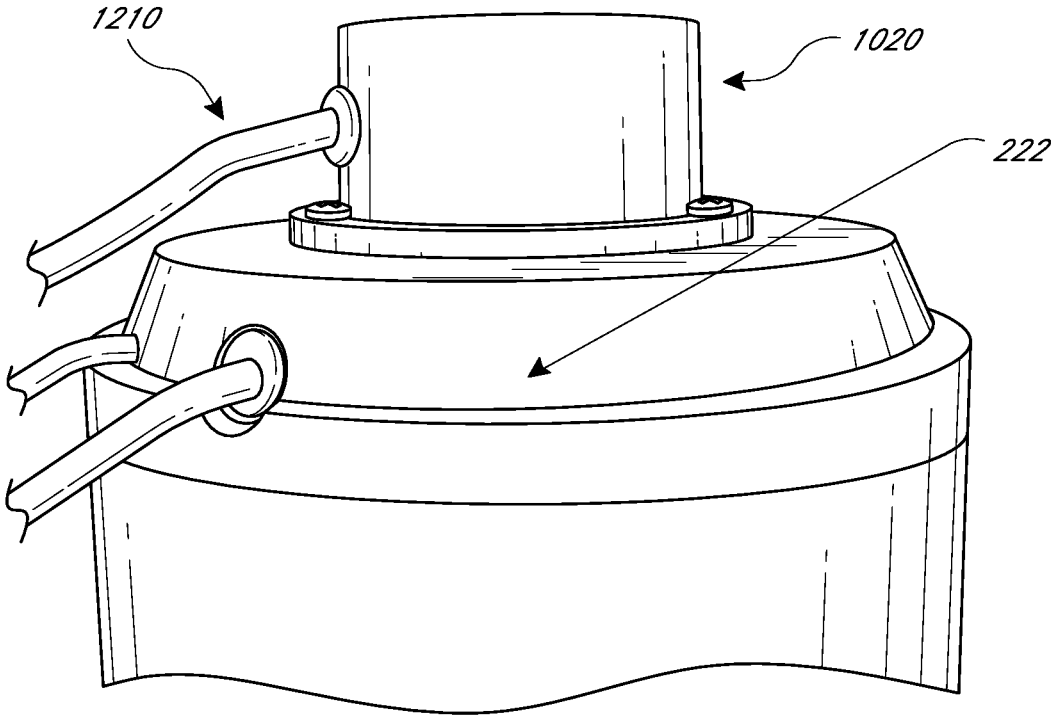
FIG. 10A is a perspective view of the cap and motor assembly of FIG. 8.

FIG. 10A shows cap 1020 attached to motor 222 via one or more screws, for example. It also shows a data communication line 1210 (e.g., a wire), capable of sending the sensor-derived information described above (the output of the sensor(s) 803 and associated control circuitry). Data communication line 1210 may be bidirectional, or there may be separate input and output lines. In addition to confirmation that output was received, data that might be input to a sensor 803 and/or its associated control circuitry includes configuration information such as data related to the number and positions of sources 801 and sensors 803, which a sensor 803 and/or associated control circuitry might use when formulating its output, for example.

FIG. 10B shows a sensor assembly insert 1025 mounted within an interior of the cap 1020. The insert 1025 supports one or more sensors 803 (such as Hall Effect sensors) and associated electronic circuitry and/or logic componentry. In certain embodiments, the insert 1025 comprises a circuit board. In the illustrated embodiment, two sensors 803 are used. The illustrated sensors 803 are not evenly or regularly distributed about the perimeter of the motor axis, but are instead positioned relatively near one another. Such a configuration, particularly when combined with appropriate logic in an associated controller, may be advantageously redundant in that if one sensor 803 should fail, another sensor 803 can take its place. In other embodiments, the sensor(s) 803 and associated electronic circuitry can be provided directly on the cap 1020, without a separate insert 1025. FIG. 10C shows the insert 1025 removed from the cap 1020. In other embodiments, the insert 1025 may be substantially permanently affixed to the cap 1020. Providing some degree of non-destructive access to the sensors 803 and associated circuitry, be it in the form of no cap 1020, a removable cap 1020, or otherwise, advantageously allows access to those components for repair, replacement, or maintenance, for example.

As illustrated in FIG. 11, disc 1010 may be attached (either removably or non-removably) to a shaft such as shaft 802, which is rotatably connected to the motor 222. Disc 1010 preferably includes one or more embedded or otherwise attached magnets, which are sources 801 (FIG. 8). In other embodiments, with appropriately configured sensors 803, different types and numbers of sources 801 may be used, as discussed above. Cap 1020, to which sensors 803 are attached (either removably or non-removably), is attached (either removably or non-removably) to motor 222 so that, for example, the shaft 802 can extend through a hole 1026 (FIG. 10B) in the insert 1025 and the disc 1010 is substantially aligned with the circle 1027 shown in FIG. 10B. In operation, the rotation of the disc 1010, which is indicative of the rotation of the motor 222, is detected and/or measured by the sensors 803. In the illustrated embodiment, the rotation of the magnets of the disc 1010 induces a voltage change across the Hall Effect sensors 803, and it is that voltage (or an associated current, for example) which is detected and reported by the sensors 803. In other embodiments, the sensors 803 may be photosensitive and the disc 1010 may contain appropriate light sources 801 instead of or in addition to magnets.

It will be understood that while disc 1010 with embedded magnets may have certain advantages in terms of rotational stability or mechanics, for example, the one or more sources 801 need not be embedded in or otherwise provided on such a disc 1010 and may, for example, be directly attached to shaft 802.

A sensor/source apparatus such as those illustrated and described herein may be configured to have a particular accuracy and/or precision in measuring rotational displacement and/or velocity. For example, it may detect full or partial revolutions, depending in part on the associated control logic and the number of sensors 803 and sources 801. An apparatus with a single sensor 803 and a single source 801 may detect only single revolutions. The use and positioning of sensors 803 and sources 801, as well as the configuration of associated control logic, may allow measuring of ½, ⅓, ¼ as well as many other fractions of a revolution. Further, the measurement accuracy may also depend in part on the speed of rotation as well as the type and quality of the components. Also, as illustrated above, some algorithms may yield precise measurements of the rate of rotation, while other algorithms may yield ranges. Embodiments may use one or both types of algorithms.

A controller 224 may also use information about rotation of the motor 222 or other components, such as from an appropriate sensor/source apparatus, to implement at least one of the features disclosed in U.S. Pat. No. 7,350,736 (issued Apr. 1, 2007), whereby the speed at which linear material is automatically wound-in is reduced when a distal end portion of the linear material (e.g., the end portion opposite to the end secured to the spool member 220) is being wound. In some embodiments, when the motor 222 is powered to rotate the spool member 220 to wind in the linear material, the motor controller 224 adjusts the operation of the motor 222 so as to slow the rate of rotation of the spool member 220 when a distal end portion of the linear material is being wound. Similarly to how the signals from the sensor 803 can be used to discontinue unwinding rotation of the spool member 220 when only the proximal end portion of the linear material remains wound on the spool member 220 (e.g., substantially all of the linear material other than the proximal end portion of the linear material is currently unspooled), the signals can also be used to determine when the distal end portion of the linear material is being wound onto the spool member 220 (e.g., substantially all of the linear material other than the distal end portion is currently spooled on the spool member).

Some embodiments may prevent deployment of the proximal end portion of the linear material by attaching a fitting to the linear material. For example, a fitting on the linear material may abut the interior surface of the body 102 of the device 100 because it is unable to pass through the aperture 114 as discussed herein. In some embodiments, contact between the fitting and the body 102 may complete or open an electronic circuit or otherwise cause a signal which is detected by the controller 224, which in turn causes the motor 222 to stop rotating.

In certain embodiments, the controller 224 operates in a voltage range from about 10 to about 14.5 volts and consumes up to approximately 450 watts. In some embodiments, the controller 224 consumes no more than approximately 42 amperes of current. To protect against current spikes that may damage the controller 224 and/or the motor 222 and pose potential safety hazards, certain embodiments of the controller 224 advantageously include a current sense shut-off circuit. In such embodiments, the controller 224 automatically shuts down the motor 222 when the current threshold is exceeded for a certain period of time. For example, the controller 224 may sense current across a current sensing device or component. If the sensed current exceeds 42 amperes for a period of more than, for example, approximately two seconds, the controller 224 advantageously turns off the motor 222 until the user clears the obstruction and restarts the controller 224. In some embodiments, the current threshold and the time period may be selected to achieve a balance between safety and performance.

For example, a current spike may occur when the linear material encounters an obstacle while the automatic device 100 is retracting the linear material. For example, the linear material may snag on a rock, on a lounge chair or on other types obstacles, which could prevent the linear material from being retracted any further by the automatic device 100. At that point, the motor 222 (and spool member 220) may stop rotating and thereby cause a spike in the sensed current draw. As a safety measure, the controller 224 advantageously responds by shutting down the motor 222 until the controller 224 receives another retract command from the user, preferably after any obstacle has been removed.

In some embodiments, the controller 224 can measure (or monitor) the electric current that is being pulled (or drawn) by the motor 222 from, for example, a battery or another power source (e.g., a wall outlet with a 120V electrical socket) of the automatic device 100. The controller 224 can take sample measurements of the electric current being pulled by the motor 222 over a time period. The measurements can occur at a predetermined sampling rate, for example, every about 30, about 40, about 50, about 60, about 70, about 80, about 90, about 100, about 150, about 200 milliseconds, or greater than about 30, greater than about 50, greater than about 100, greater than about 150, or greater than about 200 milliseconds. A higher sampling rate can achieve greater accuracy in and response to detecting a power spike for better safety and performance. The controller 224 can store in memory a predetermined number of samples (or predetermined sample number). The controller 224 can measure an average electric current draw over the predetermined number of samples. If a measured electric current sample jumps (increases) more than a predetermined current spike or jump threshold (e.g., current spike limit) above the average current draw, the controller 224 can stop the motor 222. The current spike limit can be, for example, about 10, about 20, about 30, about 40, or about 50% greater than the average current draw. For example, the controller 224 can sample the electric current draw about every 50 milliseconds. The controller 224 can calculate and store (e.g., in memory) an average current draw for a predetermined number of samples (e.g., the last 16 samples). When the electric current draw for a given sample exceeds about 20% of the average current draw of the previous predetermined number of samples (e.g., the last 16 samples), the controller 224 can stop the motor 222. Thus, with a sample rate of every 50 milliseconds, the controller 224 can stop the linear material from being wound onto the spool member 220 within about 50 to 100 milliseconds of an obstruction stopping the linear material (and causing an electric current spike), which can be almost instantaneous from a user perspective.

In some embodiments, a maximum electric current limit can be set so that relatively small current spikes or increases (e.g., relative to a current spike limit) do not immediately shut down the motor 222 when, for example, the linear material encounters small or gradual obstructions (or obstacles) during retraction. In other words, implementing a maximum electric current limit can allow for a relatively larger current spike limit to be set so that the automatic device 100 can power through obstructions that slow winding speed of the linear material (causing relatively small increases in electric current draw), but do not stop the linear material during retraction. Thus, the small obstructions may, for example, not fully prevent the linear material from being retracted, but may cause a temporary slowing of the retraction of the linear material with a commensurate temporary increase in electric current draw. In some embodiments, the maximum current may be set for more than 42 amperes or set to less than 42 amperes depending upon the design of the controller 224 and the automatic device 100. The maximum current limit can be the same or different from the current spike limit. Having a maximum current limit that is different from the current spike limit can allow for the motor 222 to "power through" obstruction that slow the linear material down. However, if the current exceeds the maximum current limit while winding, controller 224 can stop the motor to account for obstructions that slow the linear material to an undesirable retraction rate. The maximum current limit can be about 25 amperes to about 100 amperes, including about 30 to about 70 and about 40 to about 60 amperes, which can depend on the type of automatic device 100 and specific application. For example, a motor 222 operating at a base electric current of about 40 amperes can have a maximum current limit of about 55 amperes. Thus, the motor 222 operates at about 40 or more amperes and the controller 224 stops the motor 222 when the current draw reaches about 55 amperes. Automatic devices 100 with relatively heavy linear materials can have a higher electric current draw and a correspondingly higher maximum current limit. Automatic devices 100 with relatively lighter linear materials can have a lower electric current draw and a correspondingly lower maximum current limit. The maximum current limit can allow the controller 224 to take into account gradual increases in motor loads that do not result in a current spike as discussed herein. For example, the linear material being wound may encounter an obstruction (e.g., sand or gravel) that progressively slows the linear material down and results in, for example, the electric current draw of the motor 222 gradually increasing by 1% over the predetermined number of samples. If the current spike limit is 20% in comparison to an average current draw over the last 16 samples, the controller 224 may not sense a "current spike" throughout the winding operation as the average current draw over the last 16 samples steadily increases with the gradually increasing load. However, when the electric current draw of the motor 222 exceeds a maximum current limit at a certain time (e.g., retraction of the linear material keeps slowing), the controller 224 can stop the motor 222 even though a current spike limit has not been detected.

Further, in some embodiments, the automatic device 100 can have a minimum winding speed or velocity. The controller 224 can measure the winding speed of the linear material using sensors 803 (e.g., Hall Effect sensors) by counting ticks of the sensors over a time period as the motor 222 and spool member 220 rotate as discussed herein. The controller 224 can turn stop the motor 222 when the winding speed is below the minimum winding speed. For example, when the time between ticks or counts is more than a predetermined maximum tick timeout (or maximum count timeout), the controller 224 can stop the motor 222. The maximum tick timeout between counts can be, for example, about 25, about 50, about 75, about 100, about 125, about 150 milliseconds. In some embodiments, the maximum tick timeout can depend on a power setting of the automatic device 100, which can be a default factory setting or set by the user. When the controller 224 determines that the sensors 803 have not sensed a tick or count for about, for example, 75 milliseconds during winding of the linear material, the controller 224 can stop the motor 222. Thus, the controller 224 can use the operating parameters of a current spike limit, a maximum current limit, a maximum tick timeout and/or the like for a safe and highly reliable winding system that can function in various environments as discussed herein. For example, with a current spike limit, a maximum current limit, a maximum tick timeout and/or the like, the automatic device 100 may "pull through" significant and/or gradual obstructions that may have otherwise caused the controller 224 to stop the motor 222 or continue winding at an unsafe/undesirable winding speed. In some embodiments, the controller 224 can use all three operating parameters discussed herein (current spike limit, maximum current limit, and maximum tick timeout) to control the motor 222. In some embodiments, the controller 224 can use any one of the three operating parameters to control the motor 222. In some embodiments, the controller 224 can use any two of the three operating parameters to control the motor 222. In some embodiments, the controller 222 can use any combination of operating parameters discussed herein with other operating parameters to control the motor 222.

In certain embodiments, the controller 224 also uses the current sensor to determine when the linear material is fully retracted into the automatic device 100 and is wound onto the internal spool member 220. In particular, when a fitting at the end of the linear material is blocked from further movement by the linear material port 114, the linear material cannot be further retracted and the spool member 220 can no longer rotate in the retraction direction. The current applied to the motor 222 increases as the motor 222 unsuccessfully attempts to further rotate the spool member 220. The controller 224 preferably senses the current spike and responds by shutting down the motor 222. In certain embodiments, the controller 224 assumes that the current spike was caused by the completion of the retraction process, and the controller 224 establishes the current position of the linear material as the "home" position. Until a new "home" position is established, the length of the linear material extracted from the automatic device 100 is determined by the number of revolutions in the deployment direction, as discussed above, and the length of the linear material subsequently returned to the spool member 220 is determined by the number of revolutions in the retraction direction, as discussed above, relative to the "home" position.

On the other hand, if the current spike was caused by an external obstruction (e.g., the linear material is caught in a crevice and movement of the linear material is restricted), the user can release the linear material from the obstruction and press the home button on a remote control or activate a home function using the interface panel 116 on the automatic device 100. When the controller 224 is activated in this manner, the controller 224 again operates the motor 222 in the retraction direction to further retract the linear material. When the controller 224 senses another current spike, a new "home" position is established. By using the sensing of the current spike to establish the home position, the embodiments of the automatic device 100 described herein do not require a complex mechanical or electrical mechanism to determine when the linear material is fully retracted. The skilled artisan will recognize from the disclosure herein that there are a variety of alternative methods and/or devices for tracking the amount of linear material that is wound or unwound from the device 100 and/or the retraction or deployment speed of the linear material. For example, the device 100 may use an encoder, such as an optical encoder, or use a magnetic device, such as a reed switch, or the like.

One skilled in the art will recognize from the disclosure herein that the maximum current may be set for more than 42 amperes or set to less than 42 amperes depending upon the design of the controller 224 and the automatic device 100.

In certain embodiments, the controller 224 advantageously has two modes—a sleep mode and an active mode. The controller 224 operates in the active mode whenever an activity is occurring, such as, for example, the extension of the linear material by a user or the retraction of the linear material in response to a command from the user. The controller 224 also operates in the active mode while receiving commands from a user via the interface panel 106 or via a remote control. The current required by the motor control board during the active mode may be less than about 30 milliamperes, for example.

In order to conserve energy, the controller 224 is advantageously configured, in certain embodiments, to enter the sleep mode when no activity has occurred for a certain period of time, such as, for example, 60 seconds. During the sleep mode, the current required by the controller 224 is advantageously reduced. For example, the controller 224 may require less than about 300 microamperes in the sleep mode.

A remote control may enable a user to manually control the automatic device 100 without having to use the interface panel 116. In certain embodiments, the remote control operates a flow controller of the automatic device 100 (allowing and preventing the flow of a gas or liquid through a hose, for example) and also operates the motor 222 to wind and unwind the linear material onto and from the spool member 220. For example, the remote control may communicate with the controller 224 described above.

In some embodiments, the remote control operates on a DC battery, such as a standard alkaline battery. In some embodiments, the remote control may be powered by other sources of energy, such as a lithium battery, solar cell technology, or the like.

The remote control includes one or more controls (e.g., buttons or touch screen interfaces) for controlling device operation. For example, a remote control may include a valve control button, a "home" button, a "stop" button, a "jog" button, and a "kick" button. To the extent possible, symbols on these buttons may mimic standard symbols on tape, compact disc, and video playback devices.

Pressing the valve control button sends a signal to the electronics of the automatic device 100 to cause a flow controller therein to, e.g., toggle an electrically actuated valve between open and closed conditions to control the flow of a fluid (e.g., water) or a gas (e.g., air) through the linear material.

Pressing the home button causes the controller 224 to enable the motor 222 to fully wind the linear material onto the spool member 220 within the automatic device 100. In certain embodiments, the linear material is retracted and wound onto the device 100 at a quick speed after the home button has been pressed. For example, a 100-foot linear material is advantageously wound onto the spool member 220 in approximately thirty seconds.

Pressing the stop button causes the controller 224 to halt the operation of the motor 222 in the automatic device 100 so that retraction of the linear material ceases. In certain embodiments, the stop button provides a safety feature such that commands caused by the stop button override commands issued from the home button. In some embodiments, the stop button may also cause the controller to stop the motor 222 from powered assist and may enable the brake 228.

The jog button allows the user to control the amount of linear material that is spooled in by the device 100. For example, in some embodiments, pressing the jog button causes the linear material device 100 to reel in the linear material for as long as the jog button is depressed. When the user releases the jog button, the automatic device 100 stops retracting the linear material. In certain embodiments, the rate at which the device 100 retracts the linear material when the jog button is pressed is less than the initial rate at which the device 100 retracts the linear material after the home button is pressed. Because the linear material is only retracted during the time the jog button is pressed, the motor speed when retracting the linear material in response to pressing the jog button is preferably substantially constant.

In some embodiments, pressing the jog button advantageously causes the device 100 to retract the linear material a set length or for a set time period. For example, each activation of the jog button may cause the device 100 to retract the linear material approximately ten feet. In such embodiments, the jog button command may be overridden by the commands caused by pressing the home button or the stop button. Commands from the remote control may also be overridden by commands initiated by using the interface panel 106 on the automatic device 100.

A kick button may cause the controller to initiate a kick process, such as that disclosed in U.S. application Ser. No. 13/449,123, which is incorporated herein by reference. This may be helpful when a user is unable to exert sufficient force to manually trigger the kick process, or if the user prefers to have additional slack introduced into the deployment.

In certain embodiments, the remote control advantageously communicates with the automatic device 100 via wireless technologies. For example, the remote control can communicate via radio frequency (RF) channels and does not require a line-of-site communication channel with the device 100. Furthermore, the remote control transmitter is advantageously able to communicate over a range that exceeds the length of the linear material. For example, for an automatic device 100 configured for a 100-foot linear material, the communication range can be set to be at least about 110 feet. In some embodiments, the remote control is configured to communicate via other wireless or wired technologies, such as, for example, infrared, ultrasound, cellular technologies or the like.

In certain embodiments, the remote control is configured so that a button on the remote control must be pressed for a sufficient duration (e.g., at least about 0.1 second) before the remote control transmits a valid command to the automatic device 100. This feature precludes an unwanted transmission if a button is inadvertently touched by the user for a short time.

In certain embodiments, the remote control is configured so that if any button is pressed for more than three seconds (with the exception of the jog button), the remote control advantageously stops transmitting a signal to the automatic device 100. This conserves battery power and inhibits sending of mixed signals to the automatic device 100, such as when, for example, an object placed on the remote control causes the buttons to be pressed without the user's knowledge.

In some embodiments, the transmitter of the remote control and the receiver (e.g., wireless receiver) in the automatic device 100 are synchronized or "paired together" prior to use. In certain embodiments, the user advantageously receives confirmation that the synchronization is complete by observing a flashing LED on the automatic device 100 or the remote control or by hearing an audible signal generated by the automatic device 100 or the remote control.

In certain embodiments, the remote control is advantageously configured to power down to a "sleep" mode when no button of the remote control has been pressed during a certain time duration. For example, if a period of 60 seconds has elapsed since a button on the remote control was last pressed, the remote control enters a "sleep" mode wherein the current is reduced from the current consumed during an "active" state. When any of the buttons on the remote control is pressed for more than a certain time period (e.g., 0.1 second), the remote control enters the "active" state and begins operating (e.g., transmitting a signal).

In some embodiments, the remote control is advantageously attachable to the linear material at or near the extended end of the linear material. The remote control may be removeably attachable. In other embodiments, the remote control is not attached to the linear material. When the remote control is not attached to the linear material, the user can operate the remote control to, e.g., stop the flow of fluid through a hose-type linear material, and retract the linear material without entering the area where the linear material is being used. Embodiments of the remote may also take on any shape with similar and/or combined functions.

The skilled artisan will also readily appreciate from the disclosure herein numerous modifications that can be made to the electronics to operate the flow controller and an automatic device. For example, the processes disclosed herein may be implemented in software, in hardware, in firmware, or in a combination thereof. In addition, functions of individual components, such as the controller 224, may be performed by multiple components in other embodiments.

Multistage Docking

An automatic device 100 can be surface-mounted. For instance, the automatic device 100 may be mounted to a ceiling, a wall, a desktop, a table and/or another surface. In some embodiments, the automatic device 100 or reel can be a free standing unit (i.e., supported on a ground or floor surface). One example of a surface mounted automatic device 100 is shown in FIG. 2. In surface-mounted embodiments, the length of an unwound portion of the linear material when a distal end of the linear material reaches the ground/floor surface (or a lower surface other than the ground), especially when the linear material extends substantially along the shortest path from the device 100 to the ground surface (or, perhaps alternatively, the path along which the linear material would extend under gravity), can be referred to as a "ground contact length" or docking point location. As the linear material is spooled such that the unwound portion becomes less than the ground contact length, the linear material loses contact with the ground and may swing back and forth. This may be unsafe, as the swinging linear material could cause bodily injury and/or property damage. In other instances, such as a table mounted automatic device 100, the length of an unwound portion of the linear material when a distal end of the linear material loses contact with the surface upon which the automatic device 100 is mounted, can be referred to as a "surface contact length." In some of these instances (e.g., relatively small tables), any combination of the principles and advantages described herein with reference to the ground contact can alternatively or additionally be applied to the surface contact length. As described in U.S. application Ser. No. 13/449,123, which is incorporated herein by reference in its entirety, "docking" features related to reducing a rotational speed of a spool member during the winding of a distal end portion of the linear material can reduce swinging of the distal end portion of the linear material. Yet through a multi-stage docking process, swinging of the linear material may be further reduced.

Accordingly, in some embodiments, the controller 224 can operate the automatic reel device 100 such that the linear material is wound at varying rates (e.g., to remove swing from the end of the cord once it comes off the floor, to prevent tipping of the reel device from the winding force, etc.). The "docking" features related to reducing a rotational speed of a spool member during the winding of a distal end portion of the linear material can have one or more stages where the linear material is wound at varying speeds, for example, to reduce swinging of the distal end portion of the linear material.

Figure 12:
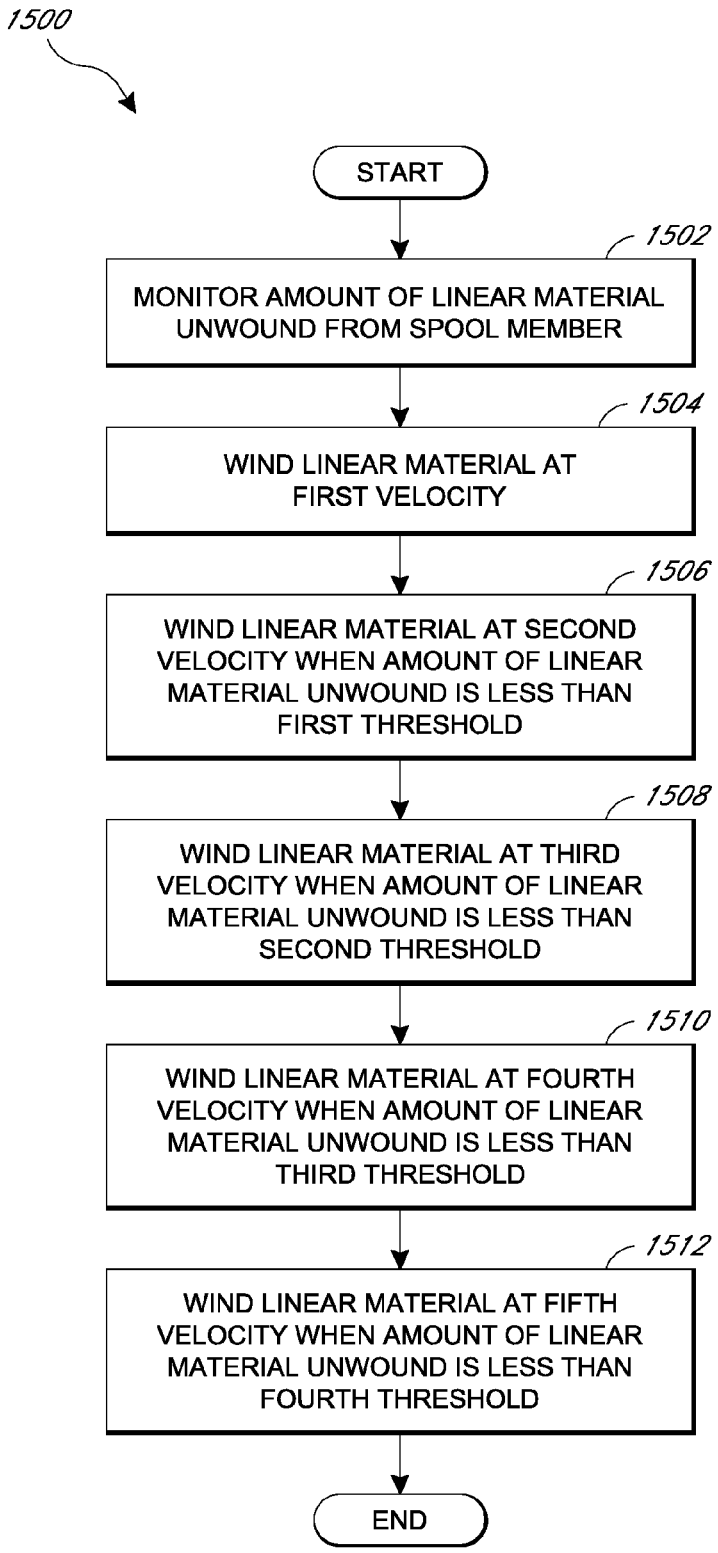
FIG. 12 is a flow diagram of an illustrative method of winding linear material at different speeds according to an embodiment.

Referring to FIG. 12, a flow diagram of an illustrative method 1500 of winding a linear material at different spooling rates will be described. The method 1500 can be implemented with any reel apparatus configured to spool linear material. For instance, the method 1500 can be implemented in connection with a surface-mounted automatic device 100 or any suitable surface-mounted real apparatus configured to spool linear material. In other implementations, the method 1500 can be implemented with a free standing automatic device 100 that is not surface-mounted. In some embodiments, the method 1500 can be implemented with any combination of features of the sensor apparatuses of FIGS. 6-11.

At block 1502, an amount of linear material unwound from a spool member can be monitored. Equivalently, the amount of linear material wound around a spool member can also be monitored. The amount of linear material can be a length and/or a mass, for example. The amount of linear material unwound from the spool member can be determined a variety of ways, for example, using any combination of features described herein. For instance, the one or more sensors 803 can generate data indicative (e.g., counts) of how many times a spool member revolves. From the generated data, a rotational velocity of the spool member and/or a number of revolutions of the spool member can be determined. Such information can be used to determine the amount of linear material unwound from the spool member. It will be understood that the monitoring of block 1502 is preferably conducted on an ongoing basis, including during the subsequent blocks 1504, 1506, 1508, and 1510 described below.

A motor can cause the spool member to rotate to wind the linear material. Spooling the linear material can be initiated a number of ways, for example, in response to a user command provided to a controller via an interface and/or a remote control. While the linear material is wound around the spool member, a controller (e.g., the controller 224) can cause the linear material to wind around the spool member at a variety of different rates. These rates can be described in a number of ways, for example, a rate of spooling (amount of linear material per unit time), a rotational velocity of the spool member, and the like. In some implementations, the controller can adjust the rate of winding by adjusting a duty cycle of a pulse provided to the motor using the principles of pulse width modulation.

With continued reference to FIG. 12, linear material can be wound around the spool member at a first velocity or speed (e.g., a "drag speed") at block 1504. The first velocity can represent a rotational velocity of the spool member and/or the amount of linear material spooled per unit time. The first velocity can represent a velocity at which the linear material is wound under typical conditions. For example, when the amount of linear material unwound from the spool member is greater than a first predetermined threshold, the linear material can be wound around the spool member at the first velocity or speed. In some implementations, the first velocity can range from about 2 to 4 feet per second. While the spool member rotates at the drag speed, the distal end of the linear material may be dragged along the ground, or other surface.

When the amount of linear material unwound from the spool member is less than the first predetermined threshold, the linear material can be wound around the spool member at a second velocity or speed (also referred to herein as a "crawl speed") at block 1506. The first threshold can represent an amount of unwound linear material (e.g., a length x1) that is greater than the ground contact length or docking point location (as discussed further below). In some embodiments, the length x1 can be between about 4-6 feet; however, in some embodiments, the length x1 can be shorter or longer than this. The first threshold can be set at the direction of the user, preprogrammed, determined algorithmically, or any combination thereof. Moreover, the first threshold can be set in relation to a second threshold that will be discussed later in connection with block 1508. The second velocity can represent a rotational velocity of the spool member and/or the amount of linear material spooled per unit time. In some implementations, the second velocity can range from about 0.1 to 0.5 feet per second. Thus, the second velocity can be less than 0.5 feet per second in some implementations.

The second velocity (e.g., crawl speed) can have a magnitude that is less than the magnitude of the first velocity (e.g., drag speed). In this way, a rate of winding of the linear material can be slowed when the amount of unwound linear material is less that the first threshold. Reducing the rate of winding can allow kinetic energy of the linear material to dissipate. For example, kinetic energy can be sufficiently dissipated so as to substantially inhibit unwanted swinging of linear material once the linear material loses ground contact below a predetermined limit in a direction transverse to a vertical axis (e.g., direction transverse to the direction of linear material travel past the docking point location). The predetermined limit can be less than about 2 feet, less than about 1 foot, or less than about half a foot. In some implementations, substantially all of the kinetic energy of the linear material can dissipate when the linear material is being wound at the second velocity. The controller 224 can advantageously control the operation of the motor 222 to wind the linear material at the second velocity or crawl speed while inhibiting hysteresis (e.g., rapid speed changes that can lead to vibration and shaking of the rotatable spool member 220) during the winding process where the controller 224 is adjusting power to the motor 222 to maintain the second velocity generally constant.

When the amount of linear material unwound from the spool member is less than a second predetermined threshold, the linear material can be wound around the spool member at a third velocity or speed at block 1508. In some embodiments, the second threshold can represent an amount (e.g., a length) of unspooled linear material that is equal or nearly equal to the ground contact length or docking point location. The second threshold can be set at the direction of the user, preprogrammed, determined algorithmically, or any combination thereof. Moreover, the second threshold can be set in relation to the first threshold described in connection with block 1506. The third velocity can represent a rotational velocity of the spool member and/or the amount of linear material spooled per unit time.

In some embodiments, the third velocity can have a magnitude that is generally equal to the second velocity (e.g., crawl speed). In this way, a rate of winding of the linear material can continue at the same speed just before the linear material loses touch with the ground (e.g., docking point location) and for some length or period of time thereafter, as further described below. In some embodiments, the third velocity can be greater or smaller than the second velocity.

When the amount of linear material unwound from the spool member is less than a third predetermined threshold, the linear material can be wound around the spool member at a fourth velocity or speed (e.g., a "docking speed") at block 1510. In some embodiments, the third threshold can represent an amount (e.g., a length) of unspooled linear material that is a predetermined length x2 less than the ground contact length. In some embodiments the length x2 can be about 1-2 feet; however, in some embodiments the length x2 can be shorter or longer than this. In some embodiments, the ratio of the length x1 to the length x2 can be about 2-to-1 or 3-to-1; however, in some embodiments, the ratio of the lengths x1/x2 can be smaller or greater than this. Having a larger ratio of length x1 to the length x2 can help further inhibit hysteresis (e.g., rapid speed changes that can lead to vibration and shaking of the rotatable spool member 220) as discussed herein. For example, an electrical receptacle, spray selector, remote, and/or the like at the end of the linear material that is heavy (and has large momentum during winding) may require a longer predetermined length x1 to dissipate the momentum with friction against the ground surface. On the other hand, increasing predetermined length x2 may not be necessary to achieve the desired inhibition of hysteresis, thus, increasing the overall ratio x1/x2 in comparison to, for example, a lighter electrical receptacle, spray selector, remote, and/or the like at the end of the linear material. Thus, a relatively larger ratio x1/x2 may inhibit undesired swinging while still minimizing overall winding time (e.g., the docking speed is initiated after the linear material winds a relatively short length x2 at the crawl speed). The third threshold can be set at the direction of the user, preprogrammed, determined algorithmically, or any combination thereof. Moreover, the third threshold can be set in relation to the first and second thresholds described in connection with blocks 1506 and 1508. The fourth velocity can represent a rotational velocity of the spool member and/or the amount of linear material spooled per unit time.

The fourth velocity can have a magnitude that is greater than the magnitude of the third velocity. In this way, a rate of winding of the linear material can be increased when the amount of linear material unwound is less than the third threshold. After kinetic energy of the linear material has dissipated by winding at the second velocity, the linear material can be wound at a higher rate in a way that is less likely to cause injury and/or property damage. In some implementations, the linear material can be wound at the fourth velocity until substantially all of the linear material is wound around the spool member. For instance, in some embodiments the linear material can be wound at the fourth velocity until the controller causes the spool member to cease rotation because substantially all of the linear material is wound around the spool member. In some embodiments, the linear material can be wound at the fourth velocity until the controller causes the spool member to cease rotation because a predetermined length of the linear material has wound around the spool member that allows a length of the linear material to remain unspooled (e.g., a predetermined docking amount or grasping length of the linear material to facilitate grasping of the linear material by the user in wall or ceiling mounted automatic devices 100). In some implementations, the fourth velocity can range from about 1 to 4 feet per second.

In some embodiments, the docking speed may be variable to, for example, slow an end of the linear material before it comes into contact with a housing 102 of the automatic device 100 at the aperture 114 to help prevent slamming the end of the linear material into the device 100. In some embodiments, when the amount of linear material unwound from the spool member is less than a fourth predetermined threshold, the linear material can be wound around the spool member at a fifth velocity or speed (e.g., a variable "docking speed") at block 1512. In some embodiments, the fourth threshold can represent an amount (e.g., a length) of unspooled linear material corresponding to a particular segment of a maximum count (e.g., Segment 1) as discussed below. The fourth threshold can be set at the direction of the user, preprogrammed, determined algorithmically, or any combination thereof. Moreover, the fourth threshold can be set in relation to the third threshold described in connection with block 1510. The fifth velocity can represent a rotational velocity of the spool member and/or the amount of linear material spooled per unit time. The fifth velocity can have a magnitude that is less than the magnitude of the fourth velocity. In some implementations, the second velocity can range from about 0.1 to 3 feet per second, which can depend on the configuration of the end of the linear material, aperture 114, and/or housing 102 to help prevent the end of the linear material from striking/slamming into the aperture 114 and/or housing 102. For example, an electrical receptacle, spray selector, remote, and/or the like on the end of the linear material may be heavy. The more heavy-weight the end of the linear material is (and/or light-weight the aperture 114 and/or housing 102 are), the slower the fifth velocity that might be implemented to help slow down the end of the material to help prevent slamming the aperture 114 and/or housing and minimize potential damage to the end of the linear material, aperture 114, and/or housing 102.

The one or more sensors 803 (e.g., Hall Effect sensors) can provide a controller 224 with a rotation indicator each time a magnet passes in proximity to the Hall Effect sensor. For example, when the magnet passes within about 0.25 to 1 inch of the Hall Effect sensor, the Hall Effect sensor can provide the controller with the rotation indicator. The controller 224 can store and/or access computer instructions for multi-stage docking, such as the multi-stage docking discussed above, from a non-transitory computer readable medium. The controller 224 can count a number of times that a magnet passes the Hall Effect sensor. For instance, when the linear material is completely wound around the spool member, the count can be zero. The count can represent a number of full and/or partial revolutions of the spool member. Further, the controller can increment or decrement the count based on the direction of rotation of the spool member. Accordingly, the count can correspond to an amount of linear material unspooled from the spool member.

When the linear material is completely unwound, a maximum count can be, for example, fifty-two (52). In some embodiments, the maximum count can be about 1000 to 2000, including 1500 to 2000, or 2000 or more. The higher the maximum count, the quicker the controller can detect changes in winding speed. A higher maximum count allows for more ticks to be registered by the sensors 803 as discussed herein over a shorter time period, allowing for the controller to more quickly adjust the winding speed. Concomitantly, a higher maximum count may provide a more precise winding speed measurement as changes in winding speed (e.g., changes in registered ticks) can be sensed and adjusted for in real or near real-time.

A visual indication of the number of counts can be provided to the user to let the user know how much of the linear material (e.g., hose, electrical cord) has been wound or unwound. In some embodiments, the count can be visually displayed on the interface panel 116 of the device 100 and/or displayed in a visual interface of a remote control of the device 100. The count can be displayed as a numerical value representing the number of times the spool member 220 has gone through a full revolution. In some embodiments, the count can be displayed as a length (e.g. feet) corresponding to the length of the linear material that has been wound or unwound. Alternatively, or additionally, and audio indication of the count can be provided.

The controller can be configured such that the count cannot exceed the maximum count. The maximum count can be used for self calibration. The controller 224 can split the maximum count into a plurality of count segments, for example, six count segments as shown in Table 1.

TABLE 1

| | Segment | | | | | |
|---|---|---|---|---|---|---|
| | 1 | 2 | 3 | 4 | 5 | 6 |
| Counts | 0-7 | 8-15 | 16-23 | 24-31 | 32-39 | >40 |

The plurality of count segments can provide flexibility in adjusting a rate at which a motor causes the spool member to wind the linear material around the spool member. Two or more segments of the plurality of segments can correspond to an equal number of counts. For instance, Segment 1 can correspond to 8 counts and Segment 2 can also correspond to 8 counts. Alternatively or additionally, two or more segments of the plurality of segments can correspond to a different number of counts. For instance, Segment 5 can correspond to 8 counts and Segment 6 can also correspond to 12 counts. In each segment, the linear material can be wound at a different rate. Alternatively or additionally, the linear material can be wound at substantially the same rate for two or more segments. For example, when the linear material is unwound to Segment 6, the linear material can be retracted at a "drag speed." Then when the count reaches Segment 2, the rate of winding can be decreased to a "crawl speed." Finally, when the count reaches Segment 1, the rate of winding can speed up and/or slow down to a "docking speed." As discussed herein, the docking speed may be variable. As discussed herein, in some embodiments, the docking speed may include a fifth velocity that is slower than a fourth velocity. Accordingly, the docking speed can include a slow speed (e.g., fifth speed or velocity) that allows, in some embodiments, an end of the linear material to come into contact with a housing 102 of the automatic device 100 at the aperture 114 without slamming into the automatic device 100. For example, the end of the linear material may include an apparatus (e.g., a water-spraying device or a large connector block for one or more electrical device plugs) that is larger than the aperture 114 and unable to pass therethrough.

Initiation of Winding Operation

Figure 13:
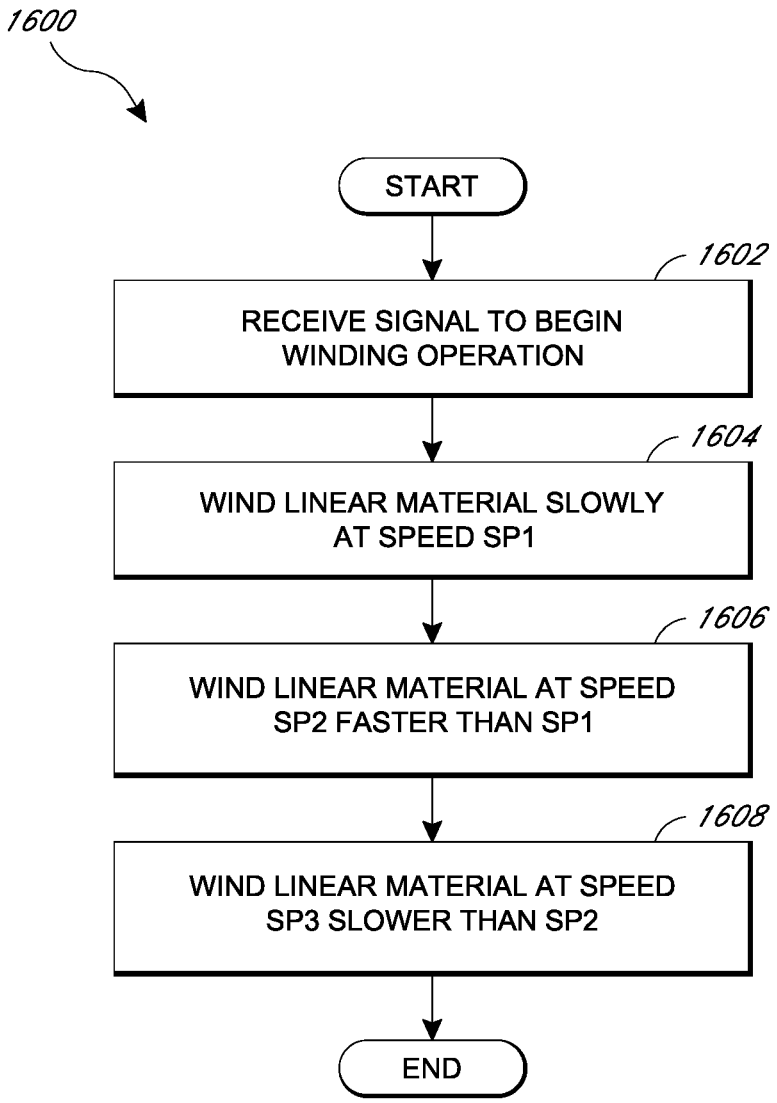
FIG. 13 is a flow diagram of an illustrative method of winding linear material different speeds according to one embodiment.

FIG. 13 shows a flowchart describing a method 1600 for winding linear material on the automatic device 100 (e.g., reel), which can be a freestanding device or surface mounted device, as discussed above. The method 1600 can be implemented by the automatic device 100 in conjunction with the method 1500 of FIG. 12.

The winding operation can begin 1602 upon receipt of a signal to begin winding the linear material, as described in application Ser. No. 13/802,638, which is hereby incorporated by reference in their entirety and should be considered a part of this specification. Such a signal can be provided by the user to the automatic device 100 via the interface panel 106 and/or via a remote control that transmits the initiation signal to the controller 224 of the automatic device 100. In some embodiments, the signal can be provided manually by the user by jerking or pulling on the linear material by a certain distance or a predetermined pull amount of the linear material (e.g., 1 to 4 inches) that triggers the initiation of the winding operation.

Figure 14:
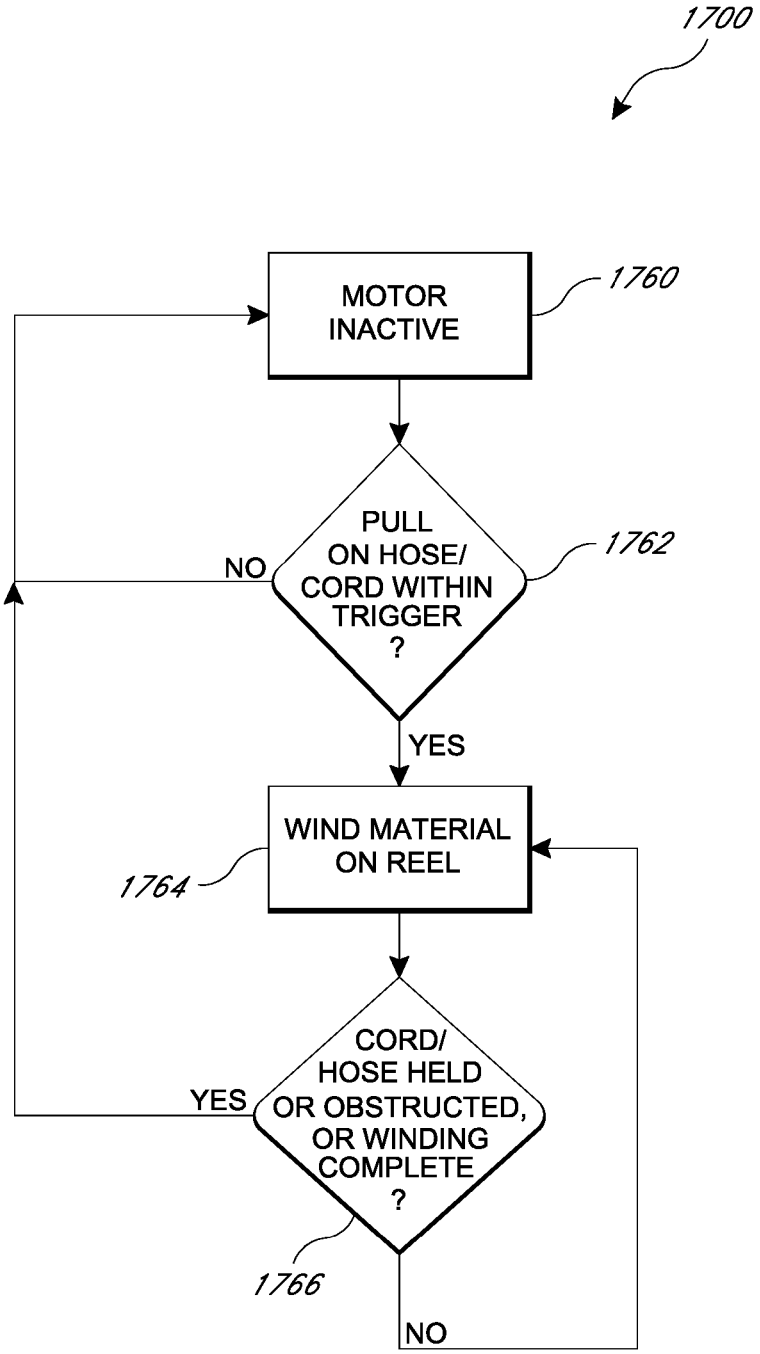
FIG. 14 is a flow diagram of an illustrative method of initiating a winding operation of a linear material.

FIG. 14 shows a flowchart describing a method 1700 for winding linear material on the automatic device 100 (e.g., reel), which can be a freestanding device or surface mounted device (e.g., wall mounted, ceiling mounted), as discussed above.

The winding operation can begin when the motor 222 of the automatic device 100 is stopped or inactive 1760. A user can pull or yank 1762 on the linear material (e.g., a conventional electrical cord coupled to the spool member 220) over a length within a predetermined range (e.g., a pull out distance between 1 and 4 inches), which can cause the rotatable spool member 220 to rotate such that its rotation is sensed by the one or more sensors 803 (e.g., Hall Effect sensors), as described above. The sensors 803 can communicate the rotation of the rotatable spool member 220 to the controller 224, and the controller 224 can determine if the rotation is within a predetermined range (e.g., length or number of counts or ticks) that triggers a retraction signal. If the yank 1762 on the linear material by the user is within the predetermined range, the controller 224 can determine or receive the retraction signal and can operate the motor 222 to begin the winding 1764 of the linear material on the rotatable spool member 220. Alternatively, if the user pulls 1762 on the linear material over a length greater than the predetermined range (e.g., pulls on the linear material 6 inches, rather than between 1-4 inches), the controller 224 does not initiate winding of the linear material. Additionally, if the user holds 1766 onto the linear material or continues to unwind the linear material (e.g., continues to pull on the hose or cord by providing a holding force), the controller 224 uses a "timeout" to turn off the motor 222 and allow further extraction or unwinding of the linear material, during which the "pull to wind" feature is disabled for the remainder of the extraction, unless the linear material stops moving (e.g., the user stops pulling on the linear material) for a predetermined period of time (e.g., 2 seconds). For example, if the "pull to wind" feature is disabled as discussed herein and the linear material stops moving for a predetermined period of time (e.g., 2 seconds), the "pull to wind" feature is enabled after the linear material has not moved for the predetermined period of time. In some embodiments, the user holding onto the linear material can be considered a similar event as the linear material being held in place by an obstruction as discussed herein.

In the event that the user holds on to the linear material while the motor 222 is rotating the rotatable spool member 220 to wind linear material (e.g., the retraction signal is triggered), the controller 224 will sense the stop in rotation (e.g., sense a spike in motor current or electric current draw of the motor), as discussed above, and cause the motor 222 to stop the winding process. For example, the user may desire to have a shorter length of the linear material extracted for use at a new location that is closer to the device 100, requiring a shorter length of the linear material to be extracted then currently extracted. The user may pull on linear within the predetermined range, causing the controller to initiate winding while the user holds on to the linear material. The user may then prevent further winding of the linear material at the new location, causing the controller 224 to turn off the motor 222 and further winding as discussed herein. The user can then again yank on the linear material to re-start the winding operation.

Following receipt of the signal to initiate the winding operation, the controller 224 can control the motor 222 to rotate the rotatable spool member 220 so that the linear material is wound at a relatively slow start-up speed SP1, and can wind the linear material at the start-up speed SP1 over a certain distance or counts, as discussed above. In some embodiments, the start-up speed SP1 can be between about 0.1 and 3 feet per second. In some embodiments, start-up speed SP1 can be based on the power and efficiency of the motor 222, which can vary based on type of motor and type of automatic device. In certain implementations, start-up speed SP1 can correlate to a start-up power setting of the motor. The start-up power setting can be about 25 to 75% of the maximum pulse width modulation (PWM), including about 35 to 65% and about 40 to 60% of the maximum PWM, and including more than 75% of the maximum PWM. Beginning the winding operation at the relatively slow start-up speed SP1 can allow the user time to release his or her grip on the linear material (e.g., drop the end of the linear material) so that the linear material is not yanked from the user's hand. Additionally, where the linear material has been unwound (e.g., fully unwound where all of the cord or hose has been previously deployed) so that the weight of the deployed linear material is about the same or greater than the weight of the automatic device 100, particularly in freestanding automatic devices 100, winding of the linear material at the relatively slow start-up speed SP1 can allow winding of a predetermined amount of linear material onto the rotatable spool member 220, thereby increasing the weight of the automatic device 100 and preventing the automatic device 100 from tipping over due to the winding force.

Once a certain length of linear material has been wound at the start-up speed SP1 or a predetermined number of counts have passed, so that tipping of the reel is minimized, the winding speed can increase to a second speed SP2 that is faster than the start-up speed SP1. Winding at the relatively faster second speed SP2 can allow for the winding operation to be completed faster, particularly where the length of unwound linear material is significant (e.g., greater than 25-40 feet). In some embodiments, the second speed SP2 can be the drag speed 1504 discussed above in connection with the method 1500 shown in FIG. 12. In some embodiments, the second speed SP2 can be faster than the drag speed 1504 and/or docking speed 1510 discussed above in connection with the method 1500 shown in FIG. 12.

After a certain length of the linear material has been wound at the second speed SP2 or a predetermined number of counts have passed, so that a relatively shorter length of linear material is left to be wound (e.g., less than 25, 20, 15, or 10 feet), the winding speed can decrease to a third speed SP3 that is slower than the second speed SP2. In some embodiments, the third speed SP3 can be the drag speed 1504 discussed above in connection with the method 1500 shown in FIG. 12. In some embodiments, the third speed SP3 can be the crawl speed 1506, 1508 discussed above in connection with the method 1500 shown in FIG. 12. In some embodiments, the third speed SP3 can be the docking speed 1510 discussed above in connection with the method 1500 shown in FIG. 12. In some embodiments, the third speed SP3 can be the fifth velocity 1512 discussed above in connection with the method 1500 shown in FIG. 12. Thereafter, the winding speed can be adjusted as discussed above with respect to method 1500 and shown in FIG. 12. In some embodiments, the winding speed can be adjusted as discussed above with respect to both method 1500 and method 1600 simultaneously. For example, as discussed above, the second speed SP2 can be the drag speed 1504 the third speed SP3 can be the docking speed 1510.

Throughout the winding operation, the controller 224 can control the motor 222 to stop the winding operation if an obstruction is sensed (e.g., if the user steps on the linear material, or the linear material gets caught). The winding operation can again begin once an initiation signal 1602 is received by the controller 224, as discussed above.

The controller 224 can control how long the linear material is wound at the second speed SP2 based on the length of unwound linear material that has to be wound (e.g., based on the number of counts, as discussed above). For example, if following the initial winding at the start-up speed SP1, the length of unwound linear material is greater than a first predetermined length (e.g., greater than 25-40 feet), the automatic device 100 can wind the linear material at the relatively faster speed SP2. However, if following the initial winding at speed SP1 the length of unwound linear material is less than a second predetermined length (e.g., length at which drag speed 1504 is implemented), the controller 224 can instead follow winding of the linear material at the first speed SP1 with winding the linear material at the third speed SP3 (which can be equal to the drag speed or other speeds as discussed herein), without winding the linear material at the relatively faster second speed SP2.

In some embodiments, winding at the various speeds as discussed herein can be combined. For example, implementing both methods of FIGS. 12 and 13 can result in winding at SP2 (first velocity or speed) when a length of the material unwound from the spool is member is great than a first predetermined threshold (e.g., greater than 25-40 feet). When the length of the material is less than the first predetermined threshold but greater than a second predetermined threshold (e.g., crawl length), the linear material can be wound at the drag speed. When the length of the material is less than the second predetermined threshold but greater than a third predetermined threshold (e.g., ground contact length less the length x2), the linear material can be wound at the crawl speed. When the length of the linear material is less than the third predetermined threshold, the linear material can wound at the docking speed. In some embodiments, the linear material can first be wound at SP1 (start-up speed or velocity) when the length of the linear material is greater than a fourth predetermined threshold (e.g., an unspooled length of linear material that may cause the automatic device to tip if the linear material is wound at an initial quick speed).

Winding at the various speeds as discussed herein (e.g., methods of FIGS. 12 and 13) can also be implemented as follows. The linear material can initially be wound at the SP1 (start-up speed or velocity) over a first predetermined length (e.g., a spooled length of the linear material sufficient to increase the weight of the automatic device as the linear material is wound onto the spool member to help prevent tipping of the automatic device). When the length of the material is greater than a second predetermined amount (e.g., greater than 25-40 feet), the linear material can be wound at SP2 (second speed or velocity). When the length of the material is less than the second predetermined amount but greater than a third predetermined amount (e.g., crawl length), the linear material can be wound at the drag sped. When the length of the linear material is less than the third predetermined amount, the linear material can be wound at the crawl speed. When the length of the linear material is less than a fourth predetermined amount (e.g., ground contact length less the length x2), the linear material can be wound at the docking speed.

In some embodiments, the reel assembly can be programmed to leave a predetermined amount of linear material outside of the housing (e.g., the entire length of the linear material is not wound onto the spool member). Leaving an unwound predetermined amount of linear material can help a user grasp the unwound portion to initially grasp and pull the linear material for extraction, particularly when the reel assembly is mounted to a ceiling. The user, in some embodiments, can program a desired amount of linear material to remain unwound after winding is complete. For example, the user can pull the end of the linear material to a predetermined grasping length, and while holding the end of the linear material in a generally fixed position corresponding a desired grasping length of linear material, yank a predetermined number of times (e.g., 4 times). After programming, the controller causes the spool member to cease rotation at the predetermined length of the linear material that allows a length of the linear material to remain unspooled (e.g., a predetermined docking amount or grasping length of the linear material to facilitate grasping of the linear material by the user in wall or ceiling mounted automatic devices 100). In some embodiments, the predetermined grasping length can have a default length set at the factory.

Determination of Docking Point

A "docking length" (location) can correspond to the count at or near winding at the docking speed is initiated. For example, the docking length can correspond to the ground contact length less the length x2 between the second and third thresholds discussed above in reference to method 1500. In some embodiments, the docking length can correspond to the ground contact length described earlier in reference to the method 1500 at which point the linear material first contacts the ground (e.g., docking point). In some implementations, the docking length can be greater than or less than the ground contact length. The docking length can be set to a default value, for example, 8 counts. Alternatively or additionally, the docking length can be programmed at the direction of the user. For instance, when the length of linear material unwound from the spool member is at or near the ground contact length, a user can set the docking length. In some embodiments, the user can provide commands to a controller 224 via an interface panel and/or via a remote control to set the docking length. The controller 224 can store the docking length in memory. In some implementations, the controller 224 can store the count when the user sends a docking length programming command to the controller. Alternatively or additionally, the user can provide commands to the controller 224 via an interface panel and/or via a remote control to set the count to any number up to the maximum count when any amount of linear material is wound/unwound from the spool member to set the docking length.

The "ground contact length" can correspond to the length of linear material from the automatic device 100 to the point ("docking point location") at which the linear material first contacts the ground/floor surface (e.g., number of counts from the automatic device 100 to the ground/floor surface). In some embodiments, the docking point location can be programmed at the direction of the user. For example, the user can pull the end of the linear material to the ground/floor surface, and while holding the end of the linear material in a generally fixed position at this location yank on the linear material a predetermined number of times (e.g., 3 times). Yanking on the linear material said predetermined number of times advantageously triggers the controller 224 to set the docking point location as the number of counts corresponding to the unwound length of the linear material held by the user to the ground. The controller 224 can then save the determined docking point location to memory. If, for example the automatic device 100 is repositioned at a different location, the user can reset the docking point location, in the manner note above, and the controller 224 can overwrite the previously stored value with the new value for the docking point location in the memory. When the user sets both a docking point location and a predetermined grasping length, the user can yank the end of the linear material a first predetermined number of times (e.g., 3 times) at a first generally fixed position to program the docking point location and yank the end of the linear material a second predetermined number of times (e.g., 4 times) at a second generally fixed position to program the predetermined grasping length.

In some embodiments, a controller, such as the controller 224 in FIG. 3 or microcontroller 610 in FIG. 4, can automatically detect the docking point location (e.g., point at which linear material loses contact with the ground) based on a sensed acceleration or deceleration (change in velocity) of the spooling of linear material due to the lack of friction between the linear material and the ground surface when the linear material lifts off the ground/floor. As discussed above, the one or more sensors 803 (e.g., Hall Effect sensors) can provide an indication (e.g., counts) of the rotation of the spool member 220 and communicate this information to the controller. The controller can therefore determine acceleration or deceleration (change in velocity) of the spooling of linear material, and therefore the docking point location, based on a decrease or decrease in the time period between counts that is sensed by the one or more sensors 803. For example, as discussed above in connection with method 1500, the controller can operate the automatic device 100 to wind the linear material at a constant crawl speed (see 1506 in FIG. 12) while on the ground/floor surface such that a significant drag force is exerted on the linear material by the ground/floor surface, and determine the docking point location by sensing when the winding of the linear material accelerates (e.g., when the time period between counts decreases). The controller can then set the docking point as the number of counts that correspond to the sensed increase in spooling velocity (acceleration), and store the docking point in a memory, as discussed above, and use it to determine when the linear material has been retracted past the docking point (e.g., second threshold, 1508 in FIG. 12) to control the winding operation (e.g., set when the automatic device 100 will operate at the drag speed and crawl speed) so that swing of the end of the linear device is limited to a desired amount or within a desired range. Accordingly, in some embodiments, the docking point location can be automatically set by the controller 224 based on sensed rotation information from the one or more sensors 803, and need not be manually set by a user.

As another example, the linear material may have an electrical receptacle, spray selector, remote, and/or the like on the end of the linear material. As the end of the linear material lifts off the ground, this may increase the weight of the linear material that the motor is winding as compared to when at least part of the linear material weight, including the electrical receptacle, spray selector, remote, and/or the like, was being supported by the ground. The increased total weight of linear material that motor is winding may decrease spooling velocity (deceleration). The winding of the linear material can decelerate when the time period between counts increases. The controller 224 can then set the docking point location as the number of counts that correspond to the point at which it senses a decrease in spooling velocity (deceleration), store the docking point location in a memory, as discussed above, and use it to determine when the linear material has been retracted past the docking point to control the winding operation. Accordingly, in some embodiments, the docking point can be automatically set by the controller 224 based on sensed rotation information from the one or more sensors 803, and need not be manually set by a user.

The controller 224 can also implement a crawl speed functionality. After the docking length is programmed at the direction of the user, the controller 224 can enable the crawl speed functionality in some implementations. This can include programming a "crawl length" of unwound linear material at which winding at the crawl speed can be initiated, for example, by the motor causing the spool member to wind the linear material at a reduced speed. Alternatively or additionally, the crawl speed functionality can be enabled independent of whether the docking length is programmed at the direction of a user.

In some embodiments, the controller 224 can set the crawl length to correspond to a predetermined number of counts (e.g., two counts) greater than the count at the length at which the linear material contacts the ground. In addition, the controller can adjust the docking length to correspond to the count at the ground contact length, or to a predetermined number of counts (e.g., two counts) greater than or less than the ground contact length. In this way, the motor can be controlled so as to wind the linear material at the crawl speed between the count corresponding to the crawl length and the count corresponding to the docking length.

Alternatively or additionally, the controller can set the crawl length a variety of other ways, such as setting the crawl length count to be a predetermined number of counts less than or greater than the count at the ground contact length, setting the crawl length at the direction of the user, or using any other suitable method.

In some embodiments, the crawl speed can be slower than the docking speed. In some implementations, winding at the crawl speed can slow the linear material such that substantially all momentum of the linear material is lost. This can prevent a distal end portion of the linear material from swinging uncontrollably when the linear material leaves a ground surface. When the length of unwound linear material reaches the docking length, the motor can cause the spool member to wind the linear material at the docking speed such that the linear material retracts smoothly toward the aperture 114 of the automatic device 110.

Although the method 1500 has been described in connection with five velocities and four threshold amounts of linear material for illustrative purposes, the principles and advantages of the method 1500 can be applied to methods that include any number of winding rates and/or threshold amounts of linear material. For example, in some embodiments, four velocities and three threshold amounts of linear material may be implemented.

Automatic Power Adjustment

In some embodiments, the automatic device 100 can spool the linear material at the same speed (e.g., second and third velocities) regardless of the height at which the device 100 is mounted, any variance in the strength of electric motors between devices 100, and regardless of ambient temperature around the device 100. Accordingly, the automatic device 100 provides a "cruise control" method of winding the linear material. The linear material can therefore be wound at a relatively "slow" speed between the first and third thresholds discussed above, so as to inhibit unwanted swing when the linear material lifts off the ground.

In some embodiments, the automatic device 100 has an automatic power adjustment control feature that allows a controller (such as the controller 224) to operate the motor 222 so that the device 100 has sufficient power to lift the linear material off the ground without stalling. For example, the linear material may have an electrical receptacle, spray selector, remote, and/or the like on the end of the linear material. As the end of the linear material lifts off the ground, this may increase the weight of the linear material that the motor is winding as compared to when at least part of the linear material weight, including the electrical receptacle, spray selector, remote and/or the like, is being supported by the ground. The increased total weight of linear material that the motor is winding may increase the load on the motor, which can be adjusted for with the automatic power adjustment control feature to help prevent stalling as discussed herein.

Using the automatic power adjustment control feature, the controller can operate the motor so that the device 100 adjusts the winding speed to stay substantially constant (e.g., constant) based on balancing a combination of the possible increased load on the motor due to increased weight when the linear material lifts off the ground and the possible decreased load on the motor due to a lack of friction between the linear material and the ground when the linear material lifts off the ground. The controller (e.g., microcontroller unit 610) can use sensed information from the one or more sensors 803 (e.g., Hall Effect sensors), which can register more than 2000 ticks or counts over the distance of a full (or complete) spooling of the linear material, to detect changes in the winding speed once the linear material lifts off the ground, and can vary the operation of the motor 222 to maintain a generally constant winding speed (e.g., such that the second and third velocities in FIG. 12 are generally equal). With reference to FIG. 12, once the linear material passes the first threshold and is being wound at the second velocity to inhibit swing, the controller can measure the time period between ticks or counts provided by the one or more sensors 803, and can adjust the power of the motor 222 (e.g., increase or decrease the power) to maintain a generally constant winding speed between the first and third thresholds. In some embodiments, the desired period between ticks or counts can be about 100 milliseconds (ms); however, in some embodiments, the desired period can be lower or greater than 100 ms (e.g., can be 150 ms). Once the linear material lifts off the ground (e.g., when the second threshold is reached), the controller can apply more or less power to the motor 222 to maintain the time period between ticks or counts, and therefore the winding speed, generally constant and to ensure the winding of the linear operation does not stall or increase.

Advantageously the automatic power adjust control allows the winding of the linear material at a generally constant speed over a distance x1 while the linear material is on the ground and a distance x2 once the linear material has lifted off the ground without stalling. Additionally, because the automatic power adjust control is based on sensed information (e.g., ticks or counts) from the one or more sensors 803 (e.g., Hall Effect sensors), the automatic power adjust control can be performed independent of the effects on the device 100 from ambient temperature changes, variances in electric motors, and the height at which the device 100 is mounted. Accordingly, the automatic power adjust control provides a reliable way of controlling the winding of linear material, particularly in automatic devices 100 mounted off the ground, to inhibit swing once linear material lifts off the ground.

Pull of Linear Material to Power on of Reel Mechanism

As discussed above, in some embodiment the automatic reel device 100 can be turned on (e.g., the motor 222 can be turned on) by pressing on a power button 108 on the interface panel 116. In some embodiments, the automatic reel device 100 can be turned on by actuating a remote control (e.g., a remote control disposed at a distal end of the linear material, such as a water hose, air hose or electrical cord).

In some embodiments, the automatic reel device 100 can be turned on manually by the user by pulling on the linear material. For example, in some embodiments, if the user pulls on the linear material by a certain amount (e.g., 10-18 inches) within a predetermined time range, the automatic reel device 100 can be turned on. In some embodiments, the controller (e.g., microcontroller unit 610) can use sensed information (e.g., number of ticks from rotation of the rotatable member 220 due to pulling on linear material) from the one or more sensors 803 (e.g., Hall Effect sensors). For example, where the automatic reel device 100 (e.g., floor, bench or wall installed reels) receives about 52 ticks or counts during a full winding such that the controller receives a tick every time the linear material translates or moves by about 8 inches, the controller can turn on the power relay (e.g., between the power source and the motor 222) when the controller registers two ticks (e.g., the linear material has been pulled by the user about 16 inches) within about two seconds. In another example, where the automatic reel device 100 (e.g., ceiling mounted cord reel, 14 gauge reel device) receives about 2000 ticks or counts during a full winding such that the controller registers a tick every time the linear material moves or translates about ¼ of an inch, the controller can turn on the power relay (e.g., between the power source and the motor 222) when the controller registers forty ticks (e.g., the linear material has been pulled by the user about 10 inches) within about 2 seconds. However, if the automatic reel device 100 or linear material is bumped accidentally, or otherwise accidentally moved, so that the controller does not register the required number of ticks or counts in the required time period, the controller will not turn on the power relay (e.g., power will not be communicated from the power source to the motor 222) and the stop point of the linear material is reset (e.g., saved in a memory) to the current position of the linear material. Of course the count and time values that trigger the winding operation can vary and are not limited to those provided in the examples above.

Winding to Power Off Automatic Reel Mechanism

As discussed above, in some embodiments (e.g., portable, wall, bench, ceiling mounted reel mechanisms) power to the automatic reel device 100 can be turned off via the interface panel 106 or the remote control before the linear material can be retracted onto the rotatable member 220. In some embodiments (e.g., 14 gauge cord reel system), power to the automatic reel device 100 can be automatically turned off upon termination of a winding operation. For example, as discussed above, the winding operation can begin 1602 upon receipt of a signal to begin winding material. Such a signal can be provided via the interface panel 106, via a remote control that transmits the initiation signal (e.g., retraction signal) to the controller 224, or via the user jerking or pulling on the linear material by a certain distance, as discussed above. In some embodiments, the user can trigger the winding operation by pulling on the linear material by a certain amount (e.g., by at least 20 ticks of the Hall Effect sensors, or about 5 inches of the linear material). The controller 224 can then turn off power to the power relay (e.g., disallow transfer of power between the power source and the motor 222) upon retraction of the linear material to the last stop point. That is, the winding operation can continue until it passes the last stop point, at which power to the power relay is turned off. By waiting for the linear material to wind past the last stop point, the system is advantageously able to ensure the user's intention to retract or wind the linear material and turn off power, and also advantageously inhibits hysteresis between the "pull to power on" feature described above and the "wind to power off" feature.

In some embodiments, the last stop point can be defined by the number of ticks or counts the controller 224 registers over the distance of a full unwinding of linear material on the rotatable member 220, and such a number can be stored in a memory. As the linear material is wound on the rotatable member 220, the controller can compare the number of ticks or counts for the amount of linear material being wound on the rotatable member 220 with said registered number of ticks or counts for a full (or complete) spooling of linear material to determine when the winding operation is complete (e.g., a last stop point), at which point the controller can turn off power to the power relay to turn power off to the automatic reel device 100 (e.g., turn power off to the motor 222 by disengaging the power relay between the power source and the motor). In some embodiments, the last stop point can be defined by the number of ticks or counts the controller 224 registers less than the number of ticks or counts associated with a full unwinding of linear material on the rotatable member 220, for example, to account for the proximal portion (e.g., strain relief portion) of linear material that remains wound on the rotatable member 220 when the linear material is deployed.

Winding in Strain Relief

It is desirable for some embodiments of an automatic device 100 (e.g., automatic reel device) to prevent all of the linear material from being unwound from the device 100 and to instead ensure that at least a portion of the linear material remains wound around the rotatable or spool member 220 or within the device 100, which can reduce strain on the linear material and help maintain the integrity of the linear material as the linear material is unwound from the rotatable member 220. Preventing all of the linear material from being unwound may also reduce strain on and help maintain the integrity of connecting components between the linear material and the spool member 220, as discussed in U.S. application Ser. No. 13/724,476, filed Dec. 21, 2012, the entire contents of which are hereby incorporated by reference and should be considered a part of this specification.

In certain embodiments, the controller 224 determines the number of revolutions of the rotatable member 220 in the unspooling direction by, for example, counting the number of revolutions of the spool member 220 (e.g., using sensors 803, such as Hall effect sensors), so that the length of linear material extracted from the device 100 is known. This value is compared to the known total length (i.e., total unspooled length) of the linear material or to a predetermined value for the maximum length of linear material to allow to be deployed. When that value is reached (e.g., strain relief portion), a braking mechanism 228 is activated. In some embodiments, the duty cycle of the brake is gradually increased as that maximum deployable length is approached so that the user does not experience a sudden imposing of the brake. For example, at a first threshold, such as with 10 feet remaining before the maximum length is reached, the brake is engaged at a first duty cycle, such as 60%. As the amount of remaining length drops, the brake's duty cycle can be increased. In some embodiments, the brake is fully engaged when the maximum deployable length is reached; in some embodiments, the brake may operate at a relatively high duty cycle of, for example, approximately 90% or higher. In some embodiments, the motor 222 is engaged (without any power) when the strain relief portion is reached, and the motor 222 acts as a brake within the automatic reel device 100 to inhibit rotation of the rotatable member or spool member 220 while in the strain relief portion. As discussed above, in some embodiments, the winding operation may be initiated when the user pulls on the linear material by an amount coinciding with at least about 20 ticks of the Hall Effect sensors. However, when the full amount of deployable linear material has been paid out so that the automatic reel device 100 is in the strain relief position, the controller 224 can initiate the winding operation of the linear material upon detecting that the linear material has been pulled by an amount corresponding to a lower number of counts or ticks of the Hall Effect sensors than when the automatic reel device 100 is not in the strain relief position (e.g., where all of the linear material except for the strain relief portion has been deployed). For example, in some embodiments, when the automatic reel device 100 is in the strain relief position, a winding operation can be triggered by the user pulling on the linear material by an amount corresponding to about four ticks or counts of the Hall Effect sensors. However, the trigger number of ticks/counts to initiate the winding operation can be lower or higher than this.

In some embodiments, the strain relief point can be set when a user fully extracts the linear material from the spooling member 220. The "flex" in the linear material can cause the spooling member to rotate in an opposite direction than the direction of rotation during extraction (from winding out to winding in) as the linear material is extracted to its full length. The Hall Effect sensors can sense the change in direction and set the number of counts (counting the number of revolutions of the spool member 220) that correspond to the length of the linear material at full extraction (by sensing the change in rotation direction). Based on the number of counts, the controller can set the strain relief portion as discussed herein. In some embodiments, the strain relief portion is reset when a new docking point is set as discussed herein.

The length of linear material deployed from the rotatable or spool member 220 is determinable from the number of revolutions of the spool member 220 and the diameter of the potentially multi-layer spool of linear material on the spool member 220. Thus, as the linear material is deployed, the controller 224 is able to determine when a sufficient length of linear material is deployed such that only the proximal end portion (e.g., the last 15 feet) of the linear material remains spooled about the spool member (e.g., the strain relief section of the linear material). When the controller 224 makes this determination, the controller 224 reduces the duty cycle of the PWM (pulse-width modulation) pulses to reduce the rotational velocity of the motor 222, preferably to zero. In some embodiments, the controller also activates the brake, as discussed in the previous paragraph.

In some embodiments, lengths other than approximately fifteen feet may be retained as undeployable, such as for example, about 1, 2, 3, 4, 5, 6, 7, 8, 9, 10, 11, 12, 13, 14, or more than 15 feet. For example, the particular length may be set and/or adjustable by the user through, e.g., the interface panel 106. In some embodiments, powered assist is terminated and the brake is enabled when 95 feet of a 100 foot spool of linear material have been deployed.

Embodiments may prevent or substantially prevent further deployment in a variety of other ways. For example, as previously discussed, the number of revolutions can be used to determine the length of linear material deployed or remaining spooled. The number of revolutions of the motor can also be calculated using a variety of electrical and mechanical means as previously disclosed and as known to one of skill in the art. In some embodiments, instead of deriving length of linear material from observed proxies such as the revolutions of the spool member or motor, may compare those revolution counts to predetermined maximum value for the number of revolutions of the spool member or motor, as appropriate. In some embodiments, instead of indirectly measuring the length of linear material deployed, may measure it directly, such as by counting the number of even spaced indicators on the linear material that have passed a sensor or using a variety of other methods known to those of skill in the art for determining the length of linear material that has passed through an aperture, such as by using a single indicator as is disclosed in U.S. Pat. No. 5,440,820 to Hwang.

In some embodiments, where the linear material has been deployed by the automatic reel device 100 such that only the proximal portion or strain relief portion of linear material is wound on the rotatable member 220, the user can still initiate the winding operation, as discussed above, by pulling or yanking on the linear material (in the manner described above). The user can yank or pull on the linear material by a certain amount (e.g., by six inches) while in the strain relief position, and pulling by such a length would allow the controller to begin the winding operation, as discussed above. Additionally, if the user pulls on the linear material by an amount less than the desired amount to initiate winding, the rotatable member 220 can rotate back so that the amount of linear material wound on the rotatable member 220 coincides with the predetermined strain relief amount.

The above detailed description of certain embodiments is not intended to be exhaustive or to limit the inventions to the precise form disclosed above. While specific embodiments of, and examples for, the inventions are described above for illustrative purposes, various equivalent modifications are possible within the scope of the inventions, as those skilled in the relevant art will recognize. For example, while processes or blocks are presented in a given order, alternative embodiments may perform routines, or employ systems having blocks, in a different order, and some processes or blocks may be deleted, moved, added, subdivided, combined, and/or modified. Each of these processes or blocks may be implemented in a variety of different ways. Also, while processes or blocks are at times shown as being performed in series, these processes or blocks may instead be performed in parallel, or may be performed at different times.

The teachings provided herein can be applied to other systems, not necessarily the systems described above. The elements and acts of the various embodiments described above can be combined to provide further embodiments.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the form of the methods and systems described herein may be made without departing from the spirit of the disclosure. For example, the automatic devices discussed herein can be used to spool linear material that can include electrical cords, air hoses, water hoses, etc. The accompanying claims and their equivalents are intended to cover such forms or modifications as would fall within the scope and spirit of the disclosure. Accordingly, the scope of the present inventions is defined only by reference to the appended claims.

What is claimed is:

1. A method for spooling linear material on an automatic reel device, the method comprising:

monitoring an amount of a linear material unwound from a rotatable spool member of the automatic reel device with one or more sensors;

sensing a pulling action on the linear material in a payout direction of the linear material;

controlling an electric motor to wind the linear material onto the rotatable spool member;

controlling the electric motor to stop rotating the rotatable spool member when the linear material is obstructed from being wound onto the rotatable spool member;

determining, with one or more sensors, whether a pull distance of said pulling action falls within a predetermined range based at least in part on sensed rotation of the rotatable spool member;

controlling the electric motor to wind the linear material onto the rotatable spool member when said pull distance falls within the predetermined range; and controlling the electric motor to not wind the linear material when said pull distance is greater than the predetermined range.

2. The method of claim 1, further comprising engaging a power relay between a power source and the electric motor when said pull distance falls within the predetermined range.

3. The method of claim 1, wherein the one or more sensors comprise one or more Hall Effect sensors configured to measure one or more counts indicative of one or more revolutions of the rotatable spool member, each of said one or more counts corresponding to an amount of linear material unspooled from the rotatable spool member.

4. The method of claim 3, wherein controlling the electric motor to stop rotating the rotatable spool member when the linear material is obstructed from being wound onto the rotatable spool member comprises sensing when a time period between measured counts is greater than a maximum count timeout.

5. The method of claim 1, wherein controlling the electric motor to stop rotating the rotatable spool member when the linear material is obstructed from being wound onto the rotatable spool member comprises sensing when electric current draw of the electric motor is greater than a current spike limit or a maximum current limit.

6. The method of claim 1, further comprising:

determining when the linear material passes a docking point location at which the linear material loses contact with a ground surface based at least in part on a sensed change in winding speed of the linear material; and adjusting power to the electric motor to maintain winding speed of an end of the linear material through the docking point location generally constant.

7. A method for spooling linear material on an automatic reel device, the method comprising:

monitoring an amount of a linear material unwound from a rotatable spool member of the automatic reel device with one or more sensors;

sensing a pulling action on the linear material in a payout direction of the linear material;

controlling an electric motor to wind the linear material onto the rotatable spool member;

determining when the linear material passes a docking point location at which the linear material loses contact with a ground surface based at least in part on a sensed change in winding speed of the linear material; and adjusting power to the electric motor to maintain winding speed of an end of the linear material through the docking point location generally constant.

8. The method of claim 7, further comprising setting the docking point location by sensing a pulling force on the linear material a first predetermined number of times while the end of the linear material is held in a first generally fixed position proximate the ground surface.

9. The method of claim 7, further comprising determining when the linear material passes the docking point location via one or more sensors that measure one or more counts indicative of one or more revolutions of the rotatable spool member, each of said one or more counts corresponding to an amount of linear material spooled or unspooled on the rotatable spool member, and wherein adjusting power to the electric motor to maintain winding speed through the docking point location generally constant is based at least in part on maintaining a time period between said one or more counts generally constant.

10. The method of claim 7, further comprising disengaging a power relay between a power source and the electric motor after winding the linear material around the rotatable spool member to a predetermined docking amount of the linear material.

11. The method of claim 7, further comprising disengaging a power relay between a power source and the electric motor after winding the linear material around the rotatable spool member to a last stop point corresponding to a complete spooling of the linear material.

12. The method of claim 7, further comprising setting a predetermined grasping length of the linear material by sensing a pulling force on the linear material while an end of the linear material is held in a second generally fixed position corresponding to a desired grasping length to facilitate grasping of the linear material for the pulling action.

13. The method of claim 7, further comprising controlling the electric motor to wind the linear material below a maximum translational velocity of the linear material by decreasing rotational velocity of the rotatable spool member as more linear material is spooled onto the rotatable spool member during winding, thereby increasing a winding diameter of the linear material around the rotatable spool member.

14. The method of claim 7, further comprising:

determining, with one or more sensors, whether a pull distance of said pulling action falls within a predetermined range based at least in part on sensed rotation of the rotatable spool member;

controlling the electric motor to wind the linear material onto the rotatable spool member when said pull distance falls within the predetermined range; and controlling the electric motor to not wind the linear material when said pull distance is greater than the predetermined range.

15. An automatic reel apparatus for spooling linear material, the apparatus comprising:

a spool member configured to rotate bi-directionally to spool and unspool the linear material with respect to the spool member;

an electric motor having an output shaft and configured to rotate the spool member via the output shaft;

one or more sensors configured to generate one or more signals indicative of rotation of the spool member;

a controller configured to control operation of the electric motor, the controller configured to:

monitor a length of the linear material unwound from the spool member based at least in part on the one or more signals indicative of rotation of the spool member generated by the one or more sensors and communicated to the controller;

control the electric motor to wind the linear material around the spool member upon detection of a pulling force on the linear material;

control the electric motor to wind the linear material around the spool member upon detection of the pulling force on the linear material over a pull distance within a predetermined range;

control the electric motor to not wind the linear material around the spool member upon detection that the pulling distance is greater than the predetermined range; and control the electric motor to stop upon detection of a holding force on the linear material that holds the linear material in place.

16. The automatic reel apparatus of claim 15, wherein the controller is further configured to detect the holding force by sensing a first spike in electric current draw of the electric motor corresponding to the spool member not rotating at a first length of the linear material unwound from the spool member, and wherein the controller is further configured to set a home position corresponding to the first length of the linear material unwound from the spool member.

17. The automatic reel apparatus of claim 15, wherein the controller is further configured to control the electric motor to not wind the linear material around the spool member upon detecting the pulling distance within the predetermined range when the pulling force is applied on the linear material within a predetermined time period of detecting the holding force on the linear material.

18. The automatic reel apparatus of claim 15, wherein the controller is further configured to stop unwinding of the linear material from the spool member at a maximum deployable length of the linear material to provide a strain relief portion of the linear material allowing to pull the linear material to initiate winding of the linear material around the spool member.

19. The automatic reel apparatus of claim 18, further comprising a brake configured to inhibit rotation of the spool member, wherein the controller is further configured to engage the brake to stop unwinding of the linear material from the spool member at the maximum deployable length of the linear material.

20. The automatic reel apparatus of claim 15, wherein the controller is further configured to control the electric motor to stop when electric current draw of the motor is greater than a current spike limit or a maximum current limit corresponding to when the linear material is obstructed from being wound onto the spool member.

21. The automatic reel apparatus of claim 15, wherein the one or more sensors are mounted on the output shaft of the motor on an opposite side of the motor from the spool member on which the linear material is wound to help accurately measure rotation of the spool member.

22. The automatic reel apparatus of claim 15, wherein the one or more sensors comprise one or more Hall Effect sensors configured to measure one or more counts indicative of one or more revolutions of the spool member, each of said one or more counts corresponding to an amount of linear material spooled or unspooled on the spool member.

23. The automatic reel apparatus of claim 22, wherein the controller is further configured to control a power output of the motor based at least in part on said one or more counts to maintain winding speed of the linear material generally constant.

24. The automatic reel apparatus of claim 22, wherein the controller is further configured to adjust power to the motor such that a time period between said one or more counts is generally constant.

25. The automatic reel apparatus of claim 15, wherein the controller is further configured to:

determine when the linear material passes a docking point location at which the linear material loses contact with a ground surface based at least in part on a sensed change in winding speed of the linear material; and adjust power to the electric motor to maintain winding speed of an end of the linear material through the docking point location generally constant.

* * * * *